US006033049A

United States Patent [19]

Fukuda

[11] Patent Number: 6,033,049

[45] Date of Patent: Mar. 7, 2000

[54] PRINTER AND PRINTING METHOD

[75] Inventor: Toshio Fukuda, Kanagawa, Japan

[73] Assignee: Sony Corporation, Tokyo, Japan

[21] Appl. No.: 08/914,099

[22] Filed: Aug. 19, 1997

[30] Foreign Application Priority Data

Aug. 22, 1996 [JP] Japan ..... 8-221308
Jan. 22, 1997 [JP] Japan ..... 9-009529

[51] Int. Cl.[7] ..... B41J 2/015

[52] U.S. Cl. ..... 347/20; 347/95; 347/100

[58] Field of Search ..... 347/20, 21, 47, 347/95, 96, 98, 100

[56] References Cited

U.S. PATENT DOCUMENTS 5,777,636 7/1998 Naganuma et al. ..... 347/20 X
5,811,019 9/1998 Nakayama et al. ..... 347/47 X
5,825,379 10/1998 Kagami ..... 347/20

FOREIGN PATENT DOCUMENTS 0 655 337 11/1994 European Pat. Off. .
4-296106 5/1992 Japan .

*Primary Examiner*—Sandra Brase
*Attorney, Agent, or Firm*—Hill & Simpson

[57] ABSTRACT

A printing method including the steps of allowing a quantitative medium to seep out, and discharging a discharge medium to mix the quantitative medium and the discharge medium with each other so as to discharge and apply the quantitative medium and the discharge medium to the surface of a recording medium, wherein relationship as $q-p \geqq 0$ is satisfied on the assumption that the surface tension of the quantitative medium is p (dyn/cm) and the surface tension of the discharge medium is q (dyn/cm).

28 Claims, 6 Drawing Sheets

PRINTER AND PRINTING METHOD

BACKGROUND OF THE INVENTION

1. Field of the Invention

The present invention relates to a printing method and a printer, and more particularly to a printing method and a printer using a discharge medium and a quantitative medium arranged in such a manner that their physical properties have an adequate relationship, whereby exhibiting excellent discharge stability and capable of accurately expressing a gradient image.

More particularly, the present invention relates to a printer of a type for mixing and discharging a quantitative medium and a discharge medium, and more particularly to a printer exhibiting stable discharge and accurate gradation expression because of the specified relationship between the viscosity of a quantitative medium and that of a discharge medium.

2. Description of Related Art

In recent years, an operation called "desktop publishing" for publishing a document by using a computer has widely been performed in business offices and so forth. Moreover, requirements for outputting a natural colored image, such as a photograph, in addition to characters and graphics have been increased. Since New Year's cards, greeting cards and the like have been printed usually in the field of personal use, requirements of the above-mentioned type have been increased. As a result, a high quality and natural image has been required to be printed, thus resulting in gradation expression capable of forming halftone images being made to be important in the above-mentioned circumstance.

A so-called "on-demand" type printer has a structure that ink droplets are discharged from nozzles when required to print an image in accordance with a control signal supplied in response to a recording signal so as to be applied to a recording medium such as a paper sheet or a film so that an image is recorded. Since the on-demand type printer enables the size and cost to furthermore be reduced in the future, the printers of this type have rapidly and widely been employed.

Among a variety of the suggested methods of discharging ink droplets from nozzles, a method using a piezoelectric device or that using a heat generating device has been usually employed. The former method is arranged to use deformation of the piezoelectric device which enables pressure to be applied to ink required to be discharged. The latter method has a structure formed in such a manner that the heating device heats and vaporizes ink in the nozzles to generate bubbles for discharging ink.

To perform the gradient expression realized by forming halftone images in a pseudo manner with the above-mentioned on-demand type printer, a variety of methods have been suggested. A first method has a structure in which the voltage or the width of voltage pulses which are applied to the piezoelectric device or the heating device is changed to control the size of the droplet so as to vary the diameter of a dot to be printed in order to express a gradient image.

However, the first method cannot form a droplet having a satisfactorily small diameter because ink cannot be discharged 3if the voltage or the width of pulses arranged to be supplied to the piezoelectric device or the heating device is reduced excessively. Thus, there arises a problem in that the number of gradients, which can be expressed, is too small. In particular, a low-density image cannot easily be expressed. Therefore, the first method is unsatisfactory to print a natural image.

A second method has a structure that the diameter of the dot is not changed and one pixel is formed by a matrix composed of, for example, 4 dots×4 dots so as to express a gradient image in matrix units by performing an image process, such as a dither method or an error diffusion method. In this case, an image processing technique, such as an outline highlighting process and/or a smoothing process is sometimes combined with the second method.

The second method, which is capable of expressing 17 gradients when one pixel is composed of a matrix in the form of 4 dots×4 dots, however, encounters deterioration in the resolution to ¼ if an image is printed with a dot density employed in the first method. In this case, the formed image is too rough to obtain a satisfactory print of a natural image.

If a precise image process is performed to overcome the above-mentioned problem, various problems arise in that circuits become too complicated, the calculation speed is reduced and thus excessively long time is required to complete the printing operation.

Accordingly, inventors of the present invention intended to make clear the principles of the problems experienced with the conventional on-demand type printer have suggested a printer as disclosed in, for example, Japanese Patent Laid-Open No. 5-201024. The printer has a structure in which diluted ink is prepared by mixing ink and diluent, which is a transparent solvent, with each other at a predetermined mixture ratio immediately before discharge so as to immediately discharge diluted ink through nozzles. Thus, a recording medium is applied with the ink droplets so that an image is recorded. Among the above-mentioned methods, the foregoing method, in which ink serving as a quantitative medium and diluent serving as a discharge medium are used such that ink serving as the quantitative medium is mixed with the diluent serving as the discharge medium to prepare diluted ink, and then the discharge medium is discharged to record an image, is called a "carrier jet method". Note that the above-mentioned printer does not arise any problem if the diluent is used as the quantitative medium and ink is used as the discharge medium.

The carrier jet printer is able to control the concentration of the diluted ink droplet, which is discharged, so as to vary the density of each dot which is printed. Therefore, a natural image including a sufficiently large number of halftones can be printed without deterioration in the resolution.

The printer adapted to the carrier jet method exhibits considerably wide degree of freedom in selecting components including ink and the diluent.

As described above, the printer of a type arranged in such a manner that ink and the diluent are mixed with each other so as to be discharged has a requirement for accurately controlling the mixture ratio of ink and the diluent in order to accurately express the gradation corresponding to image data. To achieve this, an operation for allowing the quantitative medium to seep from a second nozzle for discharging the quantitative medium toward a first nozzle for discharging the discharge medium and an operation for discharging the discharge medium from the first nozzle so as to mix and discharge the quantitative medium and the discharge medium must be performed accurately. The stability in discharging the quantitative medium and the discharge medium from each nozzle is a very important factor to obtain a required result of the printing operation.

Although the conventional ink jet printer is simply required to make the viscosity of ink to be suitable for use in the discharging operation because the printer of this type performs only the operation for discharging ink. However, the carrier jet printer, structured to discharge the mixed droplet after it has performed the operation for mixing ink and the diluent with each other, is needed to make the viscosity of each solution to be suitable for use in the mixing operation as well as in the discharging operation.

SUMMARY OF THE INVENTION

To achieve the above-mentioned objects, according to one aspect of the present invention, there is provided a recording method having an arrangement that a quantitative medium is mixed with a discharge medium at a predetermined mixture ratio immediately before the mixed solution, which is discharged, is discharged and then the mixed solution is discharged so as to be applied to the surface of a recording medium, the method comprising the step of satisfying the relationship as $q-p \geqq 0$ on the assumption that the surface tension of the quantitative medium is p (dyn/cm) and the surface tension of the discharge medium is q (dyn/cm).

It is preferable that the recording method according to the present invention has an arrangement such that the relationship as $\beta-\alpha \geqq 0$ is satisfied on the assumption that the viscosity of the quantitative medium is $\alpha$ (cp) and the viscosity of the discharge medium is $\beta$ (cp).

The recording method according to the present invention uses the discharge medium and the quantitative medium satisfying the relationship as $q-p \geqq 0$ on the assumption that the surface tension of the discharge medium is q (dyn/cm) and that of the quantitative medium is p (dyn/cm) and has an arrangement that the mediums are mixed with each other immediately before the mediums are discharged at a predetermined mixture ratio and then the mixed solution is discharged and applied to the surface of a recording medium. Since the surface tensions of the discharge medium and the quantitative medium have the above-mentioned relationship, an excellent mixing characteristic can be realized. Moreover, the mixed solution having the excellent mixing characteristic can be discharged.

When the recording method according to the present invention has an arrangement such that the relationship as $\beta-\alpha \geqq 0$ is satisfied on the assumption that the viscosity of the quantitative medium is $\alpha$ (cp) and the viscosity of the discharge medium is $\beta$ (cp), discharge can stably be performed after they have been mixed with each other.

It is preferable that the recording method according to the present invention has an arrangement that time required from mixing the discharge medium and the quantitative medium with each other to application of the mixed solution to the surface of the recording medium is 1 (msec) or shorter.

In the recording method according to the present invention, a factor of time considerably affects the operation for mixing the quantitative medium and the discharge medium with each other. The factor of time means a period of time required from mixing the quantitative medium and the discharge medium in predetermined quantities to application of the same to the surface of a recording medium. It can easily be expected that the longer the period of time is, a further satisfactory influence on the mixing phenomenon is realized.

The period of time required from mixing the quantitative medium and the discharge medium in predetermined quantities to the application of the mixed solution to the surface of a recording medium can be elongated by elongating the period of time from the quantitative mixture to the discharge, by lengthening the distance from the discharge nozzles to the recording medium or by reducing the speed of the discharge solution.

However, each of the above-mentioned methods has a problem. That is, if the period of time taken from the quantitative mixture to the discharge is elongated, the discharging frequency is lowered excessively to satisfy the current requirement for performing a high speed printing operation. The above-mentioned method cannot be employed. Moreover, the method of lengthening the distance from the discharge nozzles to the recording medium and that of reducing the speed of the discharge solution adversely affect the discharging characteristic of ink and deteriorate accuracy of the position to which ink is applied. Therefore, each of the methods has a limitation.

Therefore, if each of the discharging frequency or the distance from the discharge nozzles to a recording medium and the like is determined to be a practical value, the period of time required from the quantitative mixture in predetermined quantities to the application to the recording medium is not longer than 1 ms, preferably 500 $\mu$s or shorter.

The recording method according to the present invention is required to have a structure that the quantitative medium is either ink or the diluent and the discharge medium is the residual, that is, ink or the diluent which is not the quantitative medium.

In the case where the quantitative medium is ink and the discharge medium is the diluent, it is preferable that the surface tension of the quantitative medium is 25 (dyn/cm) to 60 (dyn/cm) and that of the discharge medium is 30 (dyn/cm) to 70 (dyn/cm). If also the viscosity is specified, it is preferable that the viscosity of the quantitative medium is 1 (cp) to 15 (cp) and that of the discharge medium is 1 (cp) to 15 (cp).

In the case where the quantitative medium is the diluent and the discharge medium is ink, it is preferable that the surface tension of the quantitative medium is 25 (dyn/cm) to 60 (dyn/cm) and that of the discharge medium is 30 (dyn/cm) to 60 (dyn/cm). If also the viscosity is specified, it is preferable that the viscosity of the quantitative medium is 1 (cp) to 15 (cp) and that of the discharge medium is 1 (cp) to 15 (cp).

It is preferable that the solvent for the ink and the diluent is composed of water and water-soluble organic solvent. Moreover, it is preferable that the solvent also contains a surface active agent.

Moreover, a printer according to the present invention comprises a printing head having a first pressure chamber into which a discharge medium is introduced, a second pressure chamber into which a quantitative medium is introduced, a first nozzle allowed to communicate with the first pressure chamber and a second nozzle allowed to communicate with the second pressure chamber which are opened adjacently and structured to discharge the discharge medium from the first nozzle after the quantitative medium has been allowed to seep from the second nozzle toward the first nozzle so that the quantitative medium and the discharge medium are mixed and discharged, wherein the discharge medium and the quantitative medium satisfy the relationship as $\alpha-\beta \geqq 0$ on the assumption that the viscosity of the discharge medium is $\alpha$ (cp) and the viscosity of the quantitative medium is $\beta$ (cp).

The printer according to the present invention arranged to discharge a discharge medium from a first nozzle so as to mix and discharge the quantitative medium and the discharge medium after the quantitative medium is allowed to seep from the second nozzle allowed to communicate with the second pressure chamber to which the quantitative medium is introduced toward the first nozzle allowed to communicate with the first pressure chamber into which the discharge medium is introduced and opened adjacently to the second nozzle is structured in such a manner that the discharge medium and the quantitative medium satisfy the relationship as $\alpha-\beta \geqq 0$ on the assumption that the viscosity of the discharge medium is $\alpha$ (cp) and the viscosity of the quantitative medium is $\beta$ (cp). Therefore, the viscosity of the quantitative medium and that of the discharge medium have the relationship which is suitable for use in the mixing operation and the discharging operation. As a result, they have satisfactory discharge stability.

Other objects, features and advantages of the invention will be evident from the following detailed description of the preferred embodiments described in conjunction with the attached drawings.

DETAILED DESCRIPTION OF PREFERRED EMBODIMENTS

An embodiment of the present invention will now be described with reference to the drawings.

A printer according to the present invention is a so-called on-demand type printer and having a structure so-called a carrier jet printer arranged in such a manner that ink is positioned in the quantitative medium portion and diluent is positioned in the discharge medium portion to discharge a mixed solution prepared by mixing ink and the diluent with each other to a recording medium, such as a paper sheet. In this embodiment, a pressure device, such as a piezoelectric device, is employed as a quantitative means for discharging ink or the diluent. Note that the diluent may be the quantitative medium and ink may be the discharge medium.

Figure 1:
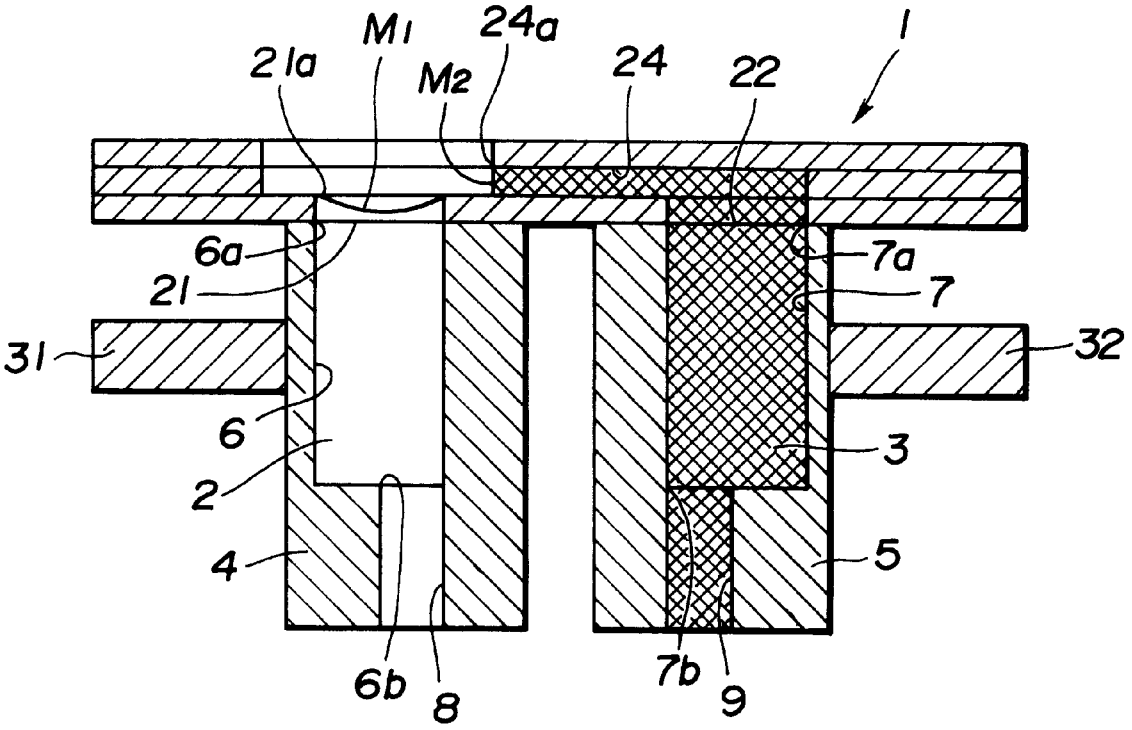
FIG. 1 is a schematic cross sectional view showing an essential portion of an embodiment of a printer according to the present invention.

The printer according to this embodiment, as shown in FIG. 1, comprises an orifice plate 1 having a nozzle, a first solution accommodation container 4 connected to the orifice plate 1 and arranged to contain a first solution 2 and a second solution accommodation container 5 arranged to contain a second solution 3.

Figure 2:
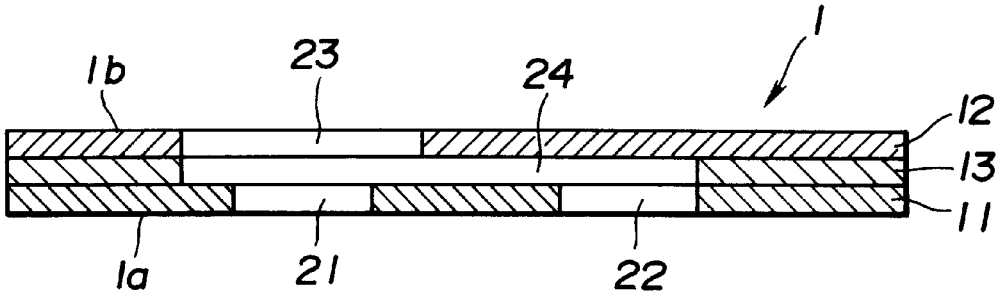
FIG. 2 is an enlarged schematic cross sectional view showing an essential portion of an orifice plate of the printer according to the embodiment.

The orifice plate 1, as shown in FIG. 2, comprises, a first plate 11, a second plate 12 and a third plate 13. The third plate 13 is held between the first plate 11 and the second plate 12 from directions of their thicknesses so as to be formed into a laminated plate.

The first plate 11, that is, a surface 1*a* of the two surfaces of the laminated plate has first and second supply ports 21 and 22, while the second plate 12, that is, another surface 1*b* of the laminated plate has a nozzle 23 for discharging a mixed solution prepared by mixing two types of solutions supplied through the first and second supply ports 21 and 22.

The third plate 13 is disposed between the first plate 11 and the second plate 12. The third plate 13 is made of a dry film resist and provided with a fluid passage 24 formed therein. The fluid passage 24 is connected to the first and second supply ports 21 and 22 and also connected to the nozzle 23.

Figure 3:
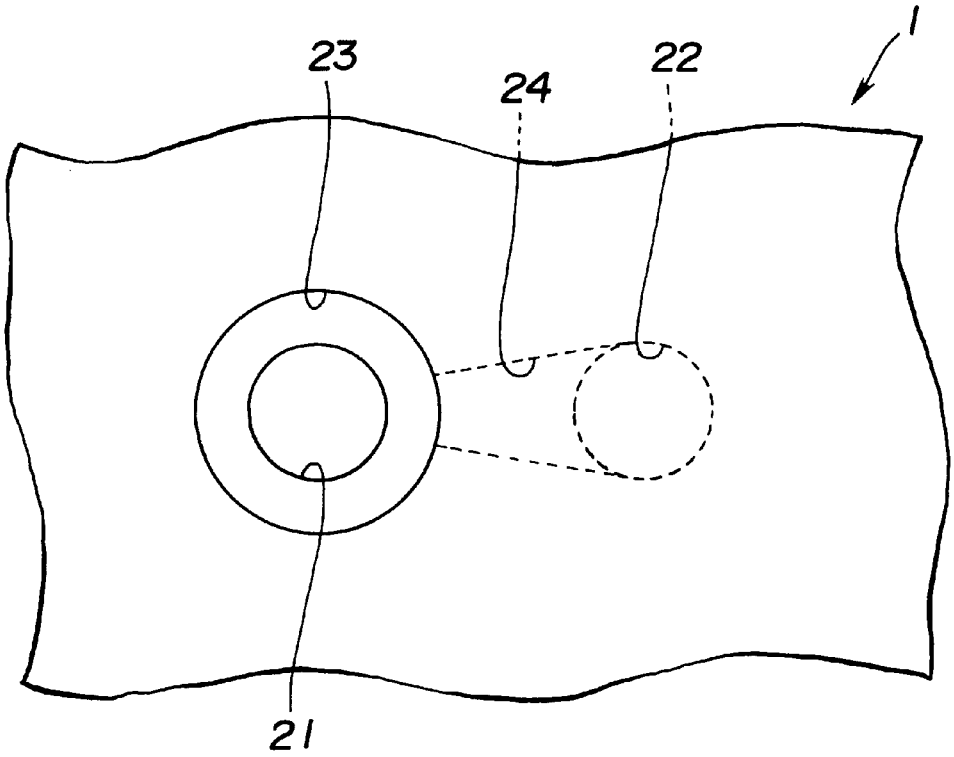
FIG. 3 is an enlarged schematic cross sectional view showing an essential portion of the orifice plate of the printer according to the embodiment.

The first and second supply ports 21 and 22 are, in the form of circular through holes, formed in the first plate 11 as shown in FIG. 3, which is a plan view from the surface 1*b* opposite to the surface 1*a* in which the first and second supply ports 21 and 22 of the orifice plate 1 are formed. Note that the first and second supply ports 21 and 22 are not required to be the circular through holes. For example, the shape may be an elliptic or a rectangular shape.

The nozzle 23 is formed into a circular through hole formed opposite to the first supply port 21 and having a diameter larger than the diameter of the first supply port 21. Although it is preferable that the nozzle 23 has the diameter larger than that of the first supply port 21 as described above, the diameter may be the same as that of the first supply port 21 or smaller than the same. Similarly to the first and second supply ports 21 and 22, the nozzle 23 is not required to be the circular through hole. For example, the nozzle 23 may be an elliptic or rectangular opening.

Moreover, the fluid passage 24 is, as shown in FIG. 3, tapered such that the width of the fluid passage 24 is gradually reduced in a direction from the second supply port 22, which is not opposite to the nozzle 23, to the nozzle 23. Note that the fluid passage 24 may be formed into a straight shape or tapered in such a manner that the width is gradually enlarged. The leading end of the fluid passage 24 is connected to the side wall of the nozzle 23 so that a portion of the nozzle 23 is formed.

The first and second solution accommodation containers 4 and 5 connected to the orifice plate 1 will now be described.

The first solution accommodation container 4 is a container including a box-like hollow portion 6, as shown in FIG. 1. An opening 6*a* formed at the position corresponding to the upper surface of the hollow portion 6 is connected to the first supply port 21 of the orifice plate 1. Also the second solution accommodation container 5 is a container including a box-like hollow portion 7. An opening 7*a* formed at the position corresponding to the upper surface of the hollow portion 7 is connected to the second supply port 22.

A through hole 8 connected to the hollow portion 6 and also connected to the outside is formed in a bottom surface 6*b* of the first solution accommodation container 4 opposite to the opening 6*a* of the hollow portion 6. Also a through hole 9 connected to the hollow portion 7 and also connected to the outside is formed in a bottom surface 7*b* of the second solution accommodation container 5 opposite to the opening 7*a* of the hollow portion 7.

As a result, the printer according to this embodiment has the through hole to which the through hole 8, the hollow portion 6 and the first supply port 21 are connected and arranged to contain diluent as the first solution 2. On the other hand, the through hole is formed to which the through hole 9, the hollow portion 7, the second supply port 22 and the fluid passage 24 are connected and arranged to contain ink as the second solution 3.

Moreover, piezoelectric devices 31 and 32 respectively are disposed on the outer surfaces of the first and second solution accommodation containers 4 and 5. The piezoelectric devices 31 and 32 are deformed in response to signals respectively supplied thereto so that their changed pressures change the pressures in the first and second solution accommodation containers 4 and 5.

The printer according to this embodiment and comprising the piezoelectric devices 31 and 32 is arranged to adjust voltage pulses to be supplied to the piezoelectric devices 31 and 32 so as to adjust the mixture ratio of the second solution 3 contained in the mixed solution, that is, the density of ink.

Therefore, when the printer performs a printing operation, the second solution 3, which is ink to be supplied through the second supply port 22, is enclosed in the fluid passage 24 attributable to the capillary phenomenon so that a second meniscus M2 is formed at a leading end 24*a* of the fluid passage 24 and a first meniscus M1 is formed at a leading end 21*a* of the first supply port 21 by the first solution 2 which is the diluent supplied from the first supply port 21, as shown in FIG. 1.

Figure 4:
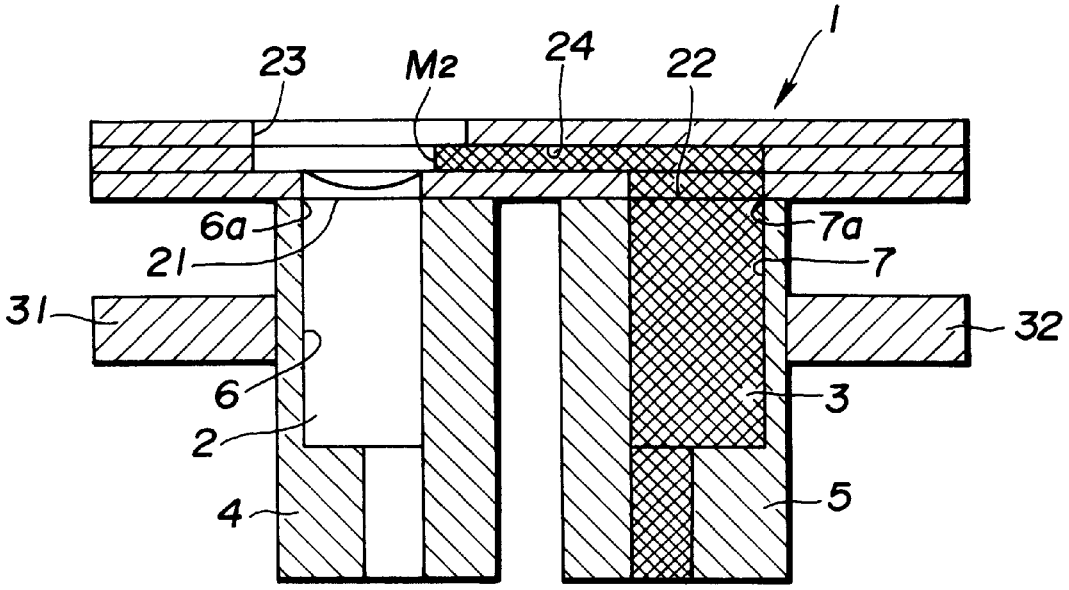
FIG. 4 is a cross sectional view sequentially showing the operation of the printer according to the embodiment such that a state in which a meniscus is formed in the orifice plate is schematically illustrated.

Then, the piezoelectric device 32 provided for the second solution accommodation container 5 arranged to contain the second solution 3 is supplied with voltage pulses to apply pressure to the second solution accommodation container 5 so as to raise the pressure in the hollow portion 7 and pressure P2 in the fluid passage 24. As a result, the second meniscus M2 of the second solution 3 is, as shown in FIG. 4, shifted to the nozzle 23 serving as a mixing chamber so that the second solution 3 is pushed into the nozzle 23. Note that the quantity of the second solution 3 which is pushed as described above is controlled in accordance with the pressure which is applied to the second solution accommodation container 5 from the piezoelectric device 32. That is, the quantity is controlled in accordance with the voltage level or the width of the voltage pulses to be supplied to the piezoelectric device 32.

Figure 5:
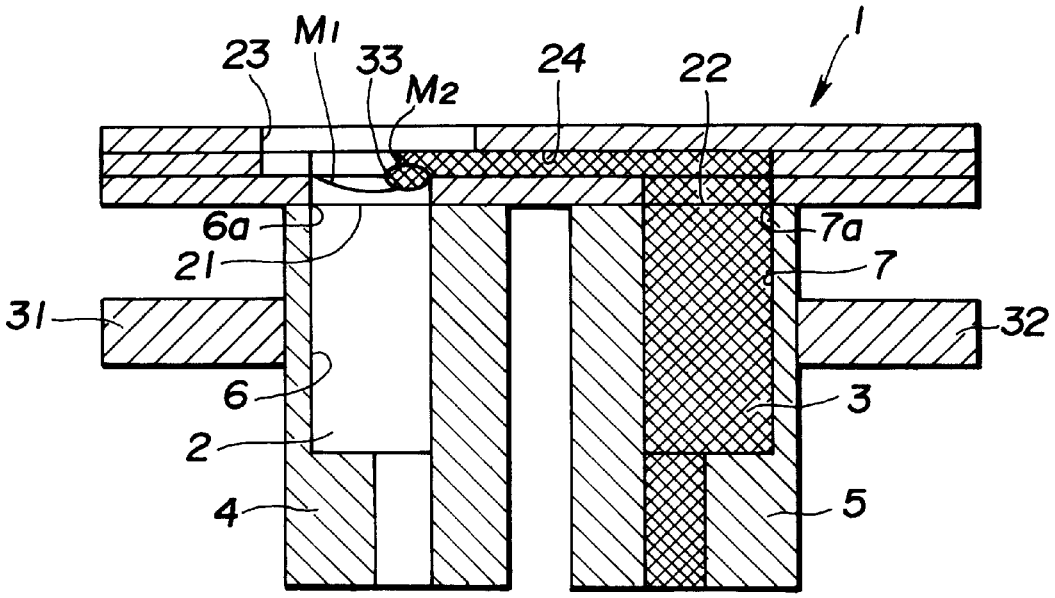
FIG. 5 is a cross sectional view sequentially showing the operation of the printer according to the embodiment such that a state in which a second meniscus is in contact with a first meniscus is illustrated.

When the degree of rise of the pressure P2 or the period of time for which the same is raised is adjusted, the second meniscus M2 is, as shown in FIG. 5, brought into contact with the first meniscus M1 of the first solution 2 in the nozzle 23. As a result, the droplet 33 of the second solution is left in the nozzle 23.

That is, the fluid passage 24 serves as a second nozzle for discharging the quantitative medium so that ink, which is the quantitative medium, is allowed to seep from the second nozzle to the first supply port 21 which serves as a first nozzle.

Figure 6:
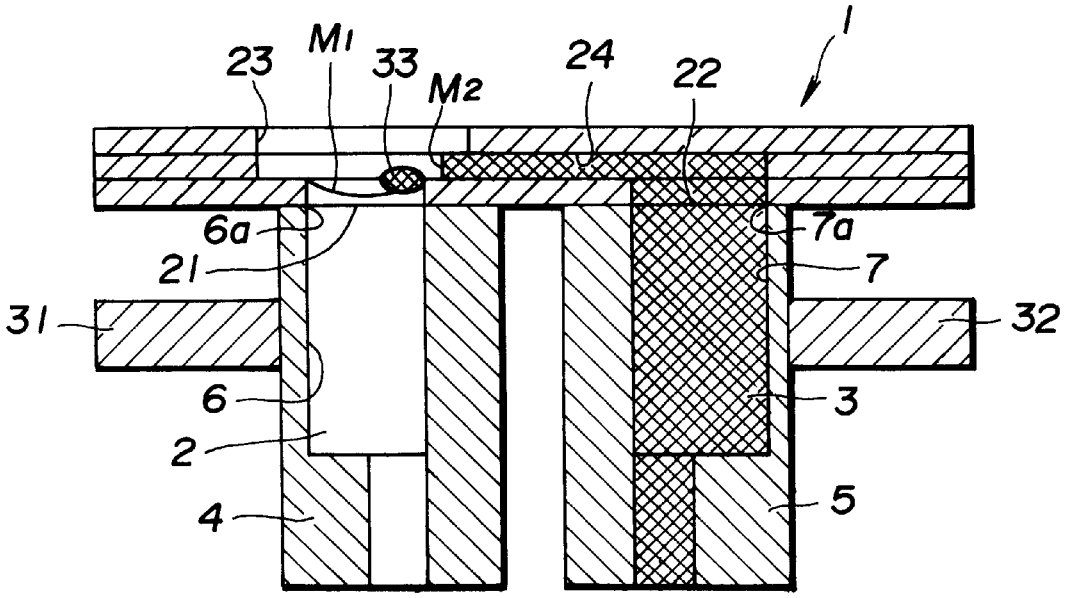
FIG. 6 is cross sectional view sequentially showing the operation of the printer according to the embodiment such that a state in which the second meniscus has been moved rearwards and separated from first solution is illustrated.
Figure 7:
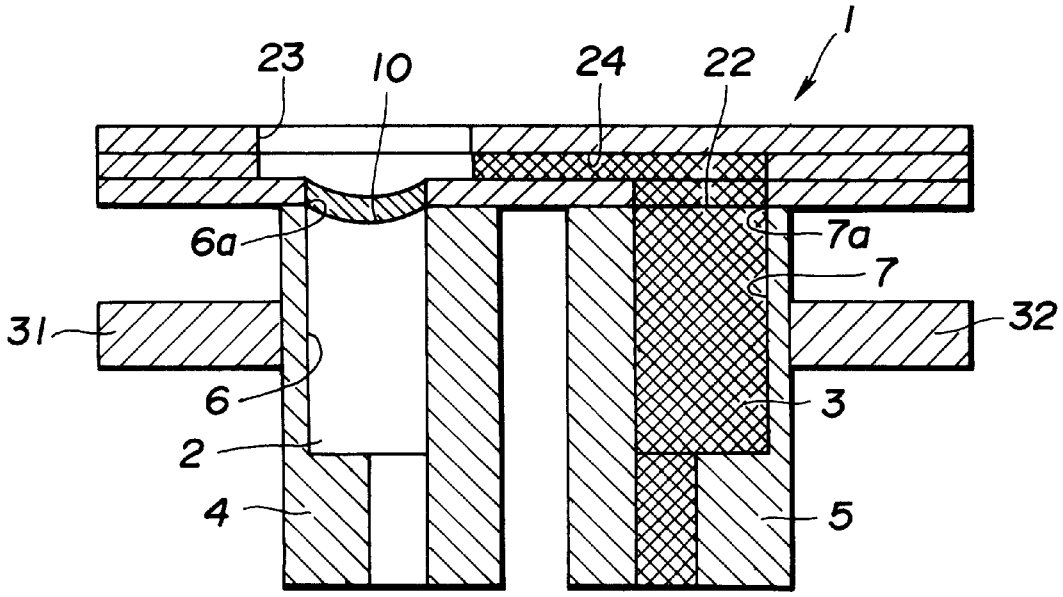
FIG. 7 is a cross sectional view sequentially showing the operation of the printer according to the embodiment such that a state in which mixed solution has been formed in a nozzle is illustrated.

Then, the voltage pulses to be supplied to the piezoelectric device 32 provided for the second solution accommodation container 5 are returned to the original values. Since it is stable for the second meniscus M2 of the second solution 3 to be positioned at which it does not in contact with the first meniscus M1 of the first solution 2 in a state where the pressure of the second solution 3 in the fluid passage 24 is not raised, the second meniscus M2 is moved rearwards, separated from the first solution 2 and finally formed at the leading end 24*a* of the fluid passage 24, as shown in FIG. 6. Thus, mixed solution 10 having an intermediate concentration is formed in the nozzle 23, as shown in FIG. 7.

The droplet 33 of the second solution is shown in the drawing to explain a transient state, the droplet 33 of the second solution being allowed to solely exist in a very short period of time. That is, the droplet 33 is immediately mixed with the first solution 2 so that the mixed solution 10 is formed.

When the degree of rise of the pressure P2 of the second solution 3 and the period of time for which the same is raised, that is, the voltage level or the pulse width of the voltage pulses to be supplied to the piezoelectric device 32 is further raised or enlarged, the mixture ratio of the second solution 3 to be contained in the mixed solution 10, that is, the concentration of ink can be raised. That is, the mixture ratio (the concentration of ink) of the generated mixed solution 10 can be adjusted by changing the degree of rise of the pressure P2 and the period of time for which the same is raised, that is, the voltage level or the width of the voltage pulses to be supplied to the piezoelectric device 32. Therefore, mixed solution, which is diluted ink capable of expressing a half tone image, is prepared at this time.

Figure 8:
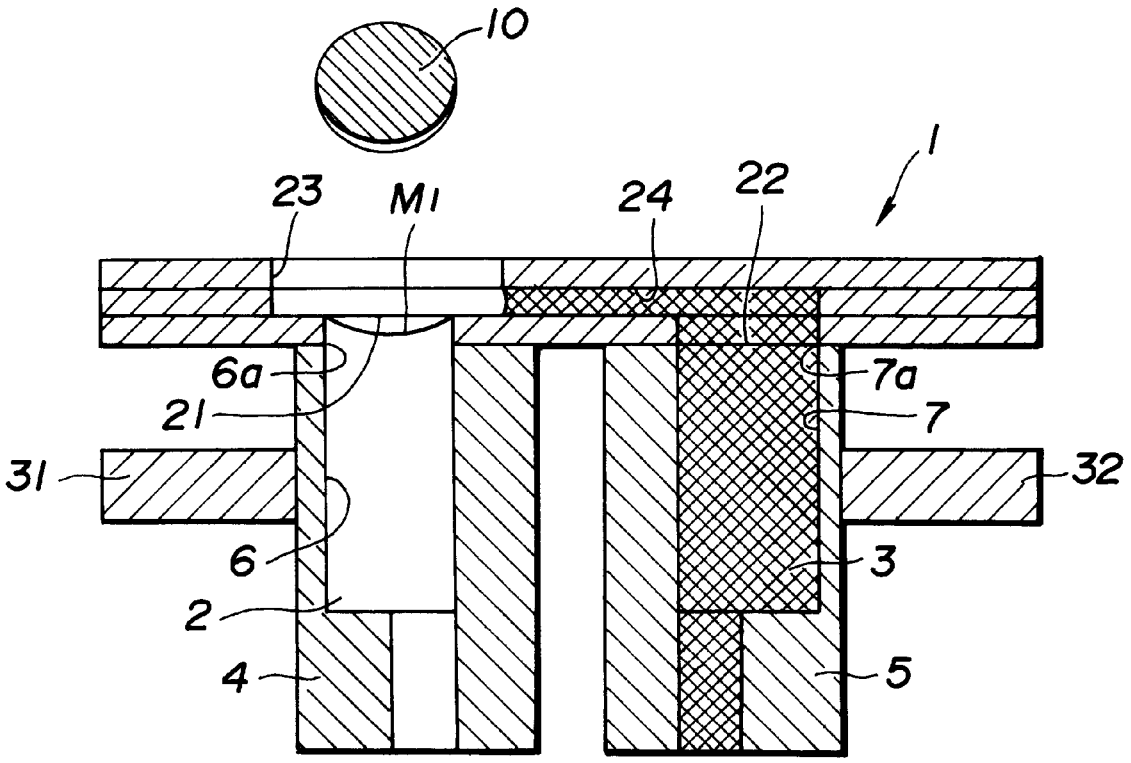
FIG. 8 is a cross sectional view sequentially showing the operation of the printer according to the embodiment such that a state in which the mixed solution has been discharged is illustrated.

Then, the piezoelectric device 31 provided for the first solution accommodation container 4, which contains the first solution 2, is supplied with voltage pulses to apply pressure to the first solution accommodation container 4 so as to raise the pressure in the hollow portion 6 and as well as raise the pressure P1 in the first supply port 21. As a result, the mixed solution 10 is shifted to the nozzle 23. When the pressure P1 in the first supply port 21, that is, the pressure of the first solution 2, is raised, the mixed solution 10 is, as shown in FIG. 8, discharged to the atmosphere so that the mixed solution 10 is allowed to adhere to a recording sheet (not shown) which is a recording medium. That is, the first supply port 21 serves as the first nozzle. On the other hand, a new first meniscus M1 is formed in the first supply port 21 to which the first solution 2 is supplied. At this time, one droplet of the mixed solution is discharged in response to one voltage pulse which is the pressure pulse for applying pressure. The above-mentioned operation is repeated so that a halftone image is recorded.

When a color image is formed, printers corresponding to, for example, yellow, magenta, cyan and block are used as one set of head assembly (consisting of four printers in this case). Then, a multiplicity of head assemblies having the above-mentioned structure may be disposed on a line to record a color image.

The above-mentioned sequential operations of the printer have been described as an example. The timing of each operation and the states, for example, the shape of the mixed solution, the containing operation and the like are varied according as the structural factors, such as the size of the supply port and that of the nozzle, the physical factors including the viscosity, the surface tension and the like of ink and the diluent and the operation conditions, such as the discharging frequency. Moreover, the shapes of the orifice plate and the solution accommodation containers and the like of the above-mentioned printer may be varied.

The degree of rise of the pressure P2 of the second solution 3, which is ink, and the period of time for which the pressure P2 is raised, that is the voltage level or the width of the voltage pulses to be supplied to the piezoelectric device 32 is adjusted so that the mixture ratio of the second solution 3 contained in the mixed solution 10, that is, the concentration of ink is changed. The concentration of each dot can be changed. By forming a multiplicity of the dots, a halftone image can be expressed, and a natural image exhibiting accurate expression of gradation can be formed.

Although the description has been described about the printer comprising the laminated piezoelectric devices adapted to so-called $d_{33}$-mode in which the piezoelectric devices are elongated in their lengthwise direction when voltage is applied, laminated piezoelectric devices adapted to so-called $d_{31}$ mode in which the piezoelectric devices are contracted in their lengthwise direction when voltage is applied may, of course, be employed.

Although this embodiment has been described about the printer comprising the piezoelectric devices for determining the quantity of the diluent, the present invention may, of course, be applied to a printer comprising heating devices for determining the quantity of the diluent. As an alternative to this, actuators comprising electromagnetic transducers or electrostrictive devices may be employed. Depending upon the drive units, they may be disposed in the first solution accommodation container 4 or the second solution accommodation container 5.

Although the description has been described about the structure in which ink serves as the quantitative medium and the diluent serves as the discharge medium, the diluent may serve as the quantitative medium and the ink may serve as the discharge medium.

The recording method according to the present invention has an arrangement that the relationship as $q-p \geqq 0$ is satisfied on the assumption that the surface tension of the diluent, which is the discharge medium, is q (dyn/cm) and the surface tension of ink, which is the quantitative medium, is p (dyn/cm). When the mediums are mixed with each other at a predetermined mixture ratio before they are discharged, they can be mixed with a satisfactory mixing characteristics. As a result, mixed solution exhibiting excellent mixing characteristics can be discharged. Thus, accurate expression of a gradient image can be performed.

The recording method according to the present invention has an arrangement that the relationship as $\beta-\alpha \geqq 0$ is satisfied on the assumption that the viscosity of ink which is the quantitative medium is $\alpha$ (cp) and the viscosity of the diluent which is the discharge medium is $\beta$ (cp). The ink and diluent can stably be discharged after they have been mixed with each other, that is, a satisfactory discharge stability can be realized.

In particular, the printer according to this embodiment has the structure in which the first solution 2 serving as the discharge medium and the second solution 3 serving as the quantitative medium satisfy the relationship as $\alpha_1-\beta_1 \geqq 0$ on the assumption that the viscosity of the first solution 2 is $\alpha_1$ (cp) and the viscosity of the second solution 3 is $\beta_1$ (cp). That is, the viscosity of each of the first solution 2 serving as the quantitative medium and the second solution 3 serving as the discharge medium and the relationship of the viscosity are made to be suitable for use in the mixing operation and the discharging operation. Therefore, their discharge stability can be maintained satisfactorily to enable accurate expression of a gradient image to be performed.

In the case where the quantitative medium is ink and the discharge medium is the diluent, it is preferable that the surface tension of the quantitative medium is 25 (dyn/cm) to 60 (dyn/cm) and that of the discharge medium is 30 (dyn/cm) to 70 (dyn/cm). If also the viscosity is specified, it is preferable that the viscosity of the quantitative medium is 1 (cp) to 15 (cp) and that of the discharge medium is 1 (cp) to 15 (cp).

In the case where the quantitative medium is the diluent and the discharge medium is ink, it is preferable that the surface tension of the quantitative medium is 25 (dyn/cm) to 60 (dyn/cm) and the surface tension of the discharge medium is 30 (dyn/cm) to 60 (dyn/cm). If also the viscosity is specified, it is preferable that the viscosity of the quantitative medium is 1 (cp) to 15 (cp) and that of the discharge medium is 1 (cp) to 15 (cp).

It is preferable that the solvent for the ink and the diluent is composed of water and water-soluble organic solvent in either case. Moreover, it is preferable that the solvent also contains a surface active agent.

As the water-soluble organic solvent for ink or the diluent, there are exemplified aliphatic monohydric alcohol, polyhydric alcohol or its derivative.

Specifically, the aliphatic monohydric alcohol is exemplified by lower alcohol such as methyl alcohol, ethyl alcohol, n-propyl alcohol, i-propyl alcohol, n-butyl alcohol, s-butyl alcohol or t-butyl alcohol. In particular, ethyl alcohol, n-propyl alcohol or i-propyl alcohol is preferred aliphatic monohydric alcohol.

When the aliphatic monohydric alcohol is employed as the solvent for ink, a satisfactory effect of adjusting the surface tension of ink can be obtained with which permeability of the mixed droplet prepared by mixing ink and the diluent with each other into a recording medium, such as plain paper or exclusive paper, characteristic for forming a required shape of a dot and a drying property of a printed image can significantly be improved. Thus, excellent characteristics can be obtained.

When the aliphatic monohydric alcohol is employed as the solvent for the diluent, satisfactory effects of improving the permeability of the mixed droplet prepared by mixing ink and the diluent with each other into a recording medium, such as plain paper or exclusive paper, characteristic for smoothly forming dots and the drying property of a printed image can be obtained.

The polyhydric alcohol is exemplified by alkylene glycol, such as ethylene glycol, diethylene glycol, triethylene glycol, propylene glycol, butylene glycol or glycerol; polyalkylene glycol, such as polyethylene glycol or polypropylene glycol; and thiodiglycol.

The derivative of the polyhydric alcohol is exemplified by lower alkylether, such as ethyleneglycol monomethylether, ethyleneglycol monoethylether, ethyleneglycol monobutylether, triethyleneglycol monomethylether, triethyleneglycol monoethylether or propyleneglycol monomethylether; and lower carboxylic acid ester, such as ethyleneglycol diacetate.

When the polyhydric alcohol and its derivative are employed as the solvent for ink, an effect of preventing clogging of the nozzles of the printer can be obtained. Moreover, other effects to serve as an assistant for dissolving a dye and to improve the preservability of ink because of lowering the freezing point of ink can be obtained.

Also in the case where the polyhydric alcohol and its derivative are employed as the solvent for the diluent, the effect of preventing clogging of the nozzles can be obtained and the effect of improving the preservability of the diluent can be obtained because it lowers the freezing point of the diluent.

As an alternative to this, alcohol amine, such as mono-, di- or triethanol amine; amide such as dimethylformamide or dimethylacetoamide; ketone such as acetone or methylethylketone; or ether such as dioxane may be employed.

As the surface active agent, any one of the known surface active agents may be employed. The surface active agent is exemplified by nonion type agent, anion type agent and cation type agent. It is preferable that the nonion type surface active agent is employed.

Specifically, the surface active agent is exemplified by polyoxyethylene ether, polyethylene glycol fatty acid ester, glycerin ester, saccharide, polyoxyethylene fatty acid amide, and polyoxyethylenealkylamine.

As a matter of course, ink according to this embodiment contains dye and/or pigment in addition to the above-mentioned solvent. The dye is exemplified by water-soluble dye.

The water-soluble dye is exemplified by water-soluble anionic dye (water-soluble direct dye and water-soluble acidic dye) and water-soluble cationic dye.

The water-soluble anionic dye may be dye having, as the chromophore thereof, a monoazo group, anthraquinone skeleton and the like and containing, in the molecule thereof, one to three negative-ionic water-soluble groups, such as sulfonic acid groups or carboxylic groups.

Specifically, yellow direct dye is exemplified which includes C.I. Direct Yellow 1, C.I Direct Yellow 8, C.I. Direct Yellow 11, C.I. Direct Yellow 12, C.I. Direct Yellow 24, C.I. Direct Yellow 26, C.I. Direct Yellow 27, C.I. Direct Yellow 28, C.I. Direct Yellow 33, C.I. Direct Yellow 39, C.I. Direct Yellow 44, C.I . Direct Yellow 50, C.I . Direct Yellow 58, C.I. Direct Yellow 85, C.I. Direct Yellow 86, C.I. Direct Yellow 87, C.I. Direct Yellow 88, C.I. Direct Yellow 89, C.I. Direct Yellow 9 8, C. I. Direct Yellow 100 and C.I. Direct Yellow 110. Magenta direct dye is exemplified by C.I. Direct Red 1, C.I. Direct Red 2, C.I. Direct Red 4, C.I. Direct Red 9, C.I. Direct Red 11, C.I. Direct Red 13, C.I. Direct Red 17, C.I. Direct Red 20, C.I. Direct Red 23, C.I. Direct Red 24, C.I. Direct Red 28, C.I. Direct Red 31, C.I. Direct Red 33, C.I. Direct Red 37, C.I. Direct Red 39, C.I. Direct Red 44, C.I. Direct Red 46, C.I. Direct Red 62, C.I. Direct Red 63, C.I. Direct Red 75, C.I. Direct Red 79, C.I. Direct Red 80, C.I. Direct Red 81, C.I. Direct Red 83, C.I. Direct Red 84, C.I. Direct Red 89, C.I. Direct Red 95, C.I. Direct Red 99, C.I. Direct Red 113, C.I. Direct Red 197, C.I. Direct Red 201, C.I. Direct Red 218, C.I. Direct Red 220, C.I. Direct Red 224, C.I. Direct Red 225, C.I. Direct Red 226, C.I. Direct Red 227, C.I. Direct Red 228, C.I. Direct Red 229, C.I. Direct Red 230 and C.I. Direct Red 321. Cyan direct dye is exemplified by C.I. Direct Blue 1, C.I. Direct Blue 2, C.I. Direct Blue 6, C.I. Direct Blue 8, C.I. Direct Blue 15, C.I. Direct Blue 22, C.I. Direct Blue 25, C.I. Direct Blue 41, C.I. Direct Blue 71, C.I. Direct Blue 76, C.I. Direct Blue 77, C.I. Direct Blue 78, C.I. Direct Blue 80, C.I. Direct Blue 86, C.I. Direct Blue 90, C.I. Direct Blue 98, C.I. Direct Blue 106, C.I. Direct Blue 108, C.I. Direct Blue 120, C.I . Direct Blue 158, C.I. Direct Blue 160, C.I. Direct Blue 163, C.I. Direct Blue 165, C.I. Direct Blue 168, C.I. Direct Blue 192, C.I. Direct Blue 193, C.I. Direct Blue 194, C.I. Direct Blue 195, C.I. Direct Blue 196, C.I. Direct Blue 199, C.I. Direct Blue 200, C.I. Direct Blue 201 , C.I. Direct Blue 202, C.I. Direct Blue 203, C.I. Direct Blue 207, C.I. Direct Blue 225, C.I. Direct Blue 226, C.I. Direct Blue 236, C.I. Direct Blue 237, C.I. Direct Blue 246, C.I. Direct Blue 248 and C.I. Direct Blue 249. Black direct dye is exemplified by C.I. Direct Black 17, C.I. Direct Black 19, C.I. Direct Black 22, C.I. Direct Black 32, C.I. Direct Black 38, C.I. Direct Black 51, C.I. Direct Black 56, C.I. Direct Black 62, C.I. Direct Black 71, C.I. Direct Black 74, C.I. Direct Black 75, C.I. Direct Black 77, C.I. Direct Black 94, C.I. Direct Black 105, C.I. Direct Black 106, C.I. Direct Black 107, C.I. Direct Black 108, C.I. Direct Black 112, C.I. Direct Black 113, C.I. Direct Black 117, C.I. Direct Black 118, C.I. Direct Black 132, C.I. Direct Black 133 and C.I. Direct Black 146.

Yellow acid dye is exemplified by C.I. Acid Yellow 1, C.I. Acid Yellow 3, C.I. Acid Yellow 7, C.I. Acid Yellow 11, C.I. Acid Yellow 17, C.I. Acid Yellow 19, C.I. Acid Yellow 23, C.I. Acid Yellow 25, C.I. Acid Yellow 29, C.I. Acid Yellow 36, C.I. Acid Yellow 38, C.I. Acid Yellow 40, C.I. Acid Yellow 42, C.I. Acid Yellow 44, C.I. Acid Yellow 49, C.I. Acid Yellow 59, C.I. Acid Yellow 61, C.I. Acid Yellow 70, C.I. Acid Yellow 72, C.I. Acid Yellow 75, C.I. Acid Yellow 76, C.I. Acid Yellow 78, C.I. Acid Yellow 79, C.I. Acid Yellow 98, C.I. Acid Yellow 99, C.I. Acid Yellow 110, C.I. Acid Yellow 111, C.I. Acid Yellow 112, C.I. Acid Yellow 114, C.I . Acid Yellow 116 , C.I . Acid Yellow 118, C.I. Acid Yellow 11 9, C.I. Acid Yellow 127, C.I. Acid Yellow 128, C.I. Acid Yellow 131, C.I. Acid Yellow 135, C.I. Acid Yellow 141, C.I. Acid Yellow 142, C.I. Acid Yellow 161, C.I. Acid Yellow 162, C.I. Acid Yellow 163, C.I. Acid Yellow 164 and C.I. Acid Yellow 165. Magenta acid dye is exemplified by C.I. Acid Red 1, C.I. Acid Red 6, C.I. Acid Red 8, C.I. Acid Red 9, C.I. Acid Red 13, C.I. Acid Red 14, C.I. Acid Red 18, C.I. Acid Red 26, C.I. Acid Red 27, C.I. Acid Red 32, C.I. Acid Red 35, C.I. Acid Red 37, C.I. Acid Red 42, C.I. Acid Red 51, C.I. Acid Red 52, C.I. Acid Red 57, C.I. Acid Red 75, C.I. Acid Red 77, C.I. Acid Red 80, C.I. Acid Red 82, C.I. Acid Red 83, C.I. Acid Red 85, C.I. Acid Red 87, C.I. Acid Red 88, C.I. Acid Red 89, C.I. Acid Red 92, C.I. Acid Red 94, C.I. Acid Red 97, C.I. Acid Red 106, C.I. Acid Red 111, C.I. Acid Red 114, C.I. Acid Red 115, C.I. Acid Red 117, C.I. Acid Red 118, C.I. Acid Red 119, C.I. Acid Red 129, C.I. Acid Red 130, C.I. Acid Red 131, C.I. Acid Red 133, C.I. Acid Red 134, C.I. Acid Red 138, C.I. Acid Red 143, C.I. Acid Red 145, C.I. Acid Red 154, C.I. Acid Red 155, C.I. Acid Red 158, C.I. Acid Red 168, C.I. Acid Red 180, C.I. Acid Red 183, C.I. Acid Red 184, C.I. Acid Red 186, C.I. Acid Red 194, C.I. Acid Red 198, C.I. Acid Red 199, C.I. Acid Red 209, C.I. Acid Red 211, C.I. Acid Red 215, C.I. Acid Red 216., C.I. Acid Red 217, C.I. Acid Red 219, C.I. Acid Red 249, C.I. Acid Red 252, C.I. Acid Red 254, C.I. Acid Red 256, C.I. Acid Red 257, C.I. Acid Red 262, C.I. Acid Red 265, C.I. Acid Red 266, C.I. Acid Red 274, C.I. Acid Red 276, C.I. Acid Red 282, C.I. Acid Red 283, C.I. Acid Red 303, C.I. Acid Red 317, C.I. Acid Red 318, C.I. Acid Red 320, C.I. Acid Red 321 and C.I. Acid Red 322. Cyan acid dye is exemplified by C.I. Acid Blue 1, C.I. Acid Blue 7, C.I. Acid Blue 9, C.I. Acid Blue 15, C.I. Acid Blue 22, C.I. Acid Blue 23, C.I. Acid Blue 25, C.I. Acid Blue 27, C.I. Acid Blue 29, C.I. Acid Blue 40, C.I. Acid Blue 41, C.I. Acid Blue 43, C.I. Acid Blue 45, C.I. Acid Blue 54, C.I. Acid Blue 59, C.I. Acid Blue 60, C.I. Acid Blue 62, C.I. Acid Blue 72, C.I. Acid Blue 74, C.I. Acid Blue 78, C.I. Acid Blue 80, C.I. Acid Blue 82, C.I. Acid Blue 83, C.I. Acid Blue 90, C.I. Acid Blue 92, C.I. Acid Blue 93, C.I. Acid Blue 100, C.I. Acid Blue 102, C.I. Acid Blue 103, C.I. Acid Blue 104, C.I. Acid Blue 112, C.I. Acid Blue 113, C.I. Acid Blue 117, C.I. Acid Blue 120, C.I. Acid Blue 126, C.I. Acid Blue 127, C.I. Acid Blue 129, C.I. Acid Blue 130, C.I. Acid Blue 131, C.I. Acid Blue 138, C.I. Acid Blue 140, C.I. Acid Blue 142, C.I. Acid Blue 143, C.I. Acid Blue 140, C.I. Acid Blue 142, C.I. Acid Blue 143, C.I. Acid Blue 151, C.I. Acid Blue 154, C.I. Acid Blue 158, C.I. Acid Blue 168, C.I. Acid Blue 170, C.I. Acid Blue 167, C.I. Acid Blue 168, C.I. Acid Blue 182, C.I. Acid Blue 187, C.I. Acid Blue 178, C.I. Acid Blue 187, C.I. Acid Blue 192, C.I. Acid Blue 199, C.I. Acid Blue 187, C.I. Acid Blue 192, C.I. Acid Blue 205, C.I. Acid Blue 229, C.I. Acid Blue 234 and C.I. Acid Blue 236. Black acid dye is exemplified by C.I. Acid Black 1, C.I. Acid Black 2, C.I. Acid Black 7, C.I. Acid Black 24, C.I. Acid Black 26, C.I. Acid Black 29, C.I. Acid Black 31, C.I. Acid Black 44, C.I. Acid Black 48, C.I. Acid Black 50, C.I. Acid Black 51, C.I. Acid Black 52, C.I. Acid Black 58, C.I. Acid Black 60, C.I. Acid Black 62, C.I. Acid Black 63, C.I. Acid Black 64, C.I. Acid Black 67, C.I. Acid Black 72, C.I. Acid Black 76, C.I. Acid Black 77, C.I. Acid Black 94, C.I. Acid Black 107, C.I. Acid Black 108, C.I. Acid Black 109, C.I. Acid Black 110, C.I. Acid Black 112, C.I. Acid Black 115, C.I. Acid Black 118, C.I. Acid Black 119, C.I. Acid Black 121, C.I. Acid Black 122, C.I. Acid Black 131, C.I. Acid Black 132, C.I. Acid Black 139, C.I. Acid Black 140, C.I. Acid Black 155, C.I. Acid Black 156, C.I. Acid Black 157, C.I. Acid Black 158, C.I. Acid Black 159 and C.I. Acid Black 191.

The water-soluble cationic dye may be azo dye having an amine salt or quaternary ammonium salt, triphenyl methane dye, azine dye, oxazine dye or thiazine dye.

Specifically, any one of the following yellow cationic dye may be employed: C.I. Basic Yellow 1, C.I. Basic Yellow 2, C.I. Basic Yellow 11, C.I. Basic Yellow 13, C.I. Basic Yellow 14, C.I. Basic Yellow 19, C.I. Basic Yellow 21, C.I. Basic Yellow 25, C.I. Basic Yellow 28, C.I. Basic Yellow 32, 33, C.I. Basic Yellow 34, C.I. Basic Yellow 35 and C.I. Basic Yellow 36. Any one of the following magenta dye may be employed: C.I. Basic Red 1, C.I. Basic Red 2, C.I. Basic Red 9, C.I. Basic Red 12, C.I. Basic Red 13, C.I. Basic Red 14, C.I. Basic Red 15, C.I. Basic Red 17, C.I. Basic Red 18, C.I. Basic Red 22, C.I. Basic Red 23, C.I. Basic Red 24, C.I. Basic Red 27, C.I. Basic Red 29, C.I. Basic Red 32, C.I. Basic Red 38, C.I. Basic Red 39, C.I. Basic Red 40, C.I. Basic Violet 7, C.I. Basic Violet 10, C.I. Basic Violet 15, C.I. Basic Violet 21, C.I. Basic Violet 25, C.I. Basic Violet 26, C.I. Basic Violet 27 and C.I. Basic Violet 28. The following cyan type dye may be employed: C.I. Basic Blue 1, C.I. Basic Blue 3, C.I. Basic Blue 5, C.I. Basic Blue 7, C.I. Basic Blue 9, C.I. Basic Blue 19, C.I. Basic Blue 21, C.I. Basic Blue 22, C.I. Basic Blue 24, C.I. Basic Blue 25, C.I. Basic Blue 26, C.I. Basic Blue 28, C.I. Basic Blue 29, C.I. Basic Blue 40, C.I. Basic Blue 41, C.I. Basic Blue 44, C.I. Basic Blue 47, C.I. Basic Blue 54, C.I. Basic Blue 58, C.I. Basic Blue 59, C.I. Basic Blue 60, C.I. Basic Blue 64, C.I. Basic Blue 65, C.I. Basic Blue 66, C.I. Basic Blue 67, C.I. Basic Blue 68 and C.I. Basic Blue 75. black type water-soluble cationic dye is exemplified by C.I. Basic Black 2 and C.I. Basic Black 8.

Among the above-mentioned dyes, preferred dyes are exemplified by C.I. Basic Yellow 21, C.I. Basic Yellow 36, C.I. Basic Yellow 37 and C.I. Basic Yellow 73 and a dye having the following structure:

[Formula 1]

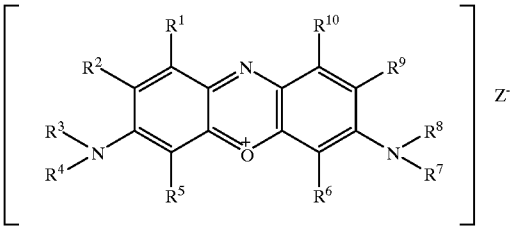

-continued

[Formula 2]

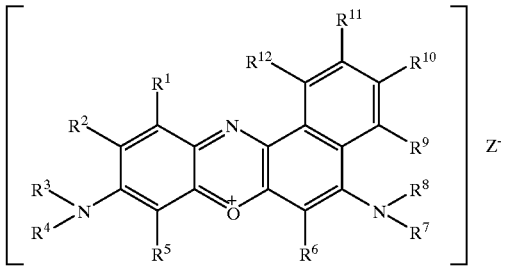

where $R^1$, $R^2$, $R^3$, $R^4$, $R^5$, $R^6$, $R^7$, $R^8$, $R^9$, $R^{10}$, $R^{11}$, and $R^{12}$ are independently a hydrogen atom, a halogen atom, a cyano group, an alkyl group, a cycloalkyl group, an alkoxy group, an aryl group, an aryloxy group, an aralkyl group, an aralkoxy group, an alkenyl group, an alkenoxy group, an alkoxycarbonyl group, an acyloxy group or an acyl group, which may be substituted, $R^1$ and $R^2$ and $R^3$ and $R^4$, $R^7$ and $R^8$, $R^9$ and $R^{10}$, $R^{10}$ and $R^{11}$ and $R^{11}$ and $R^{12}$ may be bonded to each other to form a ring and $Z^-$ is a counter ion.

[Formula 3]

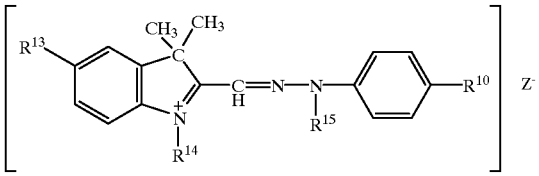

where $R^{13}$, $R^{14}$, $R^{15}$ and $R^{16}$ are independently a hydrogen atom, a halogen atom, a cyano group, an alkyl group, a cycloalkyl group, an alkoxy group, an aryl group, an aryloxy group, an aralkyl group, an aralkoxy group, an alkenyl group, an alkenoxy group, an alkoxycarbonyl group, an acyloxy group or an acyl group, which may be substituted, and $Z^-$ is a counter ion.

[Formula 4]

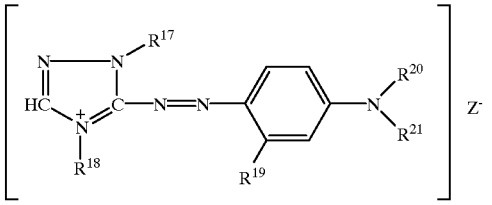

where $R^{17}$, $R^{18}$, $R^{19}$, $R^{20}$ and $R^{21}$ are independently a hydrogen atom, a halogen atom, a cyano group, an alkyl group, a cycloalkyl group, an alkoxy group, an aryl group, an aryloxy group, an aralkyl group, an aralkoxy group, an alkenyl group, an alkenoxy group, an alkoxycarbonyl group, an acyloxy group or an acyl group, which may be substituted, $R^2$ and $R^{21}$ may be bonded to each other and $Z^-$ is a counter ion.

[Formula 5]

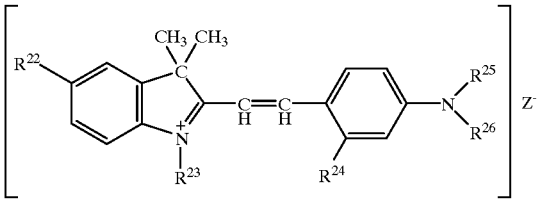

where $R^{22}$, $R^{23}$, $R^{24}$, $R^{25}$ and $R^{26}$ are independently a hydrogen atom, a halogen atom, a cyano group, an alkyl group, a cycloalkyl group, an alkoxy group, an aryl group, an aryloxy group, an aralkyl group, an aralkoxy group, an alkenyl group, an alkenoxy group, an alkoxycarbonyl group, an acyloxy group or an acyl group, which may be substituted, $R^{25}$ and $R^{26}$ may be bonded to each other and $Z^-$ is a counter ion.

[Formula 6]

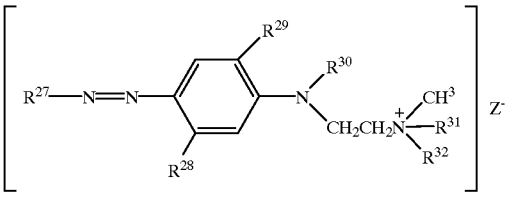

where $R^{27}$ is a substituted or non-substituted aryl group or a non-substituted hetero ring, $R^{28}$ and $R^{29}$ are independently a hydrogen atom, a halogen atom, a cyano group, an alkyl group, a cycloalkyl group, an alkoxy group, an aryl group, an aryloxy group, an aralkyl group, an aralkoxy group, an alkenyl group, an alkenoxy group, an alkoxycarbonyl group, an acyloxy group or an acyl group, which may be substituted, $R^{30}$ is a substituted or non-substituted alkyl group, $R^{31}$ and $R^{32}$ are independently a hydrogen atom, a substituted or non-substituted alkyl group or a substituted or a non-substituted aralkyl group, $R^{31}$ and $R^{32}$ may be bonded to each other and $Z^-$ is a counter ion.

[Formula 7]

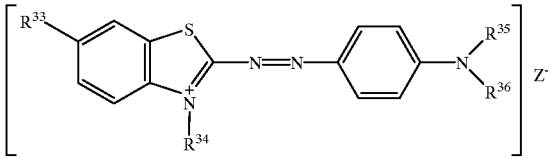

where $R^{33}$, $R^{34}$, $R^{35}$ and $R^{36}$ are independently a hydrogen atom, a halogen atom, a cyano group, an alkyl group, a cycloalkyl group, an alkoxy group, an aryl group, an aryloxy group, an aralkyl group, an aralkoxy group, an alkenyl group, an alkenoxy group, an alkoxycarbonyl group, an acyloxy group or an acyl group, which may be substituted, $R^{35}$ and $R^{36}$ may be bonded to each other and $Z^-$ is a counter ion.

[Formula 8]

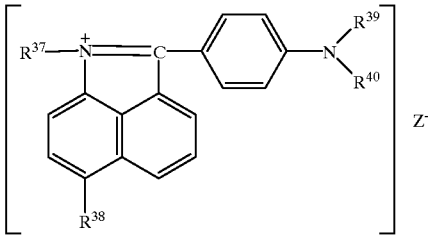

where $R^{37}$, $R^{38}$, $R^{39}$ and $R^{40}$ are independently a hydrogen atom, a halogen atom, a cyano group, an alkyl group, a cycloalkyl group, an alkoxy group, an aryl group, an aryloxy group, an aralkyl group, an aralkoxy group, an alkenyl group, an alkenoxy group, an alkoxycarbonyl group, an acyloxy group or an acyl group, which may be substituted, $R^{39}$ and $R^{40}$ may be bonded to each other and $Z^-$ is a counter ion.

The water-soluble cationic dye usually contains inorganic anion as the counter ion thereof and its major portion exists in the form of strong acid salt. Since its water solution generally therefore has an acidic characteristic, it is preferable that neutralization is performed with basic salt to prevent corrosion of a metal element which is in contact with an ink composition containing the above-mentioned water-soluble cationic dye. For example, it is preferable that inorganic anion which is the counter ion is processed with organic anion soda salt or the like to so as to be substituted. To maintain the affinity of the interlayer compound with the water-soluble cationic dye, it is preferable that the affinity with the interlayer compound is maintained by forming salt with the organic anion.

Moreover, ink or the diluent may contain additives, such as a defoaming agent, a pH adjustment agent and fungicide.

The recording method according to this embodiment has the structure that the period of time taken from mixing of the discharge medium and the quantitative medium with each other to the application of the mixed solution to the surface of the recording medium is 1 msec or shorter. Thus, the mixing characteristic between the quantitative medium and the discharge medium can furthermore be improved in a state where the practical printing speed and the accuracy in the discharge position are maintained. As a result, accurate expression of a gradient image can be performed.

EXAMPLES

To confirm the effects of the present invention, the following experiments were performed. That is, the physical properties of the discharge medium and the quantitative medium were changed when printing operations were performed by the printer having the above-mentioned structure, so that the characteristics were evaluated. Moreover, printing operations were performed in a state where the period of time taken from mixing of the discharge medium and the quantitative medium to application of the mixed solution to the surface of the recording medium was changed so as to evaluate the characteristics.

Example 1

In this example, the diluent was used as the discharge medium and the ink was used as the quantitative medium. Samples of diluent and ink having different surface tensions were prepared, and the samples were used as the discharge medium and the quantitative medium for the above-mentioned printer so that the mixing characteristic of the two types of solutions was evaluated.

Example 1-1

Initially, water, isopropyl alcohol and glycerin were used as solvents, and then the solvents were arbitrarily added so that ink samples 1-1 to 1-4 having surface tensions and viscosity values (values respectively measured at 20° C.) as shown in Table 1 were prepared. C.I. Direct Yellow 50 was used as the dye in ink sample 1-1, C.I. Direct Yellow 87 was used as the dye in ink sample 1-2, C.I. Direct Red 83 was used as the dye in the ink sample 1-3, and C.I. Direct Red 227 was used as the dye in the ink sample 1-4. Moreover, the concentration of the dye was 3 wt %.

The surface tension was measured by a surface tension meter CBVP-Z (model name) manufactured by Kyowa Surface Chemistry, and the viscosity was measured by a viscosity meter DV-II+ (model name) manufactured by BROOK FIELD.

TABLE 1

| | | Surface Tension (dyn/cm) | Viscosity (cp) | Name of Dye |
|---|---|---|---|---|
| Ink Samples | 1-1 | 25 | 3.0 | C.I. Direct Yellow 50 |
| | 1-2 | 30 | 3.0 | C.I. Direct Yellow 87 |
| | 1-3 | 40 | 3.0 | C.I. Direct Red 83 |
| | 1-4 | 45 | 3.0 | C.I. Direct Red 227 |

Then, water, isopropyl alcohol and glycerin were used as solvents, and then the solvents were arbitrarily added so that diluent samples 1-1 to 1-3 having surface tensions and viscosity values (values respectively measured at 20° C.) as shown in Table 2 were prepared.

TABLE 2

| | | Surface Tension (dyn/cm) | Viscosity (cp) |
|---|---|---|---|
| Diluent Samples | 1-1 | 30 | 3.0 |
| | 1-2 | 40 | 3.0 |
| | 1-3 | 50 | 3.0 |

Then, ink samples 1-1 to 1-4 and diluent samples 1-1 to 1-3 were used to perform quantitative discharge of a mixed solution of the two types of solutions so that the mixing characteristic of the two types of solutions were evaluated.

Figure 9A:
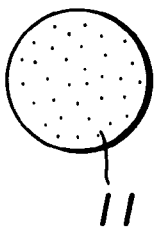
FIG. 9 is a schematic view showing steps of concentrations in a dot.
Figure 9B:
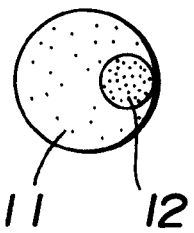
Figure 9C:
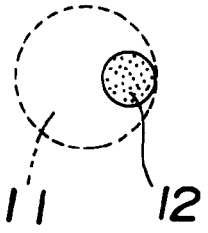

That is, ink samples 1-1 to 1-4 and diluent samples 1-1 to 1-3 were combined and the mixture ratio (the concentration of ink) of the two types of solutions was changed in each of the printing operations. Dots formed on the recording medium were observed with a microscope to examine whether or not the density in the dot was in a uniform shape. Results were evaluated with the following three grades. That is, results in each of which the area in the dot 11 was uniformly dyed as shown in FIG. 9A were given mark 0, results free from a practical problem though a dark portion 12 was observed in the dot 11 as shown in FIG. 9B were given mark Δ, and results unsatisfactory for practical use because a portion which must be formed into the dot 11 was not dyed with a partial dark portion 12 were given mark x.

The mixture ratio of ink and the diluent can be adjusted by changing the voltage to be applied to the portion for driving the printing head, the pulse width and the waveform. A ratio, which can easily be realized was in a range from 1% to 80%.

The evaluation was performed under the following discharge conditions that the voltage of the discharge side was 20 (V), the pulse width was 80 (μsec) and the highest voltage for the quantitative side was 20 (V) or lower. The pulse width was 100 (μsec) which was varied arbitrarily. The discharging frequency was 5 (kHz) and period of time taken from the quantitative mixing to the application to the recording medium was about 1 (msec). The diameter of the discharge nozzle was 35 (μm) and the diameter of the quantitative nozzle was 20 (μm). Moreover, the diameter of the dot on the recording medium was 120 (μm).

Results were shown in Table 3 with combination of ink samples and diluent samples and the concentration of ink. Symbol a in Table 3 indicated a case where ink:diluent was 50:50, b in Table 3 indicated a case where ink:diluent was 10:90 and c in Table 3 indicated a case where ink:diluent was 1:99.

TABLE 3

| | Ink Samples | | | | | | | | | | | |
|---|---|---|---|---|---|---|---|---|---|---|---|---|
| Diluent | 1-1 | | | 1-2 | | | 1-3 | | | 1-4 | | |
| Samples | a | b | c | a | b | c | a | b | c | a | b | c |
| 1-1 | ○ | ○ | ○ | ○ | ○ | ○ | Δ | X | X | X | X | X |
| 1-2 | ○ | ○ | ○ | ○ | ○ | ○ | ○ | ○ | ○ | Δ | X | X |
| 1-3 | ○ | ○ | ○ | ○ | ○ | ○ | ○ | ○ | ○ | | | |

As can be understood from results shown in Table 3, each combination of the diluent sample and ink sample satisfying the relationship as $q-p \geqq 0$ under the assumption that the surface tension of the diluent sample, which was the discharge medium, was q (dyn/cm) and the surface tension of the ink sample, which was the quantitative medium, was p (dyn/cm) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed.

If the combination of the diluent sample and the ink sample was not changed, a satisfactory result was obtained when the ratio of the ink sample, which was the quantitative medium, was lower than that of the diluent sample which was the discharge medium.

Example 1-2

As the solvents, water, ethylene glycol monomethylether and diethylene glycol were used and then the solvents were arbitrarily added. Then, non-ionic surface active agent ("Emergen 985" trade name of Kao) was added as the surface active agent so that ink samples 1-5 to 1-7 having surface tensions and viscosity values (values respectively measured at 20° C.) as shown in Table 4 were prepared. C.I. Direct Blue 6 was used as the dye in ink sample 1-5, C.I. Direct Blue 86 was used as the dye in the ink sample 1-6 and C.I. Direct Black 38 was used as the dye in the ink sample 1-7. Moreover, the concentration of the dye was 5 wt %.

TABLE 4

| | | Surface Tension (dyn/cm) | Viscosity (cp) | Name of Dye |
|---|---|---|---|---|
| Ink Samples | 1-5 | 25 | 5.0 | C.I. Direct Blue 6 |
| | 1-6 | 30 | 5.0 | C.I. Direct Blue 86 |
| | 1-7 | 40 | 5.0 | C.I. Direct Black 38 |

On the other hand, as the solvents, water, ethylene glycol monomethylether and diethylene glycol were used and then the solvents were arbitrarily added. Then, non-ionic surface active agent ("Emergen 985" trade name of Kao) was added as the surface active agent so that ink samples 1-4 to 1-6 having surface tensions and viscosity values (values respectively measured at 20° C.) as shown in Table 5 were prepared.

TABLE 5

| | | Surface Tension (dyn/cm) | Viscosity (cp) |
|---|---|---|---|
| Diluent Samples | 1-4 | 30 | 5.0 |
| | 1-5 | 35 | 5.0 |
| | 1-6 | 40 | 5.0 |

Ink samples 1-5 to 1-7 and diluent samples 1-4 to 1-6 were used to perform quantitative discharge of a mixture solution of two types of the solutions similarly to Example 1-1 so that the mixing characteristics of the two types of the solutions were evaluated similarly to the foregoing example. Results were shown in Table 6. Also Table 6 shows the mixture ratio (the concentration of ink) of ink and the diluent similarly to Table 3.

TABLE 6

| | | Ink Samples | | | | | | | | |
|---|---|---|---|---|---|---|---|---|---|---|
| | | 1-5 | | | 1-6 | | | 1-7 | | |
| | | a | b | c | a | b | c | a | b | c |
| Diluent Samples | 1-4 | ○ | ○ | ○ | ○ | ○ | ○ | Δ | X | X |
| | 1-5 | ○ | ○ | ○ | ○ | ○ | ○ | Δ | X | X |
| | 1-6 | ○ | ○ | ○ | ○ | ○ | ○ | ○ | ○ | ○ |

As can be understood from results shown in Table 6, each combination of the diluent sample and ink sample satisfying the relationship as $q-p \geqq 0$ under the assumption that the surface tension of the diluent sample, which was the discharge medium, was q (dyn/cm) and the surface tension of the ink sample, which was the quantitative medium, was p (dyn/cm) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed.

If the combination of the diluent sample and the ink sample was not changed, a satisfactory result was obtained when the ratio of the ink sample, which was the quantitative medium, was lower than that of the diluent sample which was the discharge medium.

Example 1-3

As the solvents, water, 2-(2-butoxyethoxy) ethanol, triethanol amine and glycerin were used and then the solvents were arbitrarily added so that ink samples 1-8 to 1-10 having surface tensions and viscosity values (values respectively measured at 20° C.) as shown in Table 7 were prepared. C.I. Acid Yellow 23 was used as the dye in ink sample 1-8, C.I. Acid Red 27 was used as the dye in ink sample 1-9 and C.I. Acid Blue 9 was used as the dye in ink sample 1-10. The concentration of the dye was 3 wt %.

TABLE 7

| | | Surface Tension (dyn/cm) | Viscosity (cp) | Name of Dye |
|---|---|---|---|---|
| Ink Samples | 1-8 | 40 | 10.0 | C.I. Acid Yellow 23 |
| | 1-9 | 50 | 10.0 | C.I. Acid Red 27 |
| | 1-10 | 60 | 10.0 | C.I. Acid Blue 9 |

As the solvents, water, 2-(2-butoxyethoxy) ethanol, triethanol amine and glycerin were used and then the solvents were arbitrarily added so that ink samples 1-7 to 1-9 having surface tensions and viscosity values (values respectively measured at 20° C.) as shown in Table 8 were prepared.

TABLE 8

| | | Surface Tension (dyn/cm) | Viscosity (cp) |
|---|---|---|---|
| Diluent Samples | 1-7 | 40 | 10.0 |
| | 1-8 | 50 | 10.0 |
| | 1-9 | 60 | 10.0 |

As the solvent, a solution in which glycerin was mixed with water in a small quantity was used and then the solvent was arbitrarily added so as to be prepared in such a manner that the surface tension was 70 (dyn/cm) and the viscosity was 1.5 (cp). The prepared solution was used as diluent sample 1-10.

Ink samples 1-8 to 1-10 and diluent samples 1-7 to 1-10 were used to quantitative medium discharge a mixture solution of two types of the solutions similarly to Example 1-1 so that the mixing characteristics of the two types of the solutions were evaluated. Results were shown in Table 9. Also Table 9 shows the mixture ratio (the concentration of ink) of ink and the diluent similarly to Table 3.

TABLE 9

| | | Ink Samples | | | | | | | | |
|---|---|---|---|---|---|---|---|---|---|---|
| | | 1-8 | | | 1-9 | | | 1-10 | | |
| | | a | b | c | a | b | c | a | b | c |
| Diluent Samples | 1-7 | ○ | ○ | ○ | Δ | X | X | X | X | X |
| | 1-8 | ○ | ○ | ○ | ○ | ○ | ○ | Δ | X | X |
| | 1-9 | ○ | ○ | ○ | ○ | ○ | ○ | ○ | ○ | ○ |
| | 1-10 | ○ | ○ | ○ | ○ | ○ | ○ | ○ | ○ | ○ |

As can be understood from results shown in Table 9, each combination of the diluent sample and ink sample satisfying the relationship as q−p≧0 under the assumption that the surface tension of the diluent sample, which was the discharge medium, was q (dyn/cm) and the surface tension of the ink sample, which was the quantitative medium, was p (dyn/cm) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed.

If the combination of the diluent sample and the ink sample was not changed, a satisfactory result was obtained when the ratio of the ink sample, which was the quantitative medium, was lower than that of the diluent sample which was the discharge medium.

Example 1-4

Quantitative discharge of a mixture solution of two types of the solutions was performed similarly to Example 1-1 except for the period of time taken from quantitative mixture to the application to the recording medium, which was about 1 (msec) in Example 1-1, was changed to about 500 (μsec) so that the mixing characteristics of the two types of the solutions were evaluated. Results were shown in Tables 10 to 12. Also Tables 10 to 12 showed the mixture ratio (the concentration of ink) of ink and the diluent similarly to Table 3.

TABLE 10

| | Ink Samples | | | | | | | | | | | |
|---|---|---|---|---|---|---|---|---|---|---|---|---|
| Diluent | 1-1 | | | 1-2 | | | 1-3 | | | 1-4 | | |
| Samples | a | b | c | a | b | c | a | b | c | a | b | c |
| 1-1 | ○ | ○ | ○ | ○ | ○ | ○ | X | X | X | X | X | X |
| 1-2 | ○ | ○ | ○ | ○ | ○ | ○ | ○ | ○ | ○ | X | X | X |
| 1-3 | ○ | ○ | ○ | ○ | ○ | ○ | ○ | ○ | ○ | ○ | ○ | ○ |

TABLE 11

| | Ink Samples | | | | | | | | |
|---|---|---|---|---|---|---|---|---|---|
| Diluent | 1-5 | | | 1-6 | | | 1-7 | | |
| Samples | a | b | c | a | b | c | a | b | c |
| 1-4 | ○ | ○ | ○ | ○ | ○ | ○ | X | X | X |
| 1-5 | ○ | ○ | ○ | ○ | ○ | ○ | X | X | X |
| 1-6 | ○ | ○ | ○ | ○ | ○ | ○ | ○ | ○ | ○ |

TABLE 12

| | Ink Samples | | | | | | | | |
|---|---|---|---|---|---|---|---|---|---|
| Diluent | 1-8 | | | 1-9 | | | 1-10 | | |
| Samples | a | b | c | a | b | c | a | b | c |
| 1-7 | ○ | ○ | ○ | X | X | X | X | X | X |
| 1-8 | ○ | ○ | ○ | ○ | ○ | ○ | X | X | X |
| 1-9 | ○ | ○ | ○ | ○ | ○ | ○ | ○ | ○ | ○ |
| 1-10 | ○ | ○ | ○ | ○ | ○ | ○ | ○ | ○ | ○ |

As can be understood from results shown in Tables 10 to 12, each combination of the diluent sample and ink sample satisfying the relationship as q−p≧0 under the assumption that the surface tension of the diluent sample, which was the discharge medium, was q (dyn/cm) and the surface tension of the ink sample, which was the quantitative medium, was p (dyn/cm) resulted in satisfactory mixing characteristic of the two types of the solutions being obtained.

However, since the period of time taken from the quantitative mixture of the quantitative medium and the discharge medium to the application to the recording medium was made to be shorter than that in the foregoing experiments, the mixing characteristics of the two types of the solutions deteriorated. Therefore, a fact was confirmed that the period of time taken from the quantitative mixture to the application to a recording medium affects the mixing characteristics of the two types of the solutions.

If the combination of the diluent sample and the ink sample was not changed, a satisfactory result was obtained when the ratio of the ink sample, which was the quantitative medium, was lower than that of the diluent sample which was the discharge medium.

Example 1-5

Quantitative discharge of a mixture solution of two types of the solutions was performed similarly to Example 1-4 except for the above-mentioned combinations of the ink samples and diluent samples being changed so that the mixing characteristics of the two types of the solutions were evaluated. Results were shown in Tables 13 to 15. Also Tables 13 to 15 showed the mixture ratio (the concentration of ink) of ink and the diluent similarly to Table 3.

TABLE 13

| | Ink Samples | | | | | | | | | | | |
|---|---|---|---|---|---|---|---|---|---|---|---|---|
| Diluent | 1-1 | | | 1-2 | | | 1-3 | | | 1-4 | | |
| Samples | a | b | c | a | b | c | a | b | c | a | b | c |
| 1-4 | ○ | ○ | ○ | ○ | ○ | ○ | X | X | X | X | X | X |
| 1-5 | ○ | ○ | ○ | ○ | ○ | ○ | X | X | X | X | X | X |
| 1-6 | ○ | ○ | ○ | ○ | ○ | ○ | ○ | ○ | ○ | X | X | X |
| 1-7 | ○ | ○ | ○ | ○ | ○ | ○ | ○ | ○ | ○ | X | X | X |
| 1-8 | ○ | ○ | ○ | ○ | ○ | ○ | ○ | ○ | ○ | ○ | ○ | ○ |
| 1-9 | ○ | ○ | ○ | ○ | ○ | ○ | ○ | ○ | ○ | | | |
| 1-10 | ○ | ○ | ○ | ○ | ○ | ○ | ○ | ○ | ○○ | ○ | ○ | |

TABLE 14

| | Ink Samples | | | | | | | | |
|---|---|---|---|---|---|---|---|---|---|
| Diluent | 1-5 | | | 1-6 | | | 1-7 | | |
| Samples | a | b | c | a | b | c | a | b | c |
| 1-1 | ○ | ○ | ○ | ○ | ○ | ○ | X | X | X |
| 1-2 | ○ | ○ | ○ | ○ | ○ | ○ | ○ | ○ | ○ |
| 1-3 | ○ | ○ | ○ | ○ | ○ | ○ | ○ | ○ | ○ |
| 1-7 | ○ | ○ | ○ | ○ | ○ | ○ | ○ | ○ | ○ |
| 1-8 | ○ | ○ | ○ | ○ | ○ | ○ | ○ | ○ | ○ |
| 1-9 | ○ | ○ | ○ | ○ | ○ | ○ | ○ | ○ | ○ |
| 1-10 | ○ | ○ | ○ | ○ | ○ | ○ | ○ | ○ | ○ |

TABLE 15

| Diluent | Ink Samples 1-8 | | | 1-9 | | | 1-10 | | |
|---|---|---|---|---|---|---|---|---|---|
| Samples | a | b | c | a | b | c | a | b | c |
| 1-1 | X | X | X | X | X | X | X | X | X |
| 1-2 | ○ | ○ | ○ | X | X | X | X | X | X |
| 1-3 | ○ | ○ | ○ | ○ | ○ | ○ | X | X | X |
| 1-4 | X | X | X | X | X | X | X | X | X |
| 1-5 | X | X | X | X | X | X | X | X | X |
| 1-6 | ○ | ○ | ○ | X | X | X | X | X | X |

As can be understood from results shown in Tables 13 to 15, each combination of the diluent sample and ink sample satisfying the relationship as q−p≧0 under the assumption that the surface tension of the diluent sample, which was the discharge medium, was q (dyn/cm) and the surface tension of the ink sample, which was the quantitative medium, was p (dyn/cm) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed.

If the combination of the diluent sample and the ink sample was not changed, a satisfactory result was obtained when the ratio of the ink sample, which was the quantitative medium, was lower than that of the diluent sample which was the discharge medium.

Example 1-6

Quantitative discharge of a mixture solution of two types of the solutions was performed similarly to Example 1-5 except for the period of time taken from quantitative mixture to the application to the recording medium, which was about 500 (msec) in Example 1-5, was changed to about 100 (μsec) so that the mixing characteristics of the two types of the solutions were evaluated. Results were shown in Tables 16 to 18. Also Tables 16 to 18 showed the mixture ratio (the concentration of ink) of ink and the diluent similarly to Table 3.

TABLE 16

| Diluent | Ink Samples 1-1 | | | 1-2 | | | 1-3 | | | 1-4 | | |
|---|---|---|---|---|---|---|---|---|---|---|---|---|
| Samples | a | b | c | a | b | c | a | b | c | a | b | c |
| 1-4 | ○ | ○ | ○ | ○ | ○ | Δ | X | X | X | X | X | X |
| 1-5 | ○ | ○ | ○ | ○ | ○ | ○ | X | X | X | X | X | X |
| 1-6 | ○ | ○ | ○ | ○ | ○ | ○ | ○ | ○ | Δ | X | X | X |
| 1-7 | ○ | ○ | ○ | ○ | ○ | ○ | ○ | ○ | Δ | X | X | X |
| 1-8 | ○ | ○ | ○ | ○ | ○ | ○ | ○ | ○ | ○ | ○ | ○ | ○ |
| 1-9 | ○ | ○ | ○ | ○ | ○ | ○ | ○ | ○ | ○ | ○ | ○ | ○ |
| 1-10 | ○ | ○ | ○ | ○ | ○ | ○ | ○ | ○ | ○ | ○ | ○ | ○ |

TABLE 17

| Diluent | Ink Samples 1-5 | | | 1-6 | | | 1-7 | | |
|---|---|---|---|---|---|---|---|---|---|
| Samples | a | b | c | a | b | c | a | b | c |
| 1-1 | ○ | ○ | ○ | ○ | ○ | Δ | X | X | X |
| 1-2 | ○ | ○ | ○ | ○ | ○ | ○ | ○ | ○ | Δ |
| 1-3 | ○ | ○ | ○ | ○ | ○ | ○ | ○ | ○ | ○ |
| 1-7 | ○ | ○ | ○ | ○ | ○ | ○ | ○ | ○ | Δ |
| 1-8 | ○ | ○ | ○ | ○ | ○ | ○ | ○ | ○ | ○ |
| 1-9 | ○ | ○ | ○ | ○ | ○ | ○ | ○ | ○ | ○ |
| 1-10 | ○ | ○ | ○ | ○ | ○ | ○ | ○ | ○ | ○ |

TABLE 18

| Diluent | Ink Samples 1-8 | | | 1-9 | | | 1-10 | | |
|---|---|---|---|---|---|---|---|---|---|
| Samples | a | b | c | a | b | c | a | b | c |
| 1-1 | X | X | X | X | X | X | X | X | X |
| 1-2 | ○ | ○ | Δ | X | X | X | X | X | X |
| 1-3 | ○ | ○ | ○ | ○ | ○ | Δ | X | X | X |
| 1-4 | X | X | X | X | X | X | X | X | X |
| 1-5 | X | X | X | X | X | X | X | X | X |
| 1-6 | ○ | ○ | Δ | X | X | X | X | X | X |

As can be understood from results shown in Tables 16 to 18, each combination of the diluent sample and ink sample satisfying the relationship as q−p≧0 under the assumption that the surface tension of the diluent sample, which was the discharge medium, was q (dyn/cm) and the surface tension of the ink sample, which was the quantitative medium, was p (dyn/cm) resulted in satisfactory mixing characteristic of the two types of the solutions being obtained.

However, since the period of time taken from the quantitative mixture of the quantitative medium and the discharge medium to the application to the recording medium was made to be shorter than that in Example 1-5, the mixing characteristics of the two types of the solutions deteriorated. Therefore, a fact was confirmed that the period of time taken from the quantitative mixture to the application to a recording medium affects the mixing characteristics of the two types of the solutions.

If the combination of the diluent sample and the ink sample was not changed, a satisfactory result was obtained when the ratio of the ink sample, which was the quantitative medium, was lower than that of the diluent sample which was the discharge medium.

As can be understood from the results of Example 1, the recording method according to the present invention enabled accurate expression of a gradation image to be performed because the quantitative medium, which was ink, was mixed with the discharge medium, which was the diluent, at a predetermined mixture ratio immediately before discharge to prepare diluted ink; and the discharge medium and quantitative medium satisfying the relationship as q−p≧0 on the assumption that the surface tension of the discharge medium was q (dyn/cm) and the surface tension of the quantitative medium was p (dyn/cm) were used when the diluted ink was applied to the surface of the recording medium so that the surface tensions of the quantitative medium and the discharge medium and their relationship were made to be adequate for the mixing operation.

Example 2

In this example, ink was used as the discharge medium and the diluent was used as the quantitative medium. Diluent samples and ink samples having different surface tensions were prepared, and the samples were used as the discharge medium and the quantitative medium for the above-mentioned printer so that the mixing characteristic of the two types of solutions was evaluated.

Example 2-1

Initially, water, isopropyl alcohol and glycerin were used as solvents, and then the solvents were arbitrarily added so that ink samples 2-1 to 2-3 having surface tensions and viscosity values (values respectively measured at 20° C.) as shown in Table 19 were prepared. C.I. Direct Yellow 50 was used as the dye in ink sample 2-1, C.I. Direct Yellow 87 was used as the dye in ink sample 2-2, C.I. Direct Red 83 was used as the dye in the ink sample 2-3. Moreover, the concentration of the dye was 3 wt %.

The surface tension was measured by a surface tension meter CBVP-Z (model name) manufactured by Kyowa Surface Chemistry, and the viscosity was measured by a viscosity meter DV-II+ (model name) manufactured by BROOK FIELD.

TABLE 19

| Ink Samples | Surface Tension (dyn/cm) | Viscosity (cp) | Name of Dye |
|---|---|---|---|
| 2-1 | 30 | 3.0 | C.I. Direct Yellow 50 |
| 2-2 | 40 | 3.0 | C.I. Direct Yellow 87 |
| 2-3 | 50 | 3.0 | C.I. Direct Red 83 |

Then, water, isopropyl alcohol and glycerin were used as solvents, and then the solvents were arbitrarily added so that diluent samples 2-1 to 2-4 having surface tensions and viscosity values (values respectively measured at 20° C.) as shown in Table 20 were prepared.

TABLE 20

| Diluent Samples | Surface Tension (dyn/cm) | Viscosity (cp) |
|---|---|---|
| 2-1 | 25 | 3.0 |
| 2-2 | 30 | 3.0 |
| 2-3 | 40 | 3.0 |
| 2-4 | 45 | 3.0 |

Then, quantitative mixing and discharge of two types of the solutions was performed similarly to Example 1-1 except for ink samples 2-1 to 2-3 and diluent samples 2-1 to 2-4 being used in such a manner that diluent samples 2-1 to 2-4 were used as the quantitative mediums and ink samples 2-1 to 2-3 were used as the discharge medium so that the mixing characteristics of the two types of the solutions were evaluated.

Results were shown in Table 21 with combination of ink samples and diluent samples and the concentration of ink. Symbol a in Table 21 indicated a case where diluent:ink was 50:50, b in Table 21 indicated a case where diluent:ink was 10:90 and c in Table 21 indicated a case where diluent:ink was 1:99.

TABLE 21

| Ink | Diluent Samples | | | | | | | | | | | |
|---|---|---|---|---|---|---|---|---|---|---|---|---|
| | 2-1 | | | 2-2 | | | 2-3 | | | 2-4 | | |
| Samples | a | b | c | a | b | c | a | b | c | a | b | c |
| 2-1 | ○ | ○ | ○ | ○ | ○ | ○ | Δ | X | X | X | X | X |
| 2-2 | ○ | ○ | ○ | ○ | ○ | ○ | ○ | ○ | ○ | Δ | X | X |
| 2-3 | ○ | ○ | ○ | ○ | ○ | ○ | ○ | ○ | ○ | ○ | ○ | ○ |

As can be understood from results shown in Table 21, each combination of the diluent sample and ink sample satisfying the relationship as $q-p \geqq 0$ under the assumption that the surface tension of the ink sample, which was the discharge medium, was q (dyn/cm) and the surface tension of the diluent sample, which was the quantitative medium, was p (dyn/cm) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed.

If the combination of the diluent sample and the ink sample was not changed, a satisfactory result was obtained when the ratio of the diluent sample, which was the quantitative medium, was lower than that of the ink sample which was the discharge medium.

Example 2-2

As the solvents, water, ethylene glycol monomethylether and diethylene glycol were used and then the solvents were arbitrarily added. Then, non-ionic surface active agent ("Emergen 985" trade name of Kao) was added as the surface active agent so that ink samples 2-4 to 2-6 having surface tensions and viscosity values (values respectively measured at 20° C.) as shown in Table 22 were prepared. C.I. Direct Red 227 was used as the dye in ink sample 2-4, C.I. Direct Blue 6 was used as the dye in ink sample 2-5 and C.I. Direct Blue 86 was used as the dye in ink sample 2-6. Moreover, the concentration of the dye was 5 wt %.

TABLE 22

| Ink Samples | Surface Tension (dyn/cm) | Viscosity (cp) | Name of Dye |
|---|---|---|---|
| 2-4 | 30 | 5.0 | C.I. Direct Red 227 |
| 2-5 | 35 | 5.0 | C.I. Direct Blue 6 |
| 2-6 | 40 | 5.0 | C.I. Direct Black 86 |

On the other hand, as the solvents, water, ethylene glycol monomethylether and diethylene glycol were used and then the solvents were arbitrarily added. Then, non-ionic surface active agent ("Emergen 985" trade name of Kao) was added as the surface active agent so that diluent samples 2-5 to 2-7 having surface tensions and viscosity values (values respectively measured at 20° C.) as shown in Table 23 were prepared.

TABLE 23

| | | Surface Tension (dyn/cm) | Viscosity (cp) |
|---|---|---|---|
| Diluent Samples | 2-5 | 25 | 5.0 |
| | 2-6 | 30 | 5.0 |
| | 2-7 | 40 | 5.0 |

Diluent samples 2-5 to 2-7 and ink samples 2-4 to 2-6 were used to perform quantitative discharge of a mixture solution of two types of the solutions similarly to Example 2-1 so that the mixing characteristics of the two types of the solutions were evaluated similarly to the foregoing example. Results were shown in Table 24. Also Table 24 shows the mixture ratio (the concentration of ink) of ink and the diluent similarly to Table 21.

TABLE 24

| | | Diluent Samples | | | | | | | | |
|---|---|---|---|---|---|---|---|---|---|---|
| | | 2-5 | | | 2-6 | | | 2-7 | | |
| | | a | b | c | a | b | c | a | b | c |
| Ink Samples | 2-4 | ○ | ○ | ○ | ○ | ○ | ○ | Δ | X | X |
| | 2-5 | ○ | ○ | ○ | ○ | ○ | ○ | Δ | X | X |
| | 2-6 | ○ | ○ | ○ | ○ | ○ | ○ | ○ | ○ | ○ |

As can be understood from results shown in Table 24, each combination of the diluent sample and ink sample satisfying the relationship as $q-p \geqq 0$ under the assumption that the surface tension of the ink sample, which was the discharge medium, was q (dyn/cm) and the surface tension of the diluent sample, which was the quantitative medium, was p (dyn/cm) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed.

If the combination of the diluent sample and the ink sample was not changed, a satisfactory result was obtained when the ratio of the diluent sample, which was the quantitative medium, was lower than that of the ink sample which was the discharge medium.

Example 2-3

As the solvents, water, 2-(2-butoxyethoxy) ethanol, triethanol amine and glycerin were used and then the solvents were arbitrarily added so that ink samples 2-7 to 2-9 having surface tensions and viscosity values (values respectively measured at 20° C.) as shown in Table 25 were prepared. C.I. Acid Yellow 23 was used as the dye in ink sample 2-7, C.I. Acid Red 27 was used as the dye in ink sample 2-8 and C.I. Acid Blue 9 was used as the dye in ink sample 2-9. The concentration of the dye was 3 wt %.

TABLE 25

| | | Surface Tension (dyn/cm) | Viscosity (cp) | Name of Dye |
|---|---|---|---|---|
| Ink Samples | 2-7 | 40 | 10.0 | C.I. Acid Yellow 23 |
| | 2-8 | 50 | 10.0 | C.I. Acid Red 27 |
| | 2-9 | 60 | 10.0 | C.I. Acid Blue 9 |

As the solvents, water, 2-(2-butoxyethoxy) ethanol, triethanol amine and glycerin were used and then the solvents were arbitrarily added so that diluent samples 2-8 to 2-10 having surface tensions and viscosity values (values respectively measured at 20° C.) as shown in Table 26 were prepared.

TABLE 26

| | | Surface Tension (dyn/cm) | Viscosity (cp) |
|---|---|---|---|
| Diluent Samples | 2-8 | 40 | 10.0 |
| | 2-9 | 50 | 10.0 |
| | 2-10 | 60 | 10.0 |

Quantitative discharge of a mixture solution of two types of the solutions was performed similarly to Example 2-1 by using diluent samples 2-8 to 2-10 and ink samples 2-7 to 2-9 so that the mixing characteristics of the two types of the solutions were evaluated. Results were shown in Table 27. Also Table 27 showed the mixture ratio (the concentration of ink) of ink and the diluent similarly to Table 21.

TABLE 27

| | | Diluent Samples | | | | | | | | |
|---|---|---|---|---|---|---|---|---|---|---|
| | | 2-8 | | | 2-9 | | | 2-10 | | |
| | | a | b | c | a | b | c | a | b | c |
| Ink Samples | 2-7 | ○ | ○ | ○ | Δ | X | X | X | X | X |
| | 2-8 | ○ | ○ | ○ | ○ | ○ | ○ | Δ | X | X |
| | 2-9 | ○ | ○ | ○ | ○ | ○ | ○ | ○ | ○ | ○ |

As can be understood from results shown in Table 27, each combination of the diluent sample and ink sample satisfying the relationship as $q-p \geqq 0$ under the assumption that the surface tension of the ink sample, which was the discharge medium, was q (dyn/cm) and the surface tension of the diluent sample, which was the quantitative medium, was p (dyn/cm) resulted in satisfactory mixing characteristic of the two types of the solutions being obtained. Thus, a solution mixed satisfactorily was discharged and thus accurate expression of a gradation image was formed.

If the combination of the diluent sample and the ink sample was not changed, a satisfactory result was obtained when the ratio of the diluent sample, which was the quantitative medium, was lower than that of the ink sample which was the discharge medium.

Example 2-4

Quantitative discharge of a mixture solution of two types of the solutions was performed similarly to Examples 2-1 except for the period of time taken from quantitative mixture to the application to the recording medium, which was about 1 (msec) in Examples 2-1 to 2-3, was changed to about 500 (μsec) so that the mixing characteristics of the two types of the solutions were evaluated. Results were shown in Tables 28 to 30. Also Tables 28 to 30 showed the mixture ratio (the concentration of ink) of ink and the diluent similarly to Table 21.

TABLE 28

| | | Diluent Samples | | | | | | | | | | | |
|---|---|---|---|---|---|---|---|---|---|---|---|---|---|
| | | 2-1 | | | 2-2 | | | 2-3 | | | 2-4 | | |
| | | a | b | c | a | b | c | a | b | c | a | b | c |
| Ink Samples | 2-1 | ○ | ○ | ○ | ○ | ○ | ○ | X | X | X | X | X | X |
| | 2-2 | ○ | ○ | ○ | ○ | ○ | ○ | ○ | ○ | ○ | X | X | X |
| | 2-3 | ○ | ○ | ○ | ○ | ○ | ○ | ○ | ○ | ○ | ○ | ○ | ○ |

TABLE 29

| | | Diluent Samples | | | | | | | | |
|---|---|---|---|---|---|---|---|---|---|---|
| | | 2-5 | | | 2-6 | | | 2-7 | | |
| | | a | b | c | a | b | c | a | b | c |
| Ink Samples | 2-4 | ○ | ○ | ○ | ○ | ○ | ○ | X | X | X |
| | 2-5 | ○ | ○ | ○ | ○ | ○ | ○ | X | X | X |
| | 2-6 | ○ | ○ | ○ | ○ | ○ | ○ | ○ | ○ | ○ |

TABLE 30

| | | Diluent Samples | | | | | | | | |
|---|---|---|---|---|---|---|---|---|---|---|
| | | 2-8 | | | 2-9 | | | 2-10 | | |
| | | a | b | c | a | b | c | a | b | c |
| Ink Samples | 2-7 | ○ | ○ | ○ | X | X | X | X | X | X |
| | 2-8 | ○ | ○ | ○ | ○ | ○ | ○ | X | X | X |
| | 2-9 | ○ | ○ | ○ | ○ | ○ | ○ | ○ | ○ | ○ |

As can be understood from results shown in Tables 28 to 30, each combination of the diluent sample and ink sample satisfying the relationship as $q-p \geqq 0$ under the assumption that the surface tension of the ink sample, which was the discharge medium, was q (dyn/cm) and the surface tension of the diluent sample, which was the quantitative medium, was p (dyn/cm) resulted in satisfactory mixing characteristic of the two types of the solutions being obtained.

However, since the period of time taken from the quantitative mixture of the quantitative medium and the discharge medium to the application to the recording medium was made to be shorter than that in the foregoing experiments, the mixing characteristics of the two types of the solutions deteriorated. Therefore, a fact was confirmed that the period of time taken from the quantitative mixture to the application to a recording medium affects the mixing characteristics of the two types of the solutions.

If the combination of the diluent sample and the ink sample was not changed, a satisfactory result was obtained when the ratio of the diluent sample, which was the quantitative medium, was lower than that of the ink sample which was the discharge medium.

Example 2-5

Quantitative discharge of a mixture solution of two types of the solutions was performed similarly to Example 2-4 except for the above-mentioned combinations of the ink samples and diluent samples being changed so that the mixing characteristics of the two types of the solutions were evaluated. Results were shown in Tables 31 to 33. Also Tables 31 to 33 showed the mixture ratio (the concentration of ink) of ink and the diluent similarly to Table 21.

TABLE 31

| | Diluent Samples | | | | | | | | | | | |
|---|---|---|---|---|---|---|---|---|---|---|---|---|
| Ink | 2-1 | | | 2-2 | | | 2-3 | | | 2-4 | | |
| Samples | a | b | c | a | b | c | a | b | c | a | b | c |
| 2-4 | ○ | ○ | ○ | ○ | ○ | ○ | X | X | X | X | X | X |
| 2-5 | ○ | ○ | ○ | ○ | ○ | ○ | X | X | X | X | X | X |
| 2-6 | ○ | ○ | ○ | ○ | ○ | ○ | ○ | ○ | ○ | Δ | X | X |
| 2-7 | ○ | ○ | ○ | ○ | ○ | ○ | ○ | ○ | ○ | Δ | X | X |
| 2-8 | ○ | ○ | ○ | ○ | ○ | ○ | ○ | ○ | ○ | ○ | ○ | ○ |
| 2-9 | ○ | ○ | ○ | ○ | ○ | ○ | ○ | ○ | ○ | ○ | ○ | ○ |

TABLE 32

| | Diluent Samples | | | | | | | | |
|---|---|---|---|---|---|---|---|---|---|
| Ink | 2-5 | | | 2-6 | | | 2-7 | | |
| Samples | a | b | c | a | b | c | a | b | c |
| 2-1 | ○ | ○ | ○ | ○ | ○ | ○ | X | X | X |
| 2-2 | ○ | ○ | ○ | ○ | ○ | ○ | ○ | ○ | ○ |
| 2-3 | ○ | ○ | ○ | ○ | ○ | ○ | ○ | ○ | ○ |
| 2-7 | ○ | ○ | ○ | ○ | ○ | ○ | ○ | ○ | ○ |
| 2-8 | ○ | ○ | ○ | ○ | ○ | ○ | ○ | ○ | ○ |
| 2-9 | ○ | ○ | ○ | ○ | ○ | ○ | ○ | ○ | ○ |

TABLE 33

| | Diluent Samples | | | | | | | | |
|---|---|---|---|---|---|---|---|---|---|
| Ink | 2-8 | | | 2-9 | | | 2-10 | | |
| Samples | a | b | c | a | b | c | a | b | c |
| 2-1 | X | X | X | X | X | X | X | X | X |
| 2-2 | ○ | ○ | ○ | X | X | X | X | X | X |
| 2-3 | ○ | ○ | ○ | ○ | ○ | ○ | X | X | X |
| 2-4 | X | X | X | X | X | X | X | X | X |
| 2-5 | Δ | X | X | X | X | X | X | X | X |
| 2-6 | ○ | ○ | ○ | X | X | X | X | X | X |

As can be understood from results shown in Tables 31 to 33, each combination of the diluent sample and ink sample satisfying the relationship as $q-p \geqq 0$ under the assumption that the surface tension of the ink sample, which was the discharge medium, was q (dyn/cm) and the surface tension of the diluent sample, which was the quantitative medium, was p (dyn/cm) resulted in satisfactory mixing characteristic of the two types of the solutions being obtained.

If the combination of the diluent sample and the ink sample was not changed, a satisfactory result was obtained when the ratio of the diluent sample, which was the quantitative medium, was lower than that of the ink sample which was the discharge medium.

Example 2-6

Quantitative discharge of a mixture solution of two types of the solutions was performed similarly to Example 2-5 except for the period of time taken from quantitative mixture to the application to the recording medium, which was about 500 (msec) in Example 2-5, was changed to about 100 (μsec) so that the mixing characteristics of the two types of the solutions were evaluated. Results were shown in Tables 34 to 36. Also Tables 34 to 36 showed the mixture ratio (the concentration of ink) of ink and the diluent similarly to Table 21.

TABLE 34

| Ink | Diluent Samples | | | | | | | | | | | |
|---|---|---|---|---|---|---|---|---|---|---|---|---|
| | 2-1 | | | 2-2 | | | 2-3 | | | 2-4 | | |
| Samples | a | b | c | a | b | c | a | b | c | a | b | c |
| 2-4 | ○ | ○ | ○ | ○ | ○ | Δ | X | X | X | X | X | X |
| 2-5 | ○ | ○ | ○ | ○ | ○ | ○ | X | X | X | X | X | X |
| 2-6 | ○ | ○ | ○ | ○ | ○ | ○ | ○ | ○ | Δ | X | X | X |
| 2-7 | ○ | ○ | ○ | ○ | ○ | ○ | ○ | ○ | Δ | X | X | X |
| 2-8 | ○ | ○ | ○ | ○ | ○ | ○ | ○ | ○ | ○ | ○ | ○ | ○ |
| 2-9 | ○ | ○ | ○ | ○ | ○ | ○ | ○ | ○ | ○ | ○ | ○ | ○ |

TABLE 35

| Ink | Diluent Samples | | | | | | | | |
|---|---|---|---|---|---|---|---|---|---|
| | 2-5 | | | 2-6 | | | 2-7 | | |
| Samples | a | b | c | a | b | c | a | b | c |
| 2-1 | ○ | ○ | ○ | ○ | ○ | Δ | X | X | X |
| 2-2 | ○ | ○ | ○ | ○ | ○ | ○ | ○ | ○ | Δ |
| 2-3 | ○ | ○ | ○ | ○ | ○ | ○ | ○ | ○ | ○ |
| 2-7 | ○ | ○ | ○ | ○ | ○ | ○ | ○ | ○ | Δ |
| 2-8 | ○ | ○ | ○ | ○ | ○ | ○ | ○ | ○ | ○ |
| 2-9 | ○ | ○ | ○ | ○ | ○ | ○ | ○ | ○ | ○ |

TABLE 36

| Ink | Diluent Samples | | | | | | | | |
|---|---|---|---|---|---|---|---|---|---|
| | 2-8 | | | 2-9 | | | 2-10 | | |
| Samples | a | b | c | a | b | c | a | b | c |
| 2-1 | X | X | X | X | X | X | X | X | X |
| 2-2 | ○ | ○ | Δ | X | X | X | X | X | X |
| 2-3 | ○ | ○ | ○ | ○ | ○ | Δ | X | X | X |
| 2-4 | X | X | X | X | X | X | X | X | X |
| 2-5 | X | X | X | X | X | X | X | X | X |
| 2-6 | ○ | ○ | Δ | X | X | X | X | X | X |

As can be understood from results shown in Tables 34 to 36, each combination of the diluent sample and ink sample satisfying the relationship as $q-p \geqq 0$ under the assumption that the surface tension of the ink sample, which was the discharge medium, was q (dyn/cm) and the surface tension of the diluent sample, which was the quantitative medium, was p (dyn/cm) resulted in satisfactory mixing characteristic of the two types of the solutions being obtained.

However, since the period of time taken from the quantitative mixture of the quantitative medium and the discharge medium to the application to the recording medium was made to be shorter than that in Example 2-5, the mixing characteristics of the two types of the solutions deteriorated. Therefore, a fact was confirmed that the period of time taken from the quantitative mixture to the application to a recording medium affects the mixing characteristics of the two types of the solutions.

If the combination of the diluent sample and the ink sample was not changed, a satisfactory result was obtained when the ratio of the diluent sample, which was the quantitative medium, was lower than that of the ink sample which was the discharge medium.

As can be understood from the results of Example 2, the recording method according to the present invention enabled accurate expression of a gradation image to be performed because the quantitative medium, which was the diluent, was mixed with the discharge medium, which was ink, at a predetermined mixture ratio immediately before discharge to prepare diluted ink; and the discharge medium and quantitative medium satisfying the relationship as $q-p \geqq 0$ on the assumption that the surf ace tension of the discharge medium was q (dyn/cm) and the surface tension of the quantitative medium was p (dyn/cm) were used when the diluted ink was applied to the surface of the recording medium so that the surface tensions of the quantitative medium and the discharge medium and their relationship were made to be adequate for the mixing operation.

Example 3

In this example, the diluent was used as the discharge medium and the ink was used as the quantitative medium. Samples of diluent and ink having different surface tensions were prepared, and the samples were used as the discharge medium and the quantitative medium for the above-mentioned printer so that the mixing characteristic of the two types of solutions and the discharge stability were evaluated.

Example 3-1

Initially, water, isopropyl alcohol and glycerin were used as solvents, and then the solvents were arbitrarily added so that ink samples 3-1 to 3-8 having surface tensions and viscosity values (values respectively measured at 20° C.) as shown in Table 37 were prepared. C.I. Direct Yellow 50 was used as the dye in ink sample 3-1, C.I. Direct Yellow 87 was used as the dye in ink sample 3-2, C.I. Direct Red 83 was used as the dye in the ink sample 3-3, C.I. Direct Red 227 was used as the dye in the ink sample 3-4, C.I. Direct Blue 6 was used as the dye in ink sample 3-5, C.I. Direct Blue 86 was used as the dye in ink sample 3-6, C.I. Direct Black 38 was used as the dye in ink sample 3-7 and C.I. Direct Black 154 was used as the dye in ink sample 3-8. Moreover, the concentration of the dye was 3 wt %.

The surface tension was measured by a surface tension meter CBVP-Z (model name) manufactured by Kyowa Surface Chemistry, and the viscosity was measured by a viscosity meter DV-II+ (model name) manufactured by BROOK FIELD.

TABLE 37

| Ink Samples | Surface Tension (dyn/cm) | Viscosity (cp) | Name of Dye |
|---|---|---|---|
| 3-1 | 25 | 1.5 | C.I. Direct Yellow 50 |
| 3-2 | 25 | 3.0 | C.I. Direct Yellow 87 |
| 3-3 | 30 | 3.0 | C.I. Direct Red 83 |
| 3-4 | 30 | 5.0 | C.I. Direct Red 227 |
| 3-5 | 40 | 3.0 | C.I. Direct Blue 6 |
| 3-6 | 40 | 10.0 | C.I. Direct Blue 86 |
| 3-7 | 45 | 3.0 | C.I. Direct Black 38 |
| 3-8 | 45 | 15.0 | C.I. Direct Black 154 |

Then, water, isopropyl alcohol and glycerin were used, and then these solvents were arbitrarily added so that diluent samples 3-1 to 3-6 having surface tensions and viscosity values (values respectively measured at 20° C.) as shown in Table 38 were prepared.

TABLE 38

| Diluent Samples | Surface Tension (dyn/cm) | Viscosity (cp) |
|---|---|---|
| 3-1 | 30 | 1.5 |
| 3-2 | 30 | 3.0 |
| 3-3 | 40 | 3.0 |
| 3-4 | 40 | 10.0 |
| 3-5 | 50 | 3.0 |
| 3-6 | 50 | 15.0 |

Then, ink samples 3-1 to 3-8 and diluent samples 3-1 to 3-6 were used to perform quantitative discharge of a mixed solution of the two types of solutions so that the mixing characteristic of the two types of solutions and the discharge stability were evaluated.

The mixing characteristics of the two types of the solutions was evaluated similarly to Example 1-1. The discharge stability of one of the two types of the solutions was evaluated such that ink samples 3-1 to 3-8 and diluent samples 3-1 to 3-6 were combined variously and the concentration of ink was varied to respective print images. Then, the degree of deviation of the position, at which a printed pattern was formed, from the position at which a printed pattern was formed when only the diluent sample was discharged was measured. The results were evaluated into the following three grades. That is, results that the deviation was smaller than 30 μm were given a mark 0, results that the deviation was in a range from 30 μm to 60 mm were given a mark Δ and results that the deviation was larger than 60 μm was given a mark x.

Figure 10:
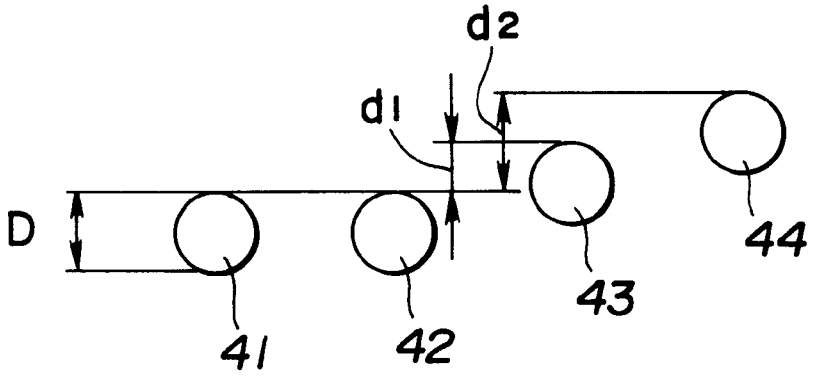
FIG. 10 is a schematic view showing a printed pattern.

At this time, the printed pattern was formed in such a manner that two circular patterns 41 and 42 each having a diameter indicated with symbol D shown in FIG. 10 being 120 μm were formed adjacently, as shown in FIG. 10. Note that the description will be performed that the circular patterns 41 and 42 were formed with only the diluent. That is, the deviation of circular patterns 43 and 44, each having a shape similar to each of the above-mentioned circular patterns and formed by mixed droplets, from the positions of the circular patterns 41 and 42, that is, the degrees of deviations, respectively indicated with $d_1$ and $d_2$ shown in FIG. 10, were measured.

Results were shown in Tables 39 and 40 with combination of ink samples and diluent samples and the concentration of ink. Symbol a in Tables 39 and 40 indicated a case where ink:diluent was 50:50, b in Tables 39 and 40 indicated a case where ink:diluent was 10:90 and c in Tables 39 and 40 indicated a case where ink:diluent was 1:99. In Tables 39 and 40, results of the mixing characteristics of the two types of the solutions were hereinafter indicated with symbol "M" and those of the discharge stability were hereinafter indicated with symbol "D".

TABLE 39

| | Ink Samples | | | | | |
|---|---|---|---|---|---|---|
| | 3-1 | | | 3-2 | | |
| Diluent Samples | a MD | b MD | c MD | a MD | b MD | c MD |
| 3-1 | ○Δ | ○○ | ○○ | ○X | ○Δ | ○Δ |
| 3-2 | ○○ | ○○ | ○○ | ○Δ | ○○ | ○○ |
| 3-3 | ○○ | ○○ | ○○ | ○Δ | ○○ | ○○ |

TABLE 39-continued

| | | | | | | |
|---|---|---|---|---|---|---|
| 3-4 | ○○ | ○○ | ○○ | ○○ | ○○ | ○○ |
| 3-5 | ○○ | ○○ | ○○ | ○Δ | ○○ | ○○ |
| 3-6 | ○○ | ○○ | ○○ | ○○ | ○○ | ○○ |

| | Ink Samples | | | | | |
|---|---|---|---|---|---|---|
| | 3-3 | | | 3-4 | | |
| Diluent Samples | a MD | b MD | c MD | a MD | b MD | c MD |
| 3-1 | ○X | ○Δ | ○Δ | ○X | ○X | ○X |
| 3-2 | ○Δ | ○○ | ○○ | ○X | ○Δ | ○Δ |
| 3-3 | ○Δ | ○○ | ○○ | ○X | ○Δ | ○Δ |
| 3-4 | ○○ | ○○ | ○○ | ○○ | ○○ | ○○ |
| 3-5 | ○Δ | ○○ | ○○ | ○X | ○Δ | ○Δ |
| 3-6 | ○○ | ○○ | ○○ | ○○ | ○○ | ○○ |

TABLE 40

| | Ink Samples | | | | | |
|---|---|---|---|---|---|---|
| | 3-5 | | | 3-6 | | |
| Diluent Samples | a MD | b MD | c MD | a MD | b MD | c MD |
| 3-1 | ΔX | XΔ | XΔ | ΔX | XX | XX |
| 3-2 | ΔΔ | X○ | X○ | ΔX | XX | XX |
| 3-3 | ○Δ | ○○ | ○○ | ○X | ○X | ○X |
| 3-4 | ○○ | ○○ | ○○ | ○Δ | ○○ | ○○ |
| 3-5 | ○Δ | ○○ | ○○ | ○X | ○X | ○X |
| 3-6 | ○○ | ○○ | ○○ | ○○ | ○○ | ○○ |

| | Ink Samples | | | | | |
|---|---|---|---|---|---|---|
| | 3-7 | | | 3-8 | | |
| Diluent Samples | a MD | b MD | c MD | a MD | b MD | c MD |
| 3-1 | XX | XΔ | XΔ | XX | XX | XX |
| 3-2 | XΔ | X○ | X○ | XX | XX | XX |
| 3-3 | ΔΔ | X○ | X○ | ΔX | XX | XX |
| 3-4 | Δ○ | X○ | X○ | ΔX | XX | XX |
| 3-5 | ○Δ | ○○ | ○○ | ○X | ○X | ○X |
| 3-6 | ○○ | ○○ | ○○ | ○Δ | ○○ | ○○ |

As can be understood from results shown in Tables 39 and 40, each combination of the diluent sample and ink sample satisfying the relationship as $q-p \geqq 0$ and $\beta-\alpha \geqq 0$ under the assumption that the surface tension of the diluent sample, which was the discharge medium, was q (dyn/cm) and the viscosity of the same was β (cp) and the surface tension of the ink sample, which was the quantitative medium, was p (dyn/cm) and the viscosity of same was α (cp) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed and the discharge stability was improved.

If the combination of the diluent sample and the ink sample was not changed, a satisfactory result was obtained when the ratio of the ink sample, which was the quantitative medium, was lower than that of the diluent sample which was the discharge medium.

Example 3-2

As the solvents, water, ethylene glycol monomethylether and diethylene glycol were used and then the solvents were arbitrarily added. Then, non-ionic surface active agent ("Emergen 985" trade name of Kao) was added as the surface active agent so that ink samples 3-9 to 3-14 having surface tensions and viscosity values (values respectively measured at 20° C.) as shown in Table 41 were prepared. C.I. Acid Yellow 23 was used as the dye in ink sample 3-9, C.I. Acid Yellow 42 was used as the dye in ink sample 3-10, C.I. Acid Red 27 was used as the dye in ink sample 3-11, C.I. Acid Red 52 was used as the dye in ink sample 3-12, C.I. Acid Blue 9 was used as the dye in ink sample 3-13 and C.I. Acid Blue 15 was used as the dye in ink sample 3-14. Moreover, the concentration of the dye was 3 wt %.

TABLE 41

| Ink Samples | Surface Tension (dyn/cm) | Viscosity (cp) | Name of Dye |
|---|---|---|---|
| 3-9 | 25 | 5.0 | C.I. Direct Yellow 23 |
| 3-10 | 25 | 15.0 | C.I. Direct Yellow 42 |
| 3-11 | 30 | 5.0 | C.I. Direct Red 27 |
| 3-12 | 30 | 8.0 | C.I. Direct Red 52 |
| 3-13 | 40 | 4.0 | C.I. Direct Blue 9 |
| 3-14 | 40 | 5.0 | C.I. Direct Blue 15 |

On the other hand, as the solvents, water, ethylene glycol monomethylether and diethylene glycol were used and then the solvents were arbitrarily added. Then, non-ionic surface active agent ("Emergen 985" trade name of Kao) was added as the surface active agent so that ink samples 3-7 to 3-12 having surface tensions and viscosity values (values respectively measured at 20° C.) as shown in Table 42 were prepared.

TABLE 42

| Diluent Samples | Surface Tension (dyn/cm) | Viscosity (cp) |
|---|---|---|
| 3-7 | 30 | 5.0 |
| 3-8 | 30 | 15.0 |
| 3-9 | 35 | 5.0 |
| 3-10 | 35 | 8.0 |
| 3-11 | 40 | 4.0 |
| 3-12 | 40 | 5.0 |

Diluent samples 3-7 to 3-12 and ink samples 3-9 to 3-14 were used to perform quantitative discharge of a mixture solution of two types of the solutions similarly to Example 3-1 so that the mixing characteristics of the two types of the solutions and the discharge stability were evaluated. Results were shown in Tables 43 and 44. Also Tables 43 and 44 showed the mixture ratio (the concentration of ink) of ink and the diluent similarly to Tables 39 and 40.

TABLE 43

| | Ink Samples | | | | | |
|---|---|---|---|---|---|---|
| | 3-9 | | | 3-10 | | |
| Diluent Samples | a MD | b MD | c MD | a MD | b MD | c MD |
| 3-7 | ○Δ | ○○ | ○○ | ○X | ○X | ○X |
| 3-8 | ○○ | ○○ | ○○ | ○Δ | ○○ | ○○ |
| 3-9 | ○Δ | ○○ | ○○ | ○X | ○X | ○X |
| 3-10 | ○○ | ○○ | ○○ | ○X | ○X | ○X |
| 3-11 | ○X | ○Δ | ○○ | ○X | ○X | ○X |
| 3-12 | ○○ | ○○ | ○○ | ○X | ○X | ○X |

TABLE 43-continued

| | Ink Samples | | | | | |
|---|---|---|---|---|---|---|
| | 3-11 | | | 3-12 | | |
| Diluent Samples | a MD | b MD | c MD | a MD | b MD | c MD |
| 3-7 | ○Δ | ○○ | ○○ | ○X | ○X | ○X |
| 3-8 | ○○ | ○○ | ○○ | ○○ | ○○ | ○○ |
| 3-9 | ○Δ | ○○ | ○○ | ○X | ○X | ○X |
| 3-10 | ○○ | ○○ | ○○ | ○Δ | ○○ | ○○ |
| 3-11 | ○X | ○Δ | ○○ | ○X | ○X | ○X |
| 3-12 | ○○ | ○○ | ○○ | ○X | ○X | ○X |

TABLE 44

| | Ink Samples | | | | | |
|---|---|---|---|---|---|---|
| | 3-13 | | | 3-14 | | |
| Diluent Samples | a MD | b MD | c MD | a MD | b MD | c MD |
| 3-7 | Δ○ | X○ | X○ | ΔΔ | X○ | XΔ |
| 3-8 | Δ○ | X○ | X○ | Δ○ | X○ | X○ |
| 3-9 | Δ○ | X○ | X○ | ΔΔ | X○ | X○ |
| 3-10 | Δ○ | X○ | X○ | Δ○ | X○ | X○ |
| 3-11 | ○Δ | ○○ | ○○ | ○X | ○Δ | ○○ |
| 3-12 | ○○ | ○○ | ○○ | ○Δ | ○○ | ○○ |

As can be understood from results shown in Tables 43 and 44, each combination of the diluent sample and ink sample satisfying the relationship as $q-p \geqq 0$ and $\beta-\alpha \geqq 0$ under the assumption that the surface tension of the diluent sample, which was the discharge medium, was q (dyn/cm) and the viscosity of the same was β (cp) and the surface tension of the ink sample, which was the quantitative medium, was p (dyn/cm) and the viscosity of same was α (cp) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed and the discharge stability was improved.

If the combination of the diluent sample and the ink sample was not changed, a satisfactory result was obtained when the ratio of the ink sample, which was the quantitative medium, was lower than that of the diluent sample which was the discharge medium.

Example 3-3

As the solvents, water, 2-(2-butoxyethoxy) ethanol, triethanol amine and glycerin were used and then the solvents were arbitrarily added. Then, non-ionic surface active agent ("Emergen 985" trade name of Kao) was added as the surface active agent so that ink samples 3-15 to 3-17 having surface tensions and viscosity values (values respectively measured at 20° C.) as shown in Table 45 were prepared. C.I. Acid Black 24 was used as the dye in ink sample 3-15, C.I. Acid Black 72 was used as the dye in ink sample 3-16 and C.I. Acid Black 94 was used as the dye in ink sample 3-17. Moreover, the concentration of the dye was 3 wt %.

TABLE 45

| | | Surface Tension (dyn/cm) | Viscosity (cp) | Name of Dye |
|---|---|---|---|---|
| Ink Samples | 3-15 | 40 | 15.0 | C.I. Direct Black 24 |
| | 3-16 | 50 | 15.0 | C.I. Direct Black 72 |
| | 3-17 | 60 | 15.0 | C.I. Direct Black 94 |

As the solvents, water, 2-(2-butoxyethoxy) ethanol, triethanol amine and glycerin were used and then the solvents were arbitrarily added. Then, non-ionic surface active agent ("Emergen 985" trade name of Kao) was added as the surface active agent so that diluent samples 3-13 to 3-15 having surface tensions and viscosity values (values respectively measured at 20° C.) as shown in Table 46 were prepared.

TABLE 46

| | | Surface Tension (dyn/cm) | Viscosity (cp) |
|---|---|---|---|
| Diluent Samples | 3-13 | 40 | 15.0 |
| | 3-14 | 50 | 15.0 |
| | 3-15 | 60 | 15.0 |

As the solvent, a solution in which glycerin was mixed with water in a small quantity was used and then the solvent was arbitrarily added so as to be prepared in such a manner that the surface tension was 70 dyn/cm and the viscosity was 1.5 cp. The prepared solution was used as diluent sample 3-16.

Diluent samples 3-13 to 3-16 and ink samples 3-15 to 3-17 were used to quantitative medium discharge a mixture solution of two types of the solutions similarly to Example 3-1 so that the mixing characteristics of the two types of the solutions and the discharge stability were evaluated. Results were shown in Table 47. Also Table 47 showed the mixture ratio (the concentration of ink) of ink and the diluent similarly to Tables 39 and 40.

TABLE 47

| | | Ink Samples | | | | | |
|---|---|---|---|---|---|---|---|
| | | 3-15 | | | 3-16 | | |
| | | a MD | b MD | c MD | a MD | b MD | c MD |
| Diluent Samples | 3-13 | ○Δ | ○○ | ○○ | ΔΔ | X○ | X○ |
| | 3-14 | ○Δ | ○○ | ○○ | ○Δ | ○○ | ○○ |
| | 3-15 | ○Δ | ○○ | ○○ | ○Δ | ○○ | ○○ |
| | 3-16 | ○X | ○X | ○X | ○X | ○X | ○X |

| | | Ink Samples 3-17 | | |
|---|---|---|---|---|
| | | a MD | b MD | c MD |
| Diluent Samples | 3-13 | X○ | X○ | X○ |
| | 3-14 | ΔΔ | X○ | X○ |
| | 3-15 | ○Δ | ○○ | ○○ |
| | 3-16 | ○X | ○X | ○X |

As can be understood from results shown in Table 47, each combination of the diluent sample and ink sample satisfying the relationship as $q-p \geqq 0$ and $\beta-\alpha \geqq 0$ under the assumption that the surface tension of the diluent sample, which was the discharge medium, was q (dyn/cm) and the viscosity of the same was β (cp) and the surface tension of the ink sample, which was the quantitative medium, was p (dyn/cm) and the viscosity of same was α (cp) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed and the discharge stability was improved.

If the combination of the diluent sample and the ink sample was not changed, a satisfactory result was obtained when the ratio of the ink sample, which was the quantitative medium, was lower than that of the diluent sample which was the discharge medium.

Example 3-4

Quantitative discharge of a mixture solution of two types of the solutions was performed similarly to Example 3-1 except for the period of time taken from quantitative mixture to the application to the recording medium, which was about 1 (msec) in Examples 3-1 to 3-3, was changed to about 500 (μsec) so that the mixing characteristics of the two types of the solutions and the discharge stability were evaluated. Results were shown in Tables 48 to 51. Also Tables 48 to 51 showed the mixture ratio (the concentration of ink) of ink and the diluent similarly to Tables 39 and 40.

TABLE 48

| | | Ink Samples | | | | | |
|---|---|---|---|---|---|---|---|
| | | 3-1 | | | 3-2 | | |
| | | a MD | b MD | c MD | a MD | b MD | c MD |
| Diluent Samples | 3-1 | ○Δ | ○○ | ○○ | ○X | ○Δ | ○Δ |
| | 3-2 | ○○ | ○○ | ○○ | ○Δ | ○○ | ○○ |
| | 3-3 | ○○ | ○○ | ○○ | ○Δ | ○○ | ○○ |
| | 3-4 | ○○ | ○○ | ○○ | ○○ | ○○ | ○○ |
| | 3-5 | ○○ | ○○ | ○○ | ○Δ | ○○ | ○○ |
| | 3-6 | ○○ | ○○ | ○○ | ○○ | ○○ | ○○ |

| | | Ink Samples | | | | | |
|---|---|---|---|---|---|---|---|
| | | 3-3 | | | 3-4 | | |
| | | a MD | b MD | c MD | a MD | b MD | c MD |
| Diluent Samples | 3-1 | ○X | ○Δ | ○Δ | ○X | ○X | ○X |
| | 3-2 | ○Δ | ○○ | ○○ | ○X | ○Δ | ○Δ |
| | 3-3 | ○Δ | ○○ | ○○ | ○X | ○Δ | ○Δ |
| | 3-4 | ○○ | ○○ | ○○ | ○○ | ○○ | ○○ |
| | 3-5 | ○Δ | ○○ | ○○ | ○X | ○Δ | ○Δ |
| | 3-6 | ○○ | ○○ | ○○ | ○○ | ○○ | ○○ |

TABLE 49

| | | Ink Samples | | | | | |
|---|---|---|---|---|---|---|---|
| | | 3-5 | | | 3-6 | | |
| | | a MD | b MD | c MD | a MD | b MD | c MD |
| Diluent Samples | 3-1 | XX | XΔ | XΔ | XX | XX | XX |
| | 3-2 | XΔ | X○ | X○ | XX | XX | XX |
| | 3-3 | ○Δ | ○○ | ○○ | ○X | ○X | ○X |
| | 3-4 | ○○ | ○○ | ○○ | ○Δ | ○○ | ○○ |
| | 3-5 | ○Δ | ○○ | ○○ | ○X | ○X | ○X |
| | 3-6 | ○○ | ○○ | ○○ | ○○ | ○○ | ○○ |

| | | Ink Samples | | | | | |
|---|---|---|---|---|---|---|---|
| | | 3-7 | | | 3-8 | | |
| | | a MD | b MD | c MD | a MD | b MD | c MD |
| Diluent Samples | 3-1 | XX | XΔ | XΔ | XX | XX | XX |
| | 3-2 | XΔ | X○ | X○ | XX | XX | XX |
| | 3-3 | XΔ | X○ | X○ | XX | XX | XX |
| | 3-4 | X○ | X○ | X○ | XX | ○X | ○X |
| | 3-5 | ○Δ | ○○ | ○○ | ○X | ○X | ○X |
| | 3-6 | ○○ | ○○ | ○○ | ○Δ | ○○ | ○○ |

TABLE 50

| | | Ink Samples | | | | | |
|---|---|---|---|---|---|---|---|
| | | 3-9 | | | 3-10 | | |
| | | a MD | b MD | c MD | a MD | b MD | c MD |
| Diluent Samples | 3-7 | ○Δ | ○○ | ○○ | ○X | ○X | ○X |
| | 3-8 | ○○ | ○○ | ○○ | ○Δ | ○○ | ○○ |
| | 3-9 | ○Δ | ○○ | ○○ | ○X | ○X | ○X |
| | 3-10 | ○○ | ○○ | ○○ | ○X | ○X | ○X |
| | 3-11 | ○X | ○Δ | ○○ | ○X | ○X | ○X |
| | 3-12 | ○○ | ○○ | ○○ | ○X | ○X | ○X |

| | | Ink Samples | | | | | |
|---|---|---|---|---|---|---|---|
| | | 3-11 | | | 3-12 | | |
| | | a MD | b MD | c MD | a MD | b MD | c MD |
| Diluent Samples | 3-7 | ○Δ | ○○ | ○○ | ○X | ○X | ○X |
| | 3-8 | ○○ | ○○ | ○○ | ○○ | ○○ | ○○ |
| | 3-9 | ○Δ | ○○ | ○○ | ○X | ○X | ○X |
| | 3-10 | ○○ | ○○ | ○○ | ○Δ | ○○ | ○○ |
| | 3-11 | ○X | ○Δ | ○○ | ○X | ○X | ○X |
| | 3-12 | ○○ | ○○ | ○○ | ○X | ○X | ○X |

TABLE 51

| | | Ink Samples | | | | | |
|---|---|---|---|---|---|---|---|
| | | 3-13 | | | 3-14 | | |
| | | a MD | b MD | c MD | a MD | b MD | c MD |
| Diluent Samples | 3-7 | X○ | X○ | X○ | XΔ | X○ | X○ |
| | 3-8 | X○ | X○ | X○ | X○ | X○ | X○ |
| | 3-8 | X○ | X○ | X○ | XΔ | X○ | X○ |
| | 3-10 | X○ | X○ | X○ | X○ | X○ | X○ |
| | 3-11 | ○Δ | ○○ | ○○ | ○X | ○Δ | ○○ |
| | 3-12 | ○○ | ○○ | ○○ | ○Δ | ○○ | ○○ |

As can be understood from results shown in Tables 48 to 51, each combination of the diluent sample and ink sample satisfying the relationship as $q-p \geqq 0$ and $\beta-\alpha \geqq 0$ under the assumption that the surface tension of the diluent sample, which was the discharge medium, was q (dyn/cm) and the viscosity of the same was β (cp) and the surface tension of the ink sample, which was the quantitative medium, was p (dyn/cm) and the viscosity of same was α (cp) resulted in satisfactory mixing characteristic of the two types of the solutions and discharge stability being obtained.

However, since the period of time taken from the quantitative mixture of the quantitative medium and the discharge medium to the application to the recording medium was made to be shorter than that in the foregoing experiments, the mixing characteristics of the two types of the solutions deteriorated. Therefore, a fact was confirmed that the period of time taken from the quantitative mixture to the application to a recording medium affects the mixing characteristics of the two types of the solutions.

If the combination of the diluent sample and the ink sample was not changed, a satisfactory result was obtained when the ratio of the ink sample, which was the quantitative medium, was lower than that of the diluent sample which was the discharge medium.

Example 3-5

Quantitative discharge of a mixture solution of two types of the solutions was performed similarly to Example 3-4 except for the above-mentioned combinations of the ink samples and diluent samples being changed so that the mixing characteristics of the two types of the solutions were evaluated. Results were shown in Tables 52 to 55. Also Tables 52 to 55 showed the mixture ratio (the concentration of ink) of ink and the diluent similarly to Tables 39 and 40.

TABLE 52

| | Ink Samples | | | | | |
|---|---|---|---|---|---|---|
| | 3-1 | | | 3-2 | | |
| Diluent Samples | a MD | b MD | c MD | a MD | b MD | c MD |
| 3-7 | ○○ | ○○ | ○○ | ○○ | ○○ | ○○ |
| 3-8 | ○○ | ○○ | ○○ | ○○ | ○○ | ○○ |
| 3-9 | ○○ | ○○ | ○○ | ○○ | ○○ | ○○ |
| 3-10 | ○○ | ○○ | ○○ | ○○ | ○○ | ○○ |
| 3-11 | ○○ | ○○ | ○○ | ○○ | ○○ | ○○ |
| 3-12 | ○○ | ○○ | ○○ | ○○ | ○○ | ○○ |
| 3-13 | ○○ | ○○ | ○○ | ○○ | ○○ | ○○ |
| 3-14 | ○○ | ○○ | ○○ | ○○ | ○○ | ○○ |
| 3-15 | ○○ | ○○ | ○○ | ○○ | ○○ | ○○ |
| 3-16 | ○Δ | ○○ | ○○ | ○X | ○Δ | ○○ |

| | Ink Samples | | | | | |
|---|---|---|---|---|---|---|
| | 3-3 | | | 3-4 | | |
| Diluent Samples | a MD | b MD | c MD | a MD | b MD | c MD |
| 3-7 | ○○ | ○○ | ○○ | ○Δ | ○○ | ○○ |
| 3-8 | ○○ | ○○ | ○○ | ○○ | ○○ | ○○ |
| 3-9 | ○○ | ○○ | ○○ | ○Δ | ○○ | ○○ |
| 3-10 | ○○ | ○○ | ○○ | ○○ | ○○ | ○○ |
| 3-11 | ○○ | ○○ | ○○ | ○X | ○Δ | ○○ |
| 3-12 | ○○ | ○○ | ○○ | ○Δ | ○○ | ○○ |
| 3-13 | ○○ | ○○ | ○○ | ○○ | ○○ | ○○ |
| 3-14 | ○○ | ○○ | ○○ | ○○ | ○○ | ○○ |

TABLE 52-continued

| | | | | | | |
|---|---|---|---|---|---|---|
| 3-15 | ○○ | ○○ | ○○ | ○○ | ○○ | ○○ |
| 3-16 | ○○ | ○○ | ○○ | ○X | ○X | ○X |

TABLE 53

| | Ink Samples | | | | | |
|---|---|---|---|---|---|---|
| | 3-5 | | | 3-6 | | |
| Diluent Samples | a MD | b MD | c MD | a MD | b MD | c MD |
| 3-7 | X○ | X○ | X○ | XX | XX | XX |
| 3-8 | X○ | X○ | X○ | X○ | X○ | X○ |
| 3-9 | X○ | X○ | X○ | XX | XX | XX |
| 3-10 | X○ | X○ | X○ | XX | XX | XX |
| 3-11 | ○○ | ○○ | ○○ | ○X | ○X | ○X |
| 3-12 | ○○ | ○○ | ○○ | ○X | ○X | ○X |
| 3-13 | ○○ | ○○ | ○○ | ○○ | ○○ | ○○ |
| 3-14 | ○○ | ○○ | ○○ | ○○ | ○○ | ○○ |
| 3-15 | ○○ | ○○ | ○○ | ○○ | ○○ | ○○ |
| 3-16 | ○X | ○Δ | ○○ | ○X | ○X | ○X |

| | Ink Samples | | | | | |
|---|---|---|---|---|---|---|
| | 3-7 | | | 3-8 | | |
| Diluent Samples | a MD | b MD | c MD | a MD | b MD | c MD |
| 3-7 | X○ | X○ | X○ | XX | XX | XX |
| 3-8 | X○ | X○ | X○ | XΔ | X○ | X○ |
| 3-9 | X○ | X○ | X○ | XX | XX | XX |
| 3-10 | X○ | X○ | X○ | XX | XX | XX |
| 3-11 | X○ | X○ | X○ | XX | XX | XX |
| 3-12 | X○ | X○ | X○ | XX | XX | XX |
| 3-13 | X○ | X○ | X○ | XΔ | X○ | X○ |
| 3-14 | ○○ | ○○ | ○○ | ○Δ | ○○ | ○○ |
| 3-15 | ○○ | ○○ | ○○ | ○Δ | ○○ | ○○ |
| 3-16 | ○X | ○Δ | ○○ | ○○ | ○○ | ○○ |

TABLE 54

| | Ink Samples | | | | | |
|---|---|---|---|---|---|---|
| | 3-9 | | | 3-10 | | |
| Diluent Samples | a MD | b MD | c MD | a MD | b MD | c MD |
| 3-1 | ○X | ○X | ○X | ○X | ○X | ○X |
| 3-2 | ○X | ○X | ○X | ○X | ○X | ○X |
| 3-3 | ○X | ○X | ○X | ○X | ○X | ○X |
| 3-4 | ○○ | ○○ | ○○ | ○X | ○X | ○X |
| 3-5 | ○X | ○X | ○X | ○X | ○X | ○X |
| 3-6 | ○○ | ○○ | ○○ | ○Δ | ○○ | ○○ |
| 3-13 | ○○ | ○○ | ○○ | ○Δ | ○○ | ○○ |
| 3-14 | ○○ | ○○ | ○○ | ○Δ | ○○ | ○○ |
| 3-15 | ○○ | ○○ | ○○ | ○Δ | ○○ | ○○ |
| 3-16 | ○X | ○X | ○X | ○X | ○X | ○X |

| | Ink Samples | | | | | |
|---|---|---|---|---|---|---|
| | 3-11 | | | 3-12 | | |
| Diluent Samples | a MD | b MD | c MD | a MD | b MD | c MD |
| 3-1 | ○X | ○X | ○X | ○X | ○X | ○X |
| 3-2 | ○X | ○X | ○X | ○X | ○X | ○X |
| 3-3 | ○X | ○X | ○X | ○X | ○X | ○X |
| 3-4 | ○○ | ○○ | ○○ | ○○ | ○○ | ○○ |
| 3-5 | ○X | ○X | ○X | ○X | ○X | ○X |
| 3-6 | ○○ | ○○ | ○○ | ○○ | ○○ | ○○ |

TABLE 54-continued

| | | | | | | |
|---|---|---|---|---|---|---|
| 3-13 | ○○ | ○○ | ○○ | ○Δ | ○○ | ○○ |
| 3-14 | ○○ | ○○ | ○○ | ○Δ | ○○ | ○○ |
| 3-15 | ○○ | ○○ | ○○ | ○Δ | ○○ | ○○ |
| 3-16 | ○X | ○X | ○X | ○X | ○X | ○X |

TABLE 55

| | Ink Samples | | | | | |
|---|---|---|---|---|---|---|
| | 3-13 | | | 3-14 | | |
| Diluent Samples | a MD | b MD | c MD | a MD | b MD | c MD |
| 3-1 | XX | XX | XX | XX | XX | XX |
| 3-2 | XX | XX | XX | XX | XΔ | XΔ |
| 3-3 | ○X | ○X | ○X | ○X | ○Δ | ○Δ |
| 3-4 | ○○ | ○○ | ○○ | ○○ | ○○ | ○○ |
| 3-5 | ○X | ○X | ○X | ○X | ○Δ | ○Δ |
| 3-6 | ○○ | ○○ | ○○ | ○○ | ○○ | ○○ |
| 3-13 | ○○ | ○○ | ○○ | ○○ | ○○ | ○○ |
| 3-14 | ○○ | ○○ | ○○ | ○○ | ○○ | ○○ |
| 3-15 | ○○ | ○○ | ○○ | ○○ | ○○ | ○○ |
| 3-16 | ○X | ○X | ○X | ○X | ○X | ○X |

As can be understood from results shown in Tables 52 to 55, each combination of the diluent sample and ink sample satisfying the relationship as $q-p \geqq 0$ and $\beta-\alpha \geqq 0$ under the assumption that the surface tension of the diluent sample, which was the discharge medium, was q (dyn/cm) and the viscosity of the same was β (cp) and the surface tension of the ink sample, which was the quantitative medium, was p (dyn/cm) and the viscosity of same was α (cp) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed and the discharge stability was improved.

If the combination of the diluent sample and the ink sample was not changed, a satisfactory result was obtained when the ratio of the ink sample, which was the quantitative medium, was lower than that of the diluent sample which was the discharge medium.

Example 3-6

Quantitative discharge of a mixture solution of two types of the solutions was performed similarly to Example 3-5 except for the period of time taken from quantitative mixture to the application to the recording medium, which was about 500 (msec) in Example 3-5, was changed to about 100 (μSec) so that the mixing characteristics of the two types of the solutions and the discharge stability were evaluated. Results were shown in Tables 56 to 59. Also Tables 56 to 59 showed the mixture ratio (the concentration of ink) of ink and the diluent similarly to Tables 39 and 40.

TABLE 56

| | Ink Samples | | | | | |
|---|---|---|---|---|---|---|
| | 3-1 | | | 3-2 | | |
| Diluent Samples | a MD | b MD | c MD | a MD | b MD | c MD |
| 3-7 | ○○ | ○○ | ○○ | ○○ | ○○ | ○○ |
| 3-8 | ○○ | ○○ | ○○ | ○○ | ○○ | ○○ |
| 3-9 | ○○ | ○○ | ○○ | ○○ | ○○ | ○○ |
| 3-10 | ○○ | ○○ | ○○ | ○○ | ○○ | ○○ |
| 3-11 | ○○ | ○○ | ○○ | ○○ | ○○ | ○○ |
| 3-12 | ○○ | ○○ | ○○ | ○○ | ○○ | ○○ |
| 3-13 | ○○ | ○○ | ○○ | ○○ | ○○ | ○○ |
| 3-14 | ○○ | ○○ | ○○ | ○○ | ○○ | ○○ |
| 3-15 | ○○ | ○○ | ○○ | ○○ | ○○ | ○○ |
| 3-16 | ○Δ | ○○ | ○○ | ○X | ○Δ | ○○ |

| | Ink Samples | | | | | |
|---|---|---|---|---|---|---|
| | 3-3 | | | 3-4 | | |
| Diluent Samples | a MD | b MD | c MD | a MD | b MD | c MD |
| 3-7 | ○○ | ○○ | Δ○ | ○Δ | ○○ | Δ○ |
| 3-8 | ○○ | ○○ | Δ○ | ○○ | ○○ | Δ○ |
| 3-9 | ○○ | ○○ | ○○ | ○Δ | ○○ | ○○ |
| 3-10 | ○○ | ○○ | ○○ | ○○ | ○○ | ○○ |
| 3-11 | ○○ | ○○ | ○○ | ○X | ○Δ | ○○ |
| 3-12 | ○○ | ○○ | ○○ | ○Δ | ○○ | ○○ |
| 3-13 | ○○ | ○○ | ○○ | ○○ | ○○ | ○○ |
| 3-14 | ○○ | ○○ | ○○ | ○○ | ○○ | ○○ |
| 3-15 | ○○ | ○○ | ○○ | ○○ | ○○ | ○○ |
| 3-16 | ○○ | ○○ | ○○ | ○X | ○X | ○X |

TABLE 57

| | Ink Samples | | | | | |
|---|---|---|---|---|---|---|
| | 3-5 | | | 3-6 | | |
| Diluent Samples | a MD | b MD | c MD | a MD | b MD | c MD |
| 3-7 | X○ | X○ | X○ | XX | XX | XX |
| 3-8 | X○ | X○ | X○ | X○ | X○ | X○ |
| 3-9 | X○ | X○ | X○ | XX | XX | XX |
| 3-10 | X○ | X○ | X○ | XX | XX | XX |
| 3-11 | ○○ | ○○ | Δ○ | ○X | ○X | ΔX |
| 3-12 | ○○ | ○○ | Δ○ | ○X | ○X | ΔX |
| 3-13 | ○○ | ○○ | Δ○ | ○○ | ○○ | Δ○ |
| 3-14 | ○○ | ○○ | ○○ | ○○ | ○○ | ○○ |
| 3-15 | ○○ | ○○ | ○○ | ○○ | ○○ | ○○ |
| 3-16 | ○X | ○Δ | ○○ | ○X | ○X | ○X |

| | Ink Samples | | | | | |
|---|---|---|---|---|---|---|
| | 3-7 | | | 3-8 | | |
| Diluent Samples | a MD | b MD | c MD | a MD | b MD | c MD |
| 3-7 | X○ | X○ | X○ | XX | XX | XX |
| 3-8 | X○ | X○ | X○ | XΔ | X○ | X○ |
| 3-9 | X○ | X○ | X○ | XX | XX | XX |
| 3-10 | X○ | X○ | X○ | XX | XX | XX |
| 3-11 | X○ | X○ | X○ | XX | XX | XX |
| 3-12 | X○ | X○ | X○ | XX | XX | XX |
| 3-13 | X○ | X○ | X○ | XΔ | X○ | XX |
| 3-14 | ○○ | ○○ | ○○ | ○Δ | ○○ | ○○ |
| 3-15 | ○○ | ○○ | ○○ | ○Δ | ○○ | ○○ |
| 3-16 | ○X | ○Δ | ○○ | ○○ | ○○ | ○○ |

TABLE 58

| | Ink Samples | | | | | |
|---|---|---|---|---|---|---|
| | 3-9 | | | 3-10 | | |
| Diluent Samples | a MD | b MD | c MD | a MD | b MD | c MD |
| 3-1 | ○X | ○X | ○X | ○X | ○X | ○X |
| 3-2 | ○X | ○X | ○X | ○X | ○X | ○X |
| 3-3 | ○X | ○X | ○X | ○X | ○X | ○X |
| 3-4 | ○○ | ○○ | ○○ | ○X | ○X | ○X |
| 3-5 | ○X | ○X | ○X | ○X | ○X | ○X |
| 3-6 | ○○ | ○○ | ○○ | ○Δ | ○○ | ○○ |
| 3-13 | ○○ | ○○ | ○○ | ○Δ | ○○ | ○○ |
| 3-14 | ○○ | ○○ | ○○ | ○Δ | ○○ | ○○ |
| 3-15 | ○○ | ○○ | ○○ | ○Δ | ○○ | ○○ |
| 3-16 | ○X | ○X | ○X | ○X | ○X | ○X |

| | Ink Samples | | | | | |
|---|---|---|---|---|---|---|
| | 3-11 | | | 3-12 | | |
| Diluent Samples | a MD | b MD | c MD | a MD | b MD | c MD |
| 3-1 | ○X | ○X | ΔX | ○X | ○X | ΔX |
| 3-2 | ○X | ○X | ΔX | ○X | ○X | ΔX |
| 3-3 | ○X | ○X | ○X | ○X | ○X | ○X |
| 3-4 | ○○ | ○○ | ○○ | ○○ | ○○ | ○○ |
| 3-5 | ○X | ○X | ○X | ○X | ○X | ○X |
| 3-6 | ○○ | ○○ | ○○ | ○○ | ○○ | ○○ |
| 3-13 | ○○ | ○○ | ○○ | ○Δ | ○○ | ○○ |
| 3-14 | ○○ | ○○ | ○○ | ○Δ | ○○ | ○○ |
| 3-15 | ○○ | ○○ | ○○ | ○Δ | ○○ | ○○ |
| 3-16 | ○X | ○X | ○X | ○X | ○X | ○X |

TABLE 59

| | Ink Samples | | | | | |
|---|---|---|---|---|---|---|
| | 3-13 | | | 3-14 | | |
| Diluent Samples | a MD | b MD | c MD | a MD | b MD | c MD |
| 3-1 | XX | XX | XX | XX | XX | XX |
| 3-2 | XX | XX | XX | XX | XΔ | XΔ |
| 3-3 | ○X | ○X | ΔX | ○X | ○Δ | ΔΔ |
| 3-4 | ○○ | ○○ | Δ○ | ○○ | ○○ | ○○ |
| 3-5 | ○X | ○X | ○X | ○X | ○Δ | ○Δ |
| 3-6 | ○○ | ○○ | ○○ | ○○ | ○○ | ○○ |
| 3-13 | ○○ | ○○ | Δ○ | ○○ | ○○ | Δ○ |
| 3-14 | ○○ | ○○ | ○○ | ○○ | ○○ | ○○ |
| 3-15 | ○○ | ○○ | ○○ | ○○ | ○○ | ○○ |
| 3-16 | ○X | ○X | ○X | ○X | ○X | ○X |

As can be understood from results shown in Tables 56 to 59, each combination of the diluent sample and ink sample satisfying the relationship as $q-p \geqq 0$ and $\beta-\alpha \geqq 0$ under the assumption that the surface tension of the diluent sample, which was the discharge medium, was q (dyn/cm) and the viscosity of the same was β (cp) and the surface tension of the ink sample, which was the quantitative medium, was p (dyn/cm) and the viscosity of same was α (cp) resulted in satisfactory mixing characteristic of the two types of the solutions and discharge stability being obtained.

However, since the period of time taken from the quantitative mixture of the quantitative medium and the discharge medium to the application to the recording medium was made to be shorter than that in the foregoing examples, the mixing characteristics of the two types of the solutions deteriorated. Therefore, a fact was confirmed that the period of time taken from the quantitative mixture to the application to a recording medium affects the mixing characteristics of the two types of the solutions.

If the combination of the diluent sample and the ink sample was not changed, a satisfactory result was obtained when the ratio of the ink sample, which was the quantitative medium, was lower than that of the diluent sample which was the discharge medium.

As can be understood from the results of Example 3, the recording method according to the present invention enabled accurate expression of a gradation image to be performed because the quantitative medium, which was ink, was mixed with the discharge medium, which was the diluent, at a predetermined mixture ratio immediately before discharge to prepare diluted ink; and the diluent sample and ink sample satisfying the relationship as $q-p \geqq 0$ and $\beta-\alpha \geqq 0$ under the assumption that the surface tension of the diluent sample, which was the discharge medium, was q (dyn/cm) and the viscosity of the same was β (cp) and the surface tension of the ink sample, which was the quantitative medium, was p (dyn/cm) and the viscosity of same was α (cp) were used so that the surface tensions of the quantitative medium and the discharge medium and their relationship were made to be adequate for the mixing operation and the discharging operation and discharge stability of the mediums are maintained regardless of the material. As a result, accurate expression of a gradient image was performed.

Example 4

In this example, ink was used as the discharge medium and the diluent was used as the quantitative medium. Diluent samples and ink samples having different surface tensions were prepared, and the samples were used as the discharge medium and the quantitative medium for the above-mentioned printer so that the mixing characteristic of the two types of solutions and the discharge stability were evaluated.

Example 4-1

Initially, water, isopropyl alcohol and glycerin were used as solvents, and then the solvents were arbitrarily added so that ink samples 4-1 to 4-6 having surface tensions and viscosity values (values respectively measured at 20° C.) as shown in Table 60 were prepared. C.I. Direct Yellow 50 was used as the dye in ink sample 4-1, C.I. Direct Yellow 87 was used as the dye in ink sample 4-2, C.I. Direct Red 83 was used as the dye in the ink sample 4-3, C.I. Direct Red 227 was used as the dye in ink sample 4-4, C.I. Direct Blue 6 was used as the dye in ink sample 4-5 and C.I. Direct Blue 86 was used as the dye in ink sample 4-6. Moreover, the concentration of the dye was 3 wt %.

The surface tension was measured by a surface tension meter CBVP-Z (model name) manufactured by Kyowa Surface Chemistry, and the viscosity was measured by a viscosity meter DV-II+ (model name) manufactured by BROOK FIELD.

TABLE 60

| | | Surface Tension (dyn/cm) | Viscosity (cp) | Name of Dye |
|---|---|---|---|---|
| Ink Samples | 4-1 | 30 | 1.5 | C.I. Direct Yellow 50 |
| | 4-2 | 30 | 3.0 | C.I. Direct Yellow 87 |

TABLE 60-continued

| | | Surface Tension (dyn/cm) | Viscosity (cp) | Name of Dye |
|---|---|---|---|---|
| | 4-3 | 40 | 3.0 | C.I. Direct Red 83 |
| | 4-4 | 40 | 10.0 | C.I. Direct Red 227 |
| | 4-5 | 50 | 3.0 | C.I. Direct Blue 6 |
| | 4-6 | 50 | 15.0 | C.I. Direct Blue 86 |

Then, water, isopropyl alcohol and glycerin were used as solvents, and then the solvents were arbitrarily added so that diluent samples 4-1 to 4-8 having surface tensions and viscosity values (values respectively measured at 20° C.) as shown in Table 61 were prepared.

TABLE 61

| | | Surface Tension (dyn/cm) | Viscosity (cp) |
|---|---|---|---|
| Diluent Samples | 4-1 | 25 | 1.5 |
| | 4-2 | 25 | 3.0 |
| | 4-3 | 30 | 3.0 |
| | 4-4 | 30 | 5.0 |
| | 4-5 | 40 | 3.0 |
| | 4-6 | 40 | 10.0 |
| | 4-7 | 45 | 3.0 |
| | 4-8 | 45 | 15.0 |

Then, quantitative mixing and discharge of two types of the solutions was performed similarly to Example 1-1 by using ink samples 4-1 to 4-6 and diluent samples 4-1 to 4-8 so that the mixing characteristics of the two types of the solutions and the discharge stability were evaluated. The mixing characteristics of the two types of the solutions was evaluated similarly to Example 1-1 and the discharge stability was evaluated similarly to Example 3-1.

Results were shown in Tables 62 and 63 with combination of ink samples and diluent samples and the concentration of ink. Symbol a in Tables 62 and 63 indicated a case where diluent:ink was 50:50, b in Tables 62 and 63 indicated a case where diluent:ink was 10:90 and c in Tables 62 and 63 indicated a case where diluent:ink was 1:99. In Tables 39 and 40, results of the mixing characteristics of the two types of the solutions were hereinafter indicated with symbol "M" and those of the discharge stability were hereinafter indicated with symbol "D".

TABLE 62

| | | Diluent Samples | | | | | |
|---|---|---|---|---|---|---|---|
| | | 4-1 | | | 4-2 | | |
| | | a MD | b MD | c MD | a MD | b MD | c MD |
| Ink Samples | 4-1 | ○Δ | ○○ | ○○ | ○X | ○Δ | ○Δ |
| | 4-2 | ○○ | ○○ | ○○ | ○Δ | ○○ | ○○ |
| | 4-3 | ○○ | ○○ | ○○ | ○Δ | ○○ | ○○ |
| | 4-4 | ○○ | ○○ | ○○ | ○○ | ○○ | ○○ |
| | 4-5 | ○○ | ○○ | ○○ | ○Δ | ○○ | ○○ |
| | 4-6 | ○○ | ○○ | ○○ | ○○ | ○○ | ○○ |

TABLE 62-continued

| | | Diluent Samples | | | | | |
|---|---|---|---|---|---|---|---|
| | | 4-3 | | | 4-4 | | |
| | | a MD | b MD | c MD | a MD | b MD | c MD |
| Ink Samples | 4-1 | ○X | ○Δ | ○Δ | ○X | ○X | ○X |
| | 4-2 | ○Δ | ○○ | ○○ | ○X | ○Δ | ○Δ |
| | 4-3 | ○Δ | ○○ | ○○ | ○X | ○Δ | ○Δ |
| | 4-4 | ○○ | ○○ | ○○ | ○○ | ○○ | ○○ |
| | 4-5 | ○Δ | ○○ | ○○ | ○X | ○Δ | ○Δ |
| | 4-6 | ○○ | ○○ | ○○ | ○○ | ○○ | ○○ |

TABLE 63

| | | Diluent Samples | | | | | |
|---|---|---|---|---|---|---|---|
| | | 4-5 | | | 4-6 | | |
| | | a MD | b MD | c MD | a MD | b MD | c MD |
| Ink Samples | 4-1 | ΔX | XΔ | XΔ | ΔX | XX | XX |
| | 4-2 | ΔΔ | X○ | X○ | ΔX | XX | XX |
| | 4-3 | ○Δ | ○○ | ○○ | ○X | ○X | ○X |
| | 4-4 | ○○ | ○○ | ○○ | ○Δ | ○○ | ○○ |
| | 4-5 | ○○ | ○○ | ○○ | ○X | ○X | ○X |
| | 4-6 | ○○ | ○○ | ○○ | ○○ | ○○ | ○○ |
| | | Diluent Samples | | | | | |
| | | 4-7 | | | 4-8 | | |
| | | a MD | b MD | c MD | a MD | b MD | c MD |
| Ink Samples | 4-1 | XX | XΔ | XΔ | XX | XX | XX |
| | 4-2 | XΔ | X○ | X○ | XX | XX | XX |
| | 4-3 | ΔΔ | X○ | X○ | ΔX | XX | XX |
| | 4-4 | Δ○ | X○ | X○ | ΔX | XX | XX |
| | 4-5 | ○Δ | ○○ | ○○ | ○X | ○X | ○X |
| | 4-6 | ○○ | ○○ | ○○ | ○Δ | ○○ | ○○ |

As can be understood from results shown in Tables 62 and 63, each combination of the diluent sample and ink sample satisfying the relationship as $q-p \geqq 0$ and $\beta-\alpha \geqq 0$ under the assumption that the surface tension of the ink sample, which was the discharge medium, was q (dyn/cm) and the viscosity of the same was β (cp) and the surface tension of the diluent sample, which was the quantitative medium, was p (dyn/cm) and the viscosity of same was α (cp) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed and discharge stability was improved.

If the combination of the diluent sample and the ink sample was not changed, a satisfactory result was obtained when the ratio of the diluent sample, which was the quantitative medium, was lower than that of the ink sample which was the discharge medium.

Example 4-2

As the solvents, water, ethylene glycol monomethylether and diethylene glycol were used and then the solvents were arbitrarily added. Then, non-ionic surface active agent ("Emergen 985" trade name of Kao) was added as the surface active agent so that ink samples 4-7 to 4-12 having surface tensions and viscosity values (values respectively measured at 20° C.) as shown in Table 64 were prepared. C.I. Acid Yellow 23 was used as the dye in ink sample 4-7, C.I. Acid Yellow 42 was used as the dye in ink sample 4-8, C.I. Acid Red 27 was used as the dye in ink sample 4-9, C.I. Acid Red 52 was used as the dye in ink sample 4-10, C.I. Acid Blue 9 was used as the dye in ink sample 4-11 and C.I. Acid Blue 15 was used as the dye in ink sample 4-12. Moreover, the concentration of the dye was 3 wt %.

TABLE 64

| | | Surface Tension (dyn/cm) | Viscosity (cp) | Name of Dye |
|---|---|---|---|---|
| Ink Samples | 4-7 | 30 | 5.0 | C.I. Acid Yellow 23 |
| | 4-8 | 30 | 15.0 | C.I. Acid Yellow 42 |
| | 4-9 | 35 | 5.0 | C.I. Acid Red 27 |
| | 4-10 | 35 | 8.0 | C.I. Acid Red 52 |
| | 4-11 | 40 | 4.0 | C.I. Acid Blue 9 |
| | 4-12 | 40 | 5.0 | C.I. Acid Blue 15 |

On the other hand, as the solvents, water, ethylene glycol monomethylether and diethylene glycol were used and then the solvents were arbitrarily added. Then, non-ionic surface active agent ("Emergen 985" trade name of Kao) was added as the surface active agent so that diluent samples 4-9 to 4-14 having surface tensions and viscosity values (values respectively measured at 20° C.) as shown in Table 65 were prepared.

TABLE 65

| | | Surface Tension (dyn/cm) | Viscosity (cp) |
|---|---|---|---|
| Diluent Samples | 4-9 | 25 | 5.0 |
| | 4-10 | 25 | 15.0 |
| | 4-11 | 30 | 5.0 |
| | 4-12 | 30 | 8.0 |
| | 4-13 | 40 | 4.0 |
| | 4-14 | 40 | 5.0 |

Diluent samples 4-9 to 4-14 and ink samples 4-7 to 4-12 were used to perform quantitative discharge of a mixture solution of two types of the solutions similarly to Example 4-1 so that the mixing characteristics of the two types of the solutions and the discharge stability were evaluated similarly to the foregoing example. Results were shown in Tables 66 and 67. Also Tables 66 and 67 showed the mixture ratio (the concentration of ink) of ink and the diluent similarly to Tables 62 and 63.

TABLE 66

| | | Diluent Samples | | | | | |
|---|---|---|---|---|---|---|---|
| | | 4-9 | | | 4-10 | | |
| | | a MD | b MD | c MD | a MD | b MD | c MD |
| Ink Samples | 4-7 | ○Δ | ○○ | ○○ | ○X | ○X | ○X |
| | 4-8 | ○○ | ○○ | ○○ | ○Δ | ○○ | ○○ |
| | 4-9 | ○Δ | ○○ | ○○ | ○X | ○X | ○X |
| | 4-10 | ○○ | ○○ | ○○ | ○X | ○X | ○X |
| | 4-11 | ○X | ○Δ | ○○ | ○X | ○X | ○X |
| | 4-12 | ○○ | ○○ | ○○ | ○X | ○X | ○X |

| | | Diluent Samples | | | | | |
|---|---|---|---|---|---|---|---|
| | | 4-11 | | | 4-12 | | |
| | | a MD | b MD | c MD | a MD | b MD | c MD |
| Ink Samples | 4-7 | ○Δ | ○○ | ○○ | ○X | ○X | ○X |
| | 4-8 | ○○ | ○○ | ○○ | ○○ | ○○ | ○○ |
| | 4-9 | ○Δ | ○○ | ○○ | ○X | ○X | ○X |
| | 4-10 | ○○ | ○○ | ○○ | ○Δ | ○○ | ○○ |
| | 4-11 | ○X | ○Δ | ○○ | ○X | ○X | ○X |
| | 4-12 | ○Δ | ○○ | ○○ | ○X | ○X | ○X |

TABLE 67

| | | Diluent Samples | | | | | |
|---|---|---|---|---|---|---|---|
| | | 4-13 | | | 4-14 | | |
| | | a MD | b MD | c MD | a MD | b MD | c MD |
| Ink Samples | 4-7 | Δ○ | X○ | X○ | ΔΔ | X○ | XΔ |
| | 4-8 | Δ○ | X○ | X○ | Δ○ | X○ | X○ |
| | 4-9 | Δ○ | X○ | X○ | ΔΔ | X○ | X○ |
| | 4-10 | Δ○ | X○ | X○ | Δ○ | X○ | X○ |
| | 4-11 | ○Δ | ○○ | ○○ | ○X | ○Δ | ○○ |
| | 4-12 | ○○ | ○○ | ○○ | ○Δ | ○○ | ○○ |

As can be understood from results shown in Tables 66 and 67, each combination of the diluent sample and ink sample satisfying the relationship as $q-p \geqq 0$ and $\beta-\alpha \geqq 0$ under the assumption that the surface tension of the ink sample, which was the discharge medium, was q (dyn/cm) and the viscosity of the same was β (cp) and the surface tension of the diluent sample, which was the quantitative medium, was p (dyn/cm) and the viscosity of same was α (cp) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed and the discharge stability was improved.

If the combination of the diluent sample and the ink sample was not changed, a satisfactory result was obtained when the ratio of the diluent sample, which was the quantitative medium, was lower than that of the ink sample which was the discharge medium.

Example 4-3

As the solvents, water, 2-(2-butoxyethoxy) ethanol, triethanol amine and glycerin were used and then the solvents were arbitrarily added. Then, non-ionic surface active agent ("Emergen 985" trade name of Kao) was added as the surface active agent so that ink samples 4-13 to 4-15 having surface tensions and viscosity values (values respectively measured at 20° C.) as shown in Table 68 were prepared. C.I. Acid Black 24 was used as the dye in ink sample 4-13, C.I. Acid Black 72 was used as the dye in ink sample 4-14 and C.I. Acid Black 94 was used as the dye in ink sample 4-15. The concentration of the dye was 3 wt %.

TABLE 68

| | | Surface Tension (dyn/cm) | Viscosity (cp) | Name of Dye |
|---|---|---|---|---|
| Ink Samples | 4-13 | 40 | 15.0 | C.I. Acid Black 24 |
| | 4-14 | 50 | 15.0 | C.I. Acid Black 72 |
| | 4-15 | 60 | 15.0 | C.I. Acid Black 94 |

As the solvents, water, 2-(2-butoxyethoxy) ethanol, triethanol amine and glycerin were used and then the solvents were arbitrarily added. Then, non-ionic surface active agent ("Emergen 985" trade name of Kao) was added as the surface active agent so that ink samples 4-15 to 4-17 having surface tensions and viscosity values (values respectively measured at 20° C.) as shown in Table 69 were prepared.

TABLE 69

| | | Surface Tension (dyn/cm) | Viscosity (cp) |
|---|---|---|---|
| Diluent Samples | 4-15 | 40 | 15.0 |
| | 4-16 | 50 | 15.0 |
| | 4-17 | 60 | 15.0 |

Quantitative discharge of a mixture solution of two types of the solutions was performed similarly to Example 4-1 by using diluent samples 4-15 to 4-17 and ink samples 4-13 to 4-15 so that the mixing characterist of the two types of the solutions and the discharge stability were evaluated. Results were shown in Table 70. Also Table 70 showed the mixture ratio (the concentration of ink) of ink and the diluent similarly to Tables 62 and 63.

TABLE 70

| | | Diluent Samples | | | | | |
|---|---|---|---|---|---|---|---|
| | | 4-15 | | | 4-16 | | |
| | | a MD | b MD | c MD | a MD | b MD | c MD |
| Ink Samples | 4-13 | ○Δ | ○○ | ○○ | ΔΔ | X○ | X○ |
| | 4-14 | ○Δ | ○○ | ○○ | ○Δ | ○○ | ○○ |
| | 4-15 | ○Δ | ○○ | ○○ | ○Δ | ○○ | ○○ |

| | | Diluent Samples 4-17 | | |
|---|---|---|---|---|
| | | a MD | b MD | c MD |
| Ink Samples | 4-13 | X○ | X○ | X○ |
| | 4-14 | ΔΔ | X○ | X○ |
| | 4-15 | ○Δ | ○○ | ○○ |

As can be understood from results shown in Table 70, each combination of the diluent sample and ink sample satisfying the relationship as $q-p \geqq 0$ and $\beta-\alpha \geqq 0$ under the assumption that the surface tension of the ink sample, which was the discharge medium, was q (dyn/cm) and the viscosity of the same was β (cp) and the surface tension of the diluent sample, which was the quantitative medium, was p (dyn/cm) and the viscosity of same was α (cp) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed and the discharge stability was improved.

If the combination of the diluent sample and the ink sample was not changed, a satisfactory result was obtained when the ratio of the diluent sample, which was the quantitative medium, was lower than that of the ink sample which was the discharge medium.

Example 4-4

Quantitative discharge of a mixture solution of two types of the solutions was performed similarly to Example 4-1 except for the period of time taken from quantitative mixture to the application to the recording medium, which was about 1 (msec) in Examples 4-1 to 4-2 was changed to about 500 (μsec) so that the mixing characteristics of the two types of the solutions and the discharge stability were evaluated. Results were shown in Tables 71 to 74. Also Tables 71 to 74 showed the mixture ratio (the concentration of ink) of ink and the diluent similarly to Tables 62 and 63.

TABLE 71

| | | Diluent Samples | | | | | |
|---|---|---|---|---|---|---|---|
| | | 4-1 | | | 4-2 | | |
| | | a MD | b MD | c MD | a MD | b MD | c MD |
| Ink Samples | 4-1 | ○Δ | ○○ | ○○ | ○X | ○Δ | ○Δ |
| | 4-2 | ○○ | ○○ | ○○ | ○Δ | ○○ | ○○ |
| | 4-3 | ○○ | ○○ | ○○ | ○Δ | ○○ | ○○ |
| | 4-4 | ○○ | ○○ | ○○ | ○○ | ○○ | ○○ |
| | 4-5 | ○○ | ○○ | ○○ | ○Δ | ○○ | ○○ |
| | 4-6 | ○○ | ○○ | ○○ | ○○ | ○○ | ○○ |
| | | Diluent Samples | | | | | |
| | | 4-3 | | | 4-4 | | |
| | | a MD | b MD | c MD | a MD | b MD | c MD |
| Ink Samples | 4-1 | ○X | ○Δ | ○Δ | ○X | ○X | ○X |
| | 4-2 | ○Δ | ○○ | ○○ | ○X | ○Δ | ○Δ |
| | 4-3 | ○Δ | ○○ | ○○ | ○X | ○Δ | ○Δ |
| | 4-4 | ○○ | ○○ | ○○ | ○○ | ○○ | ○○ |
| | 4-5 | ○Δ | ○○ | ○○ | ○X | ○Δ | ○Δ |
| | 4-6 | ○○ | ○○ | ○○ | ○○ | ○○ | ○○ |

TABLE 72

| | | Diluent Samples | | | | | |
|---|---|---|---|---|---|---|---|
| | | 4-5 | | | 4-6 | | |
| | | a MD | b MD | c MD | a MD | b MD | c MD |
| Ink Samples | 4-1 | XX | XΔ | XΔ | XX | XX | XX |
| | 4-2 | XΔ | X○ | X○ | XX | XX | XX |

TABLE 72-continued

| | | Diluent Samples | | | | | |
|---|---|---|---|---|---|---|---|
| | 4-3 | ○Δ | ○○ | ○○ | ○X | ○X | ○X |
| | 4-4 | ○○ | ○○ | ○○ | ○Δ | ○○ | ○○ |
| | 4-5 | ○Δ | ○○ | ○○ | ○X | ○X | ○X |
| | 4-6 | ○○ | ○○ | ○○ | ○○ | ○○ | ○○ |
| | | Diluent Samples | | | | | |
| | | 4-7 | | | 4-8 | | |
| | | a MD | b MD | c MD | a MD | b MD | c MD |
| Ink Samples | 4-1 | XX | XΔ | XΔ | XX | XX | XX |
| | 4-2 | XΔ | X○ | X○ | XX | XX | XX |
| | 4-3 | XΔ | X○ | X○ | XX | XX | XX |
| | 4-4 | X○ | X○ | X○ | XX | ○X | ○X |
| | 4-5 | ○Δ | ○○ | ○○ | ○X | ○X | ○X |
| | 4-6 | ○○ | ○○ | ○○ | ○Δ | ○○ | ○○ |

TABLE 73

| | | Diluent Samples | | | | | |
|---|---|---|---|---|---|---|---|
| | | 4-9 | | | 4-10 | | |
| | | a MD | b MD | c MD | a MD | b MD | a MD |
| Ink Samples | 4-7 | ○Δ | ○○ | ○○ | ○X | ○X | ○X |
| | 4-8 | ○○ | ○○ | ○○ | ○Δ | ○○ | ○○ |
| | 4-9 | ○Δ | ○○ | ○○ | ○X | ○X | ○X |
| | 4-10 | ○○ | ○○ | ○○ | ○X | ○X | ○X |
| | 4-11 | ○X | ○Δ | ○○ | ○X | ○X | ○X |
| | 4-12 | ○Δ | ○○ | ○○ | ○X | ○X | ○X |
| | | Diluent samples | | | | | |
| | | 4-11 | | | 4-12 | | |
| | | a MD | b MD | c MD | a MD | b MD | c MD |
| Ink Samples | 4-7 | ○Δ | ○○ | ○○ | ○X | ○X | ○X |
| | 4-8 | ○○ | ○○ | ○○ | ○○ | ○○ | ○○ |
| | 4-9 | ○Δ | ○○ | ○○ | ○X | ○X | ○X |
| | 4-10 | ○○ | ○○ | ○○ | ○Δ | ○○ | ○○ |
| | 4-11 | ○X | ○Δ | ○○ | ○X | ○X | ○X |
| | 4-12 | ○Δ | ○○ | ○○ | ○X | ○X | ○X |

TABLE 74

| | | Diluent Samples | | | | | |
|---|---|---|---|---|---|---|---|
| | | 4-13 | | | 4-14 | | |
| | | a MD | b MD | c MD | a MD | b MD | c MD |
| Ink Samples | 4-7 | X○ | X○ | X○ | XΔ | X○ | XΔ |
| | 4-8 | X○ | X○ | X○ | X○ | X○ | X○ |
| | 4-9 | X○ | X○ | X○ | XΔ | X○ | X○ |
| | 4-10 | X○ | X○ | X○ | X○ | X○ | X○ |
| | 4-11 | ○Δ | ○○ | ○○ | ○X | ○Δ | ○○ |
| | 4-12 | ○○ | ○○ | ○○ | ○Δ | ○○ | ○○ |

As can be understood from results shown in Tables 71 to 74, each combination of the diluent sample and ink sample satisfying the relationship as $q-p \geqq 0$ and $\beta-\alpha \geqq 0$ under the assumption that the surface tension of the ink sample, which was the discharge medium, was q (dyn/cm) and the viscosity of the same was β (cp) and the surface tension of the diluent sample, which was the quantitative medium, was p (dyn/cm)

and the viscosity of same was α (cp) resulted in satisfactory mixing characteristic of the two types of the solutions and discharge stability being obtained.

However, since the period of time taken from the quantitative mixture of the quantitative medium and the discharge medium to the application to the recording medium was made to be shorter than that in the foregoing experiments, the mixing characteristics of the two types of the solutions deteriorated. Therefore, a fact was confirmed that the period of time taken from the quantitative mixture to the application to a recording medium affects the mixing characteristics of the two types of the solutions.

If the combination of the diluent sample and the ink sample was not changed, a satisfactory result was obtained when the ratio of the diluent sample, which was the quantitative medium, was lower than that of the ink sample which was the discharge medium.

Example 4-5

Quantitative discharge of a mixture solution of two types of the solutions was performed similarly to Example 4-4 except for the above-mentioned combinations of the ink samples and diluent samples being changed so that the mixing characteristics of the two types of the solutions were evaluated. Results were shown in Tables 75 to 78. Also Tables 75 to 78 showed the mixture ratio (the concentration of ink) of ink and the diluent similarly to Tables 62 and 63.

TABLE 75

| | | Diluent Samples | | | | | |
|---|---|---|---|---|---|---|---|
| | | 4-1 | | | 4-2 | | |
| | | a MD | b MD | c MD | a MD | b MD | c MD |
| Ink Samples | 4-7 | ○○ | ○○ | ○○ | ○○ | ○○ | ○○ |
| | 4-8 | ○○ | ○○ | ○○ | ○○ | ○○ | ○○ |
| | 4-9 | ○○ | ○○ | ○○ | ○○ | ○○ | ○○ |
| | 4-10 | ○○ | ○○ | ○○ | ○○ | ○○ | ○○ |
| | 4-11 | ○○ | ○○ | ○○ | ○○ | ○○ | ○○ |
| | 4-12 | ○○ | ○○ | ○○ | ○○ | ○○ | ○○ |
| | 4-13 | ○○ | ○○ | ○○ | ○○ | ○○ | ○○ |
| | 4-14 | ○○ | ○○ | ○○ | ○○ | ○○ | ○○ |
| | 4-15 | ○○ | ○○ | ○○ | ○○ | ○○ | ○○ |

| | | Diluent Samples | | | | | |
|---|---|---|---|---|---|---|---|
| | | 4-3 | | | 4-4 | | |
| | | a MD | b MD | c MD | a MD | b MD | c MD |
| Ink Samples | 4-7 | ○○ | ○○ | ○○ | ○Δ | ○○ | ○○ |
| | 4-8 | ○○ | ○○ | ○○ | ○○ | ○○ | ○○ |
| | 4-9 | ○○ | ○○ | ○○ | ○Δ | ○○ | ○○ |
| | 4-10 | ○○ | ○○ | ○○ | ○○ | ○○ | ○○ |
| | 4-11 | ○○ | ○○ | ○○ | ○X | ○Δ | ○○ |
| | 4-12 | ○○ | ○○ | ○○ | ○Δ | ○○ | ○○ |
| | 4-13 | ○○ | ○○ | ○○ | ○○ | ○○ | ○○ |
| | 4-14 | ○○ | ○○ | ○○ | ○○ | ○○ | ○○ |
| | 4-15 | ○○ | ○○ | ○○ | ○○ | ○○ | ○○ |

TABLE 76

| | | Diluent Samples | | | | | |
|---|---|---|---|---|---|---|---|
| | | 4-5 | | | 4-6 | | |
| | | a MD | b MD | c MD | a MD | b MD | c MD |
| Ink Samples | 4-7 | X○ | X○ | X○ | XX | XX | XX |
| | 4-8 | X○ | X○ | X○ | X○ | X○ | X○ |
| | 4-9 | X○ | X○ | X○ | XX | XX | XX |
| | 4-10 | X○ | X○ | X○ | XX | XX | XX |
| | 4-11 | ○○ | ○○ | ○○ | ○X | ○X | ○X |
| | 4-12 | ○○ | ○○ | ○○ | ○X | ○X | ○X |
| | 4-13 | ○○ | ○○ | ○○ | ○○ | ○○ | ○○ |
| | 4-14 | ○○ | ○○ | ○○ | ○○ | ○○ | ○○ |
| | 4-15 | ○○ | ○○ | ○○ | ○○ | ○○ | ○○ |

| | | Diluent Samples | | | | | |
|---|---|---|---|---|---|---|---|
| | | 4-7 | | | 4-8 | | |
| | | a MD | b MD | c MD | a MD | b MD | c MD |
| Ink Samples | 4-7 | X○ | X○ | X○ | XX | XX | XX |
| | 4-8 | X○ | X○ | X○ | XΔ | X○ | X○ |
| | 4-9 | X○ | X○ | X○ | XX | XX | XX |
| | 4-10 | X○ | X○ | X○ | XX | XX | XX |
| | 4-11 | X○ | X○ | X○ | XX | XX | XX |
| | 4-12 | X○ | X○ | X○ | XX | XX | XX |
| | 4-13 | X○ | X○ | X○ | XΔ | X○ | X○ |
| | 4-14 | ○○ | ○○ | ○○ | ○Δ | ○○ | ○○ |
| | 4-15 | ○○ | ○○ | ○○ | ○Δ | ○○ | ○○ |

TABLE 77

| | | Diluent Samples | | | | | |
|---|---|---|---|---|---|---|---|
| | | 4-9 | | | 4-10 | | |
| | | a MD | b MD | c MD | a MD | b MD | c MD |
| Ink Samples | 4-1 | ○X | ○X | ○X | ○X | ○X | ○X |
| | 4-2 | ○X | ○X | ○X | ○X | ○X | ○X |
| | 4-3 | ○X | ○X | ○X | ○X | ○X | ○X |
| | 4-4 | ○○ | ○○ | ○○ | ○X | ○X | ○X |
| | 4-5 | ○X | ○X | ○X | ○X | ○X | ○X |
| | 4-6 | ○○ | ○○ | ○○ | ○Δ | ○○ | ○○ |
| | 4-13 | ○○ | ○○ | ○○ | ○Δ | ○○ | ○○ |
| | 4-14 | ○○ | ○○ | ○○ | ○Δ | ○○ | ○○ |
| | 4-15 | ○○ | ○○ | ○○ | ○Δ | ○○ | ○○ |

| | | Diluent samples | | | | | |
|---|---|---|---|---|---|---|---|
| | | 4-11 | | | 4-12 | | |
| | | a MD | b MD | c MD | a MD | b MD | c MD |
| Ink Samples | 4-1 | ○X | ○X | ○X | ○X | ○X | ○X |
| | 4-2 | ○X | ○X | ○X | ○X | ○X | ○X |
| | 4-3 | ○X | ○X | ○X | ○X | ○X | ○X |
| | 4-4 | ○○ | ○○ | ○○ | ○○ | ○○ | ○○ |
| | 4-5 | ○X | ○X | ○X | ○X | ○X | ○X |
| | 4-6 | ○○ | ○○ | ○○ | ○○ | ○○ | ○○ |
| | 4-13 | ○○ | ○○ | ○○ | ○Δ | ○○ | ○○ |
| | 4-14 | ○○ | ○○ | ○○ | ○Δ | ○○ | ○○ |
| | 4-15 | ○○ | ○○ | ○○ | ○Δ | ○○ | ○○ |

TABLE 78

| | | Diluent Samples | | | | | |
|---|---|---|---|---|---|---|---|
| | | 4-13 | | | 4-14 | | |
| | | a MD | b MD | c MD | a MD | b MD | c MD |
| Ink Samples | 4-1 | XX | XX | XX | XX | XX | XX |
| | 4-2 | XX | XX | XX | XX | XΔ | XΔ |
| | 4-3 | ○X | ○X | ○X | ○X | XΔ | XΔ |
| | 4-4 | ○○ | ○○ | ○○ | ○○ | ○○ | ○○ |
| | 4-5 | ○X | ○X | ○X | ○X | ○Δ | ○Δ |
| | 4-6 | ○○ | ○○ | ○○ | ○○ | ○○ | ○○ |
| | 4-13 | ○○ | ○○ | ○○ | ○○ | ○○ | ○○ |
| | 4-14 | ○○ | ○○ | ○○ | ○○ | ○○ | ○○ |
| | 4-15 | ○○ | ○○ | ○○ | ○○ | ○○ | ○○ |

As can be understood from results shown in Tables 75 to 78, each combination of the diluent sample and ink sample satisfying the relationship as $q-p \geqq 0$ and $\beta-\alpha \geqq 0$ under the assumption that the surface tension of the ink sample, which was the discharge medium, was q (dyn/cm) and the viscosity of the same was β (cp) and the surface tension of the diluent sample, which was the quantitative medium, was p (dyn/cm) and the viscosity of same was α (cp) resulted in satisfactory mixing characteristic of the two types of the solutions being obtained. When the two types of the solutions were mixed with each other at a predetermined mixture ratio immediately before discharge was performed, the two types of the solutions were satisfactorily mixed with each other. Thus, a solution mixed satisfactorily was discharged and thus accurate expression of a gradation image was formed and the discharge stability was improved.

If the combination of the diluent sample and the ink sample was not changed, a satisfactory result was obtained when the ratio of the diluent sample, which was the quantitative medium, was lower than that of the ink sample which was the discharge medium.

Example 4-6

Quantitative discharge of a mixture solution of two types of the solutions was performed similarly to Example 4-5 except for the period of time taken from quantitative mixture to the application to the recording medium, which was about 500 (msec) in Example 4-5, was changed to about 100 (μsec) so that the mixing characteristics of the two types of the solutions and the discharge stability were evaluated. Results were shown in Tables 79 to 82. Also Tables 79 to 82 showed the mixture ratio (the concentration of ink) of ink and the diluent similarly to Tables 62 and 63.

TABLE 79

| | | Diluent Samples | | | | | |
|---|---|---|---|---|---|---|---|
| | | 4-1 | | | 4-2 | | |
| | | a MD | b MD | c MD | a MD | b MD | c MD |
| Ink Samples | 4-7 | ○○ | ○○ | ○○ | ○○ | ○○ | ○○ |
| | 4-8 | ○○ | ○○ | ○○ | ○○ | ○○ | ○○ |
| | 4-9 | ○○ | ○○ | ○○ | ○○ | ○○ | ○○ |
| | 4-10 | ○○ | ○○ | ○○ | ○○ | ○○ | ○○ |
| | 4-11 | ○○ | ○○ | ○○ | ○○ | ○○ | ○○ |
| | 4-12 | ○○ | ○○ | ○○ | ○○ | ○○ | ○○ |
| | 4-13 | ○○ | ○○ | ○○ | ○○ | ○○ | ○○ |
| | 4-14 | ○○ | ○○ | ○○ | ○○ | ○○ | ○○ |

TABLE 79-continued

| | | | | | | | |
|---|---|---|---|---|---|---|---|
| | 4-15 | ○○ | ○○ | ○○ | ○○ | ○○ | ○○ |
| | | Diluent Samples | | | | | |
| | | 4-3 | | | 4-4 | | |
| | | a MD | b MD | c MD | a MD | b MD | c MD |
| Ink Samples | 4-7 | ○○ | ○○ | Δ○ | ○Δ | ○○ | Δ○ |
| | 4-8 | ○○ | ○○ | Δ○ | ○○ | ○○ | Δ○ |
| | 4-9 | ○○ | ○○ | ○○ | ○Δ | ○○ | ○○ |
| | 4-10 | ○○ | ○○ | ○○ | ○○ | ○○ | ○○ |
| | 4-11 | ○○ | ○○ | ○○ | ○X | ○Δ | ○○ |
| | 4-12 | ○○ | ○○ | ○○ | ○Δ | ○○ | ○○ |
| | 4-13 | ○○ | ○○ | ○○ | ○○ | ○○ | ○○ |
| | 4-14 | ○○ | ○○ | ○○ | ○○ | ○○ | ○○ |
| | 4-15 | ○○ | ○○ | ○○ | ○○ | ○○ | ○○ |

TABLE 80

| | | Diluent Samples | | | | | |
|---|---|---|---|---|---|---|---|
| | | 4-5 | | | 4-6 | | |
| | | a MD | b MD | c MD | a MD | b MD | c MD |
| Ink Samples | 4-7 | X○ | X○ | X○ | XX | XX | XX |
| | 4-8 | X○ | X○ | X○ | X○ | X○ | X○ |
| | 4-9 | X○ | X○ | X○ | XX | XX | XX |
| | 4-10 | X○ | X○ | X○ | XX | XX | XX |
| | 4-11 | ○○ | ○○ | Δ○ | ○X | ○X | ΔX |
| | 4-12 | ○○ | ○○ | Δ○ | ○X | ○X | ΔX |
| | 4-13 | ○○ | ○○ | Δ○ | ○○ | ○○ | Δ○ |
| | 4-14 | ○○ | ○○ | ○○ | ○○ | ○○ | ○○ |
| | 4-15 | ○○ | ○○ | ○○ | ○○ | ○○ | ○○ |
| | | Diluent Samples | | | | | |
| | | 4-7 | | | 4-8 | | |
| | | a MD | b MD | c MD | a MD | b MD | c MD |
| Ink Samples | 4-7 | X○ | X○ | X○ | XX | XX | XX |
| | 4-8 | X○ | X○ | X○ | XΔ | X○ | X○ |
| | 4-9 | X○ | X○ | X○ | XX | XX | XX |
| | 4-10 | X○ | X○ | X○ | XX | XX | XX |
| | 4-11 | X○ | X○ | X○ | XX | XX | XX |
| | 4-12 | X○ | X○ | X○ | XX | XX | XX |
| | 4-13 | X○ | X○ | X○ | XΔ | X○ | XX |
| | 4-14 | ○○ | ○○ | ○○ | ○Δ | ○○ | ○○ |
| | 4-15 | ○○ | ○○ | ○○ | ○Δ | ○○ | ○○ |

TABLE 81

| | | Diluent Samples | | | | | |
|---|---|---|---|---|---|---|---|
| | | 4-9 | | | 4-10 | | |
| | | a MD | b MD | c MD | a ND | b MD | c MD |
| Ink Samples | 4-1 | ○X | ○X | ○X | ○X | ○X | ○X |
| | 4-2 | ○X | ○X | ○X | ○X | ○X | ○X |
| | 4-3 | ○X | ○X | ○X | ○X | ○X | ○X |
| | 4-4 | ○○ | ○○ | ○○ | ○X | ○X | ○X |
| | 4-5 | ○X | ○X | ○X | ○X | ○X | ○X |
| | 4-6 | ○○ | ○○ | ○○ | ○Δ | ○○ | ○○ |
| | 4-13 | ○○ | ○○ | ○○ | ○Δ | ○○ | ○○ |
| | 4-14 | ○○ | ○○ | ○○ | ○Δ | ○○ | ○○ |
| | 4-15 | ○○ | ○○ | ○○ | ○Δ | ○○ | ○○ |

TABLE 81-continued

| | | Diluent Samples | | | | | |
|---|---|---|---|---|---|---|---|
| | | 4-11 | | | 4-12 | | |
| | | a MD | b MD | c MD | a MD | b MD | c MD |
| Ink Samples | 4-1 | ○X | ○X | ΔX | ○X | ○X | ΔX |
| | 4-2 | ○X | ○X | ΔX | ○X | ○X | ΔX |
| | 4-3 | ○X | ○X | ○X | ○X | ○X | ○X |
| | 4-4 | ○○ | ○○ | ○○ | ○○ | ○○ | ○○ |
| | 4-5 | ○X | ○X | ○X | ○X | ○X | ○X |
| | 4-6 | ○○ | ○○ | ○○ | ○○ | ○○ | ○○ |
| | 4-13 | ○○ | ○○ | ○○ | ○Δ | ○○ | ○○ |
| | 4-14 | ○○ | ○○ | ○○ | ○Δ | ○○ | ○○ |
| | 4-15 | ○○ | ○○ | ○○ | ○Δ | ○○ | ○○ |

TABLE 82

| | | Diluent Samples | | | | | |
|---|---|---|---|---|---|---|---|
| | | 4-13 | | | 4-14 | | |
| | | a MD | b MD | c MD | a MD | b MD | c MD |
| Ink Samples | 4-1 | XX | XX | XX | XX | XX | XX |
| | 4-2 | XX | XX | XX | XX | XΔ | XΔ |
| | 4-3 | ○X | ○X | ΔX | ○X | ○Δ | ΔΔ |
| | 4-4 | ○○ | ○○ | Δ○ | ○○ | ○○ | Δ○ |
| | 4-5 | ○X | ○X | ○X | ○X | ○Δ | ○Δ |
| | 4-6 | ○○ | ○○ | ○○ | ○○ | ○○ | ○○ |
| | 4-13 | ○○ | ○○ | ○○ | ○○ | ○○ | Δ○ |
| | 4-14 | ○○ | ○○ | ○○ | ○○ | ○○ | ○○ |
| | 4-15 | ○○ | ○○ | ○○ | ○○ | ○○ | ○○ |

As can be understood from results shown in Tables 79 to 82, each combination of the diluent sample and ink sample satisfying the relationship as $q-p \geqq 0$ and $\beta-\alpha \geqq 0$ under the assumption that the surface tension of the ink sample, which was the discharge medium, was q (dyn/cm) and the viscosity of the same was β (cp) and the surface tension of the diluent sample, which was the quantitative medium, was p (dyn/cm) and the viscosity of same was α (cp) resulted in satisfactory mixing characteristic of the two types of the solutions and discharge stability being obtained.

However, since the period of time taken from the quantitative mixture of the quantitative medium and the discharge medium to the application to the recording medium was made to be shorter than that in the foregoing examples, the mixing characteristics of the two types of the solutions deteriorated. Therefore, a fact was confirmed that the period of time taken from the quantitative mixture to the application to a recording medium affects the mixing characteristics of the two types of the solutions.

If the combination of the diluent sample and the ink sample was not changed, a satisfactory result was obtained when the ratio of the diluent sample, which was the quantitative medium, was lower than that of the ink sample which was the discharge medium.

As can be understood from the results of Example 4, the recording method according to the present invention enabled discharge of mediums to be performed stably regardless of the material and accurate expression of a gradient image to be performed because the quantitative medium, which was the diluent was mixed with the discharge medium, which was ink, at a predetermined mixture ratio immediately before discharge so as to be formed into diluted ink; and the discharge medium and the quantitative medium satisfying the relationship as $q-p \geqq 0$ and $\beta-\alpha \geqq 0$ under the assumption that the surface tension of the discharge medium was q (dyn/cm) and the viscosity of the same was β (cp) and the surface tension of the quantitative medium was p (dyn/cm) and the viscosity of same was α (cp) were used when the diluted ink was applied to the surface of a recording medium so that the surface tensions of the quantitative medium and the discharge medium and their relationship were made to be adequate for the mixing operation and the discharge operation.

Example 5

In this example, the diluent was used as the discharge medium and the ink was used as the quantitative medium. Samples of the diluent and ink having different viscosity were prepared, and the samples were used as the discharge medium and the quantitative medium for the above-mentioned printer so that the discharge stability was evaluated.

Example 5-1

Initially, isopropyl alcohol and glycerin were added to water so that diluent samples 5-1 to 5-5 having the viscosity and the surface tension shown in Table 83 were prepared at 20° C.

TABLE 83

| | | Viscosity (cp) | Surface Tension (dyn/cm) |
|---|---|---|---|
| Diluent Samples 1 | 5-1 | 1.5 | 35 |
| Diluent Samples 2 | 5-2 | 3.0 | 35 |
| Diluent Samples 3 | 5-3 | 5.0 | 35 |
| Diluent Samples 4 | 5-4 | 10.0 | 35 |
| Diluent Samples 5 | 5-5 | 15.0 | 35 |
| Ink Samples 1 | 5-1 | 1.5 | 35 |
| Ink Samples 2 | 5-2 | 3.0 | 35 |
| Ink Samples 3 | 5-3 | 5.0 | 35 |
| Ink Samples 4 | 5-4 | 10.0 | 35 |
| Ink Samples 5 | 5-5 | 15.0 | 35 |

Then, isopropyl alcohol, ethylene glycol and dye were added to water so that ink samples 5-1 to 5-5 having viscosity and surface tensions shown in Table 83 were prepared at 20° C. C.I. Direct Yellow 50 was used as the dye in ink sample 5-1, C.I. Direct Yellow 87 was used as the dye in ink sample 5-2, C.I. Direct Red 83 was used as the dye in ink sample 5-3, C.I. Direct Red 227 was used as the dye in ink sample 5-4 and C.I. Direct Blue 6 was used as the dye in ink sample 5-5.

The surface tensions of the diluent samples and ink samples were measured by a surface tension meter CBVP-Z (model name) manufactured by Kyowa Surface Chemistry, and the viscosity was measured by a viscosity meter DV-II+ (model name) manufactured by BROOK FIELD.

Then, the foregoing diluent samples 5-1 to 5-5 and ink samples 5-1 to 5-5 were used to evaluate the discharge stability. That is, the diluent samples 5-1 to 5-5 and ink samples 5-1 to 5-5 were combined variously and the concentration of ink was varied to respective print images. Then, the degree of deviation of the position, at which a printed pattern was formed, from the position at which a printed pattern was formed when only the diluent sample was discharged was measured. In accordance with the degree of deviation, the discharge stability was evaluated.

At this time, the printed pattern was formed in such a manner that two circular patterns 41 and 42 each having a diameter indicated with symbol D shown in FIG. 10 being 120 μm were formed adjacently, as shown in FIG. 10. Note that the description will be performed that the circular patterns 41 and 42 were formed with only the diluent. That is, the deviation of circular patterns 43 and 44, each having a shape similar to each of the above-mentioned circular patterns and formed by mixed droplets, from the positions of the circular patterns 41 and 42, that is, the degrees of deviations, respectively indicated with $d_1$ and $d_2$ shown in FIG. 10, were measured.

The evaluation was performed under the following discharge conditions that the voltage of the discharge side was 20 V, the pulse width was 80 μs and the highest voltage for the quantitative side was 20 V or lower. The pulse width was 100 μs which was varied arbitrarily. The discharging frequency was 5 kHz and period of time taken from the quantitative mixing to the application to the recording medium was about 100 μs. The diameter of the discharge nozzle was 35 μm and the diameter of the quantitative nozzle was 20 μm. Moreover, the diameter of the dot on the recording medium was 120 μm.

Results were shown in Table 84 with combination of ink samples and diluent samples and the concentration of ink. Symbol a in Table 84 indicated a case where diluent:ink was 99:1, b in Table 84 indicated a case where diluent:ink was 90:10, c in Table 84 indicated a case where diluent:ink was 50:50 and d in Table 84 indicated a case where diluent:ink was 20:80.

Results having deviation smaller than 30 μm were given mark 0, results having deviation 30 μm to 60 μm were given mark Δ and results having deviation larger than 60 μm were given mark x.

TABLE 84

| Ink | Diluent Samples | | | | | | | | | | | |
|---|---|---|---|---|---|---|---|---|---|---|---|---|
| | 5-1 | | | | 5-2 | | | | 5-3 | | | |
| Samples | a | b | c | d | a | b | c | d | a | b | c | d |
| 5-1 | ○ | ○ | Δ | Δ | ○ | ○ | ○ | ○ | ○ | ○ | ○ | ○ |
| 5-2 | Δ | Δ | X | X | ○ | ○ | Δ | Δ | ○ | ○ | ○ | ○ |
| 5-3 | Δ | X | X | X | Δ | Δ | X | X | ○ | ○ | Δ | Δ |
| 5-4 | X | X | X | X | Δ | X | X | X | Δ | Δ | X | X |
| 5-5 | X | X | X | X | X | X | X | X | Δ | X | X | X |

| Ink | Diluent Samples | | | | | | | |
|---|---|---|---|---|---|---|---|---|
| | 5-4 | | | | 5-5 | | | |
| Samples | a | b | c | d | a | b | c | d |
| 5-1 | ○ | ○ | ○ | ○ | ○ | ○ | ○ | ○ |
| 5-2 | ○ | ○ | ○ | ○ | ○ | ○ | ○ | ○ |
| 5-3 | ○ | ○ | ○ | ○ | ○ | ○ | ○ | ○ |
| 5-4 | ○ | ○ | Δ | Δ | ○ | ○ | ○ | ○ |
| 5-5 | Δ | Δ | X | X | ○ | ○ | Δ | Δ |

As can be understood from results shown in Table 84, the combination of the diluent sample, which was the discharge medium, and ink sample, which was the quantitative medium, having the relationship that the viscosity $\alpha_2$ (cp) of the diluent sample and that $\beta_2$ (cp) of the ink sample satisfied $\alpha_2-\beta_2 \geqq 0$ resulted in deviation being 60 μm or smaller which was a practically allowable value. If the deviation was larger than 60 μm, a white portion (lack of dots) undesirably took place in the printed pattern.

Example 5-2

Initially, ethylene glycol monomethylether, glycerin and non-ionic surface active agent were added to water so that diluent samples 5-6 to 5-9 having the viscosity and surface tensions as shown in Table 85 were prepared at 20° C. As the surface active agent, Emergen 985 (trade name) manufactured by Kao was employed.

TABLE 85

| | | Viscosity (cp) | Surface Tension (dyn/cm) |
|---|---|---|---|
| Diluent Samples 6 | 5-6 | 2.0 | 30 |
| Diluent Samples 7 | 5-7 | 4.0 | 30 |
| Diluent Samples 8 | 5-8 | 8.0 | 30 |
| Diluent Samples 9 | 5-9 | 12.0 | 30 |
| Ink Samples 6 | 5-6 | 2.0 | 30 |
| Ink Samples 7 | 5-7 | 4.0 | 30 |
| Ink Samples 8 | 5-8 | 8.0 | 30 |
| Ink Samples 9 | 5-9 | 12.0 | 30 |

Ethyleneglycol monomethylether, glycerin, a non-ionic surface active agent and dye were added to water so that ink samples 5-6 to 5-9 having the viscosity and the surface tensions shown in Table 85 were prepared at 20° C. C.I. Acid yellow 23 was used as the dye in ink sample 5-6, C.I. Acid Red 52 was used as the dye in ink sample 5-7, C.I. Acid Blue 9 was used as the dye in ink sample 5-8 and C.I. Acid Black 24 was used as the dye in ink sample 5-9. Moreover, the concentration of the dye was 5 wt %.

The viscosity and the surface tension of the diluent sample and the ink sample were measured similarly to Example 5-1.

Then, diluent samples 5-6 to 5-9 and ink samples 5-6 to 5-9 were used to evaluate the discharge stability similarly to Example 5-1. Results were shown in Table 86 similarly to Table 84.

TABLE 86

| | Diluent Samples | | | | | | | |
|---|---|---|---|---|---|---|---|---|
| | 5-6 | | | | 5-7 | | | |
| Ink Samples | a | b | c | d | a | b | c | d |
| 5-6 | ○ | ○ | Δ | Δ | ○ | ○ | ○ | ○ |
| 5-7 | Δ | Δ | X | X | ○ | ○ | Δ | Δ |
| 5-8 | Δ | X | X | X | Δ | Δ | X | X |
| 5-9 | X | X | X | X | Δ | X | X | X |

| | Diluent Samples | | | | | | | |
|---|---|---|---|---|---|---|---|---|
| | 5-8 | | | | 5-9 | | | |
| Ink Samples | a | b | c | d | a | b | c | d |
| 5-6 | ○ | ○ | ○ | ○ | ○ | ○ | ○ | ○ |
| 5-7 | ○ | ○ | ○ | ○ | ○ | ○ | ○ | ○ |
| 5-8 | ○ | ○ | Δ | Δ | ○ | ○ | ○ | ○ |
| 5-9 | Δ | Δ | X | X | ○ | ○ | Δ | Δ |

As can be understood from results shown in Table 86, the combination of the diluent sample, which was the discharge medium, and ink sample, which was the quantitative medium, having the relationship that the viscosity $\alpha_2$ (cp) of the diluent sample and that $\beta_2$ (cp) of the ink sample satisfied $\alpha_2-\beta_2 \geqq 0$ resulted in deviation being 60 μm or smaller which was a practically allowable value. If the deviation was larger than 60 μm, a white portion (lack of dots) undesirably took place in the printed pattern.

Example 5-3

Then, diluent samples 5-1 to 5-5 according to Example 5-1 and ink samples 5-6 to 5-9 according to Example 5-2 were combined so that the discharge stability was evaluated similarly to Example 5-1. Results were shown in Table 87 similarly to Table 84.

TABLE 87

| Diluent | Ink Samples 5-1 | | | | 5-2 | | | | 5-3 | | | |
|---|---|---|---|---|---|---|---|---|---|---|---|---|
| Samples | a | b | c | d | a | b | c | d | a | b | c | d |
| 5-6 | Δ | Δ | Δ | X | ○ | ○ | ○ | Δ | ○ | ○ | ○ | ○ |
| 5-7 | Δ | X | X | X | Δ | Δ | X | X | ○ | ○ | ○ | Δ |
| 5-8 | X | X | X | X | Δ | X | X | X | Δ | Δ | X | X |
| 5-9 | X | X | X | X | X | X | X | X | Δ | X | X | X |

| Diluent | Ink Samples 5-4 | | | | 5-5 | | | |
|---|---|---|---|---|---|---|---|---|
| Samples | a | b | c | d | a | b | c | d |
| 5-6 | ○ | ○ | ○ | ○ | ○ | ○ | ○ | ○ |
| 5-7 | ○ | ○ | ○ | ○ | ○ | ○ | ○ | ○ |
| 5-8 | ○ | ○ | ○ | ○ | ○ | ○ | ○ | ○ |
| 5-9 | Δ | Δ | X | X | ○ | ○ | ○ | ○ |

Then, diluent samples 5-6 to 5-9 according to Example 5-2 and ink samples 5-1 to 5-5 according to Example 5-2 were combined so that the discharge stability was evaluated similarly to Example 5-1. Results were shown in Table 88 similarly to Table 84.

TABLE 88

| Diluent | Ink Samples 5-6 | | | | 5-7 | | | |
|---|---|---|---|---|---|---|---|---|
| Samples | a | b | c | d | a | b | c | d |
| 5-1 | ○ | ○ | ○ | Δ | ○ | ○ | ○ | ○ |
| 5-2 | Δ | Δ | X | X | ○ | ○ | ○ | ○ |
| 5-3 | Δ | X | X | X | Δ | Δ | X | X |
| 5-4 | X | X | X | X | X | X | X | X |
| 5-5 | X | X | X | X | X | X | X | X |

| Diluent | Ink Samples 5-8 | | | | 5-9 | | | |
|---|---|---|---|---|---|---|---|---|
| Samples | a | b | c | d | a | b | c | d |
| 5-1 | ○ | ○ | ○ | ○ | ○ | ○ | ○ | ○ |
| 5-2 | ○ | ○ | ○ | ○ | ○ | ○ | ○ | ○ |
| 5-3 | ○ | ○ | ○ | ○ | ○ | ○ | ○ | ○ |
| 5-4 | Δ | Δ | X | X | ○ | ○ | ○ | ○ |
| 5-6 | X | X | X | X | Δ | X | X | X |

As can be understood from results shown in Tables 87 and 88, the combination of the diluent sample, which was the discharge medium, and ink sample, which was the quantitative medium, having the relationship that the viscosity $\alpha_2$ (cp) of the diluent sample and that $\beta_2$ (cp) of the ink sample satisfied $\alpha_2-\beta_2 \geqq 0$ resulted in deviation being 60 $\mu$m or smaller which was a practically allowable value. If the deviation was larger than 60 $\mu$m, a white portion (lack of dots) undesirably took place in the printed pattern.

Example 5-4

Initially, ethanol, 2-(2-butoxyethoxy) ethanol and diethylene glycol were added to water so that ink samples 5-10 and 5-11 having the viscosity and the surface tensions shown in Table 89 were prepared at 20° C.

TABLE 89

| | | Viscosity (cp) | Surface Tension (dyn/cm) |
|---|---|---|---|
| Diluent Samples 10 | 5-10 | 3.0 | 37 |
| Diluent Samples 11 | 5-11 | 5.0 | 37 |
| Ink Samples 10 | 5-10 | 3.0 | 37 |
| Ink Samples 11 | 5-11 | 5.0 | 37 |

Then, ethanol, 2-(2-butoxyethoxy) ethanol, diethylene glycol and dye were added to water so that ink samples 5-10 and 5-11 having the viscosity and the surface tensions shown in Table 89 were prepared at 20° C. C.I. Direct Black 38 was used as the dye in ink sample 5-10 and C.I. Direct Black 94 was used as the dye in ink sample 5-11. Moreover, the concentration of the dye was 5 wt %.

The viscosity and the surface tension of the diluent sample and the ink sample were measured similarly to Example 5-1.

Then, diluent samples 5-10 and 5-11 and ink samples 5-10 and 5-11 were used to evaluate the discharge stability similarly to Example 5-1. Results were shown in Table 90 similarly to Table 84.

TABLE 90

| Ink Samples | Diluent Samples 5-10 | | | | 5-11 | | | |
|---|---|---|---|---|---|---|---|---|
| | a | b | c | d | a | b | c | d |
| 5-10 | ○ | ○ | Δ | Δ | ○ | ○ | ○ | ○ |
| 5-11 | Δ | Δ | X | X | ○ | ○ | Δ | Δ |

As can be understood from results shown in Table 90, the combination of the diluent sample, which was the discharge medium, and ink sample, which was the quantitative medium, having the relationship that the viscosity $\alpha_2$ (cp) of the diluent sample and that $\beta_2$ (cp) of the ink sample satisfied $\alpha_2-\beta_2 \geqq 0$ resulted in deviation being 60 $\mu$m or smaller which was a practically allowable value. If the deviation was larger than 60 $\mu$m, a white portion (lack of dots) undesirably took place in the printed pattern.

Example 5-5

Then, diluent samples 5-10 and 5-11 according to Example 5-4 and ink samples 5-1 to 5-9 according to Examples 5-1 and 5-2 were combined so that the discharge stability was evaluated similarly to Example 5-1. Results were shown in Table 91 similarly to Table 84.

TABLE 91

| Ink | Diluent Samples 5-10 | | | | 5-11 | | | |
|---|---|---|---|---|---|---|---|---|
| Samples | a | b | c | d | a | b | c | d |
| 5-1 | ○ | ○ | ○ | ○ | ○ | ○ | ○ | ○ |
| 5-2 | ○ | ○ | Δ | Δ | ○ | ○ | ○ | ○ |
| 5-3 | Δ | Δ | X | X | ○ | ○ | Δ | Δ |
| 5-4 | Δ | X | X | X | Δ | Δ | X | X |
| 5-5 | X | X | X | X | Δ | X | X | X |
| 5-6 | ○ | ○ | ○ | ○ | ○ | ○ | ○ | ○ |
| 5-7 | Δ | Δ | X | X | ○ | ○ | ○ | ○ |

TABLE 91-continued

| Ink | Diluent Samples | | | | | | | |
|---|---|---|---|---|---|---|---|---|
| | 5-10 | | | | 5-11 | | | |
| Samples | a | b | c | d | a | b | c | d |
| 5-8 | Δ | Δ | X | X | Δ | Δ | X | X |
| 5-9 | X | X | X | X | Δ | X | X | X |

Diluent samples 5-1 to 5-9 according to Examples 5-1 and 5-2 and ink samples 5-10 and 5-11 according to Example 5-4 were combined so that the discharge stability was evaluated similarly to Example 5-1. Results were shown in Tables 92 and 93 similarly to Table 84.

TABLE 92

| Ink | Diluent Samples | | | | | | | | | | | |
|---|---|---|---|---|---|---|---|---|---|---|---|---|
| | 5-1 | | | | 5-2 | | | | 5-3 | | | |
| Samples | a | b | c | d | a | b | c | d | a | b | c | d |
| 5-10 | Δ | Δ | X | X | ○ | ○ | Δ | Δ | ○ | ○ | ○ | ○ |
| 5-11 | Δ | X | X | X | Δ | Δ | X | X | ○ | ○ | Δ | Δ |

| Ink | Diluent Samples | | | | | | | |
|---|---|---|---|---|---|---|---|---|
| | 5-4 | | | | 5-5 | | | |
| Samples | a | b | c | d | a | b | c | d |
| 5-10 | ○ | ○ | ○ | ○ | ○ | ○ | ○ | ○ |
| 5-11 | ○ | ○ | ○ | ○ | ○ | ○ | ○ | ○ |

TABLE 93

| Ink | Diluent Samples | | | | | | | |
|---|---|---|---|---|---|---|---|---|
| | 5-6 | | | | 5-7 | | | |
| Samples | a | b | c | d | a | b | c | d |
| 5-10 | Δ | Δ | X | X | ○ | ○ | ○ | ○ |
| 5-11 | Δ | X | X | X | Δ | Δ | X | X |

| Ink | Diluent Samples | | | | | | | |
|---|---|---|---|---|---|---|---|---|
| | 5-8 | | | | 5-9 | | | |
| Samples | a | b | c | d | a | b | c | d |
| 5-10 | ○ | ○ | ○ | ○ | ○ | ○ | ○ | ○ |
| 5-11 | ○ | ○ | ○ | ○ | ○ | ○ | ○ | ○ |

As can be understood from results shown in Tables 91 to 93, the combination of the diluent sample, which was the discharge medium, and ink sample, which was the quantitative medium, having the relationship that the viscosity $\alpha_2$ (cp) of the diluent sample and that $\beta_2$ (cp) of the ink sample satisfied $\alpha_2-\beta_2 \geqq 0$ resulted in deviation being 60 $\mu$m or smaller which was a practically allowable value. If the deviation was larger than 60 $\mu$m, a white portion (lack of dots) undesirably took place in the printed pattern.

As can be understood from the results of Example 5, the printer according to the present invention arranged to discharge a discharge medium from a first nozzle so as to mix and discharge the quantitative medium and the discharge medium after the quantitative medium has been allowed to seep from the second nozzle allowed to communicate with the second pressure chamber to which the quantitative medium was introduced toward the first nozzle allowed to communicate with the first pressure chamber into which the discharge medium was introduced and opened adjacently to the second nozzle was structured in such a manner that the discharge medium and the quantitative medium satisfied the relationship as $\alpha-\beta \geqq 0$ on the assumption that the viscosity of the discharge medium was $\alpha$ (cp) and the viscosity of the quantitative medium was $\beta$ (cp). Therefore, the viscosity of the quantitative medium and that of the discharge medium and their relationship were made to be suitable for use in the mixing operation and the discharge operation. As a result, the discharge stability of the medium was maintained regardless of the materials of the mediums. As a result, accurate expression of a gradient image was performed.

Example 6

In this embodiment, ink was used as the discharge medium and the diluent was used as the quantitative medium. Ink samples and diluent samples having different viscosity were prepared and the samples were used to evaluate the discharge stability by using the above-mentioned printer.

Example 6-1

In this example, diluent samples 5-1 to 5-5 and ink samples 5-1 to 5-5 according to Example 5-1 were used such that ink samples 5-1 to 5-5 were used as the discharge mediums and diluent samples 5-1 to 5-5 were used as quantitative mediums so as to evaluate the discharge stability in printing operations.

That is, ink samples 5-1 to 5-5 and diluent samples 5-1 to 5-5 were combined and the concentration of ink was varied when printing operations were performed so that the discharge medium was evaluated similarly to Example 5-1. Results were shown in Table 94 similarly to Table 83. Symbol a in Table 94 indicated a case where ink:diluent was 99:1, b in Table 94 indicated a case where ink:diluent was 90:10 and c in Table 94 indicated a case where ink:diluent was 50:50 and d in Table 94 indicated a case where ink:diluent was 20:80. Results having deviation smaller than 30 $\mu$m were indicated with symbol 0, results having deviation of 30 $\mu$m to 60 $\mu$m were indicated with symbol Δ and results having deviation larger than 60 $\mu$m were indicated with x.

TABLE 94

| Diluent | Ink Samples | | | | | | | | | | | |
|---|---|---|---|---|---|---|---|---|---|---|---|---|
| | 5-1 | | | | 5-2 | | | | 5-3 | | | |
| Samples | a | b | c | d | a | b | c | d | a | b | c | d |
| 5-1 | ○ | ○ | Δ | Δ | ○ | ○ | ○ | ○ | ○ | ○ | ○ | ○ |
| 5-2 | Δ | Δ | X | X | ○ | ○ | Δ | Δ | ○ | ○ | ○ | ○ |
| 5-3 | Δ | X | X | X | Δ | Δ | X | X | ○ | ○ | Δ | Δ |
| 5-4 | X | X | X | X | Δ | X | X | X | Δ | Δ | X | X |
| 5-5 | X | X | X | X | X | X | X | X | Δ | X | X | X |

| Diluent | Ink Samples | | | | | | | |
|---|---|---|---|---|---|---|---|---|
| | 5-4 | | | | 5-5 | | | |
| Samples | a | b | c | d | a | b | c | d |
| 5-1 | ○ | ○ | ○ | ○ | ○ | ○ | ○ | ○ |
| 5-2 | ○ | ○ | ○ | ○ | ○ | ○ | ○ | ○ |
| 5-3 | ○ | ○ | ○ | ○ | ○ | ○ | ○ | ○ |
| 5-4 | ○ | ○ | Δ | Δ | ○ | ○ | ○ | ○ |
| 5-5 | Δ | Δ | X | X | ○ | ○ | Δ | Δ |

As can be understood from the results shown in Table 94, the combination of the ink sample, which was the discharge medium, and diluent sample, which was the quantitative medium, having the relationship that the viscosity $\alpha_3$ (cp) of the ink sample and that $\beta_3$ (cp) of the diluent sample satisfied $\alpha_3-\beta_3 \geqq 0$ resulted in deviation being 60 $\mu$m or smaller which was a practically allowable value. If the deviation was larger than 60 $\mu$m, a white portion (lack of dots) undesirably took place in the printed pattern.

Example 6-2

In this example, diluent samples 5-6 to 5-9 and ink samples 5-6 to 5-9 according to Example 5-2 were used such that ink samples 5-6 to 5-9 were used as the discharge mediums and diluent samples 5-6 to 5-9 were used as the quantitative mediums in the printing operations for evaluating the discharge stability.

That is, ink samples 5-6 to 5-9 and diluent samples 5-6 to 5-9 were combined and the concentration of ink was varied in the printing operations. Similarly to Example 5-1, the discharge stability was evaluated. Results were shown in Table 95 similarly to Table 94.

TABLE 95

| | Ink Samples | | | | | | | |
|---|---|---|---|---|---|---|---|---|
| Diluent | 5-6 | | | | 5-7 | | | |
| Samples | a | b | c | d | a | b | c | d |
| 5-6 | ○ | ○ | Δ | Δ | ○ | ○ | ○ | ○ |
| 5-7 | Δ | Δ | X | X | ○ | ○ | Δ | Δ |
| 5-8 | Δ | X | X | X | Δ | Δ | X | X |
| 5-9 | X | X | X | X | Δ | X | X | X |

| | Ink Samples | | | | | | | |
|---|---|---|---|---|---|---|---|---|
| Diluent | 5-8 | | | | 5-9 | | | |
| Samples | a | b | c | d | a | b | c | d |
| 5-6 | ○ | ○ | ○ | ○ | ○ | ○ | ○ | |
| 5-7 | ○ | ○ | ○ | ○ | ○ | ○ | ○ | ○ |
| 5-8 | ○ | ○ | Δ | Δ | ○ | ○ | ○ | ○ |
| 5-9 | Δ | Δ | X | X | ○ | ○ | Δ | Δ |

As can be understood from the results shown in Table 95, the combination of the ink sample, which was the discharge medium, and diluent sample, which was the quantitative medium, having the relationship that the viscosity $\alpha_3$ (cp) of the ink sample and that $\beta_3$ (cp) of the diluent sample satisfied $\alpha_3-\beta_3 \geqq 0$ resulted in deviation being 60 $\mu$m or smaller which was a practically allowable value. If the deviation was larger than 60 $\mu$m, a white portion (lack of dots) undesirably took place in the printed pattern.

Example 6-3

Then, ink samples 5-1 to 5-5 according to Example 6-1 and diluent samples 5-6 to 5-9 according to Example 6-2 were combined variously so that the discharge stability was evaluated similarly to Example 1. Results were shown in Table 96 similarly to Table 94.

TABLE 96

| | Ink Samples | | | | | | | | | | | |
|---|---|---|---|---|---|---|---|---|---|---|---|---|
| Diluent | 5-1 | | | | 5-2 | | | | 5-3 | | | |
| Samples | a | b | c | d | a | b | c | d | a | b | c | d |
| 5-6 | Δ | Δ | Δ | X | ○ | ○ | ○ | Δ | ○ | ○ | ○ | ○ |
| 5-7 | Δ | X | X | X | Δ | Δ | X | X | ○ | ○ | ○ | Δ |

TABLE 96-continued

| | | | | | | | | | | | | |
|---|---|---|---|---|---|---|---|---|---|---|---|---|
| 5-8 | X | X | X | X | Δ | X | X | X | Δ | Δ | X | X |
| 5-9 | X | X | X | X | X | X | X | X | Δ | X | X | X |

| | Ink Samples | | | | | | | |
|---|---|---|---|---|---|---|---|---|
| Diluent | 5-4 | | | | 5-5 | | | |
| Samples | a | b | c | d | a | b | c | d |
| 5-6 | ○ | ○ | ○ | ○ | ○ | ○ | ○ | ○ |
| 5-7 | ○ | ○ | ○ | ○ | ○ | ○ | ○ | ○ |
| 5-8 | ○ | ○ | ○ | ○ | ○ | ○ | ○ | ○ |
| 5-9 | Δ | Δ | X | X | ○ | ○ | ○ | ○ |

Ink samples 5-6 to 5-9 according to Example 6-2 and diluent samples 5-1 to 5-5 according to Example 6-1 were combined variously so that the discharge stability was evaluated similarly to Example 5-1. Results were shown in Table 97 similarly to Table 94.

TABLE 97

| | Ink Samples | | | | | | | |
|---|---|---|---|---|---|---|---|---|
| Diluent | 5-6 | | | | 5-7 | | | |
| Samples | a | b | c | d | a | b | c | d |
| 5-1 | ○ | ○ | ○ | Δ | ○ | ○ | ○ | ○ |
| 5-2 | Δ | Δ | X | X | ○ | ○ | ○ | ○ |
| 5-3 | Δ | X | X | X | Δ | Δ | X | X |
| 5-4 | X | X | X | X | X | X | X | X |
| 5-5 | X | X | X | X | X | X | X | X |

| | Ink Samples | | | | | | | |
|---|---|---|---|---|---|---|---|---|
| Diluent | 5-8 | | | | 5-9 | | | |
| Samples | a | b | c | d | a | b | c | d |
| 5-1 | ○ | ○ | ○ | ○ | ○ | ○ | ○ | ○ |
| 5-2 | ○ | ○ | ○ | ○ | ○ | ○ | ○ | ○ |
| 5-3 | ○ | ○ | ○ | ○ | ○ | ○ | ○ | ○ |
| 5-4 | Δ | Δ | X | X | ○ | ○ | ○ | ○ |
| 5-5 | X | X | X | X | Δ | X | X | X |

As can be understood from the results shown in Tables 96 and 97, the combination of the ink sample, which was the discharge medium, and diluent sample, which was the quantitative medium, having the relationship that the viscosity $\alpha_3$ (cp) of the ink sample and that $\beta_3$ (cp) of the diluent sample satisfied $\alpha_3-\beta_3 \geqq 0$ resulted in deviation being 60 $\mu$m or smaller which was a practically allowable value. If the deviation was larger than 60 $\mu$m, a white portion (lack of dots) undesirably took place in the printed pattern.

Example 6-4

In this example, diluent samples 5-10 and 5-11 and ink samples 5-10 and 5-11 according Example 5-4 were used such that the diluent samples 5-10 and 5-11 were used as discharge mediums and ink samples 5-10 and 5-11 were used ad quantitative mediums in the printing operations for evaluating the discharge stability.

That is, ink samples 5-10 and 5-11 and diluent samples 5-10 and 5-11 were combined variously and the concentration of ink was changed in the printing operations so as to evaluate the discharge stability similarly to Example 5-1. Results were shown in Table 98 similarly to Table 94.

TABLE 98

| | Ink Samples | | | | | | | |
|---|---|---|---|---|---|---|---|---|
| Diluent | 5-10 | | | | 5-11 | | | |
| Samples | a | b | c | d | a | b | c | d |
| 5-10 | ○ | ○ | Δ | Δ | ○ | ○ | ○ | ○ |
| 5-11 | Δ | Δ | X | X | ○ | ○ | Δ | Δ |

As can be understood from the results shown in Table 98, the combination of the ink sample, which was the discharge medium, and diluent sample, which was the quantitative medium, having the relationship that the viscosity $\alpha_3$ (cp) of the ink sample and that $\beta_3$ (cp) of the diluent sample satisfied $\alpha_3-\beta_3 \geqq 0$ resulted in deviation being 60 $\mu$m or smaller which was a practically allowable value. If the deviation was larger than 60 $\mu$m, a white portion (lack of dots) undesirably took place in the printed pattern.

Example 6-5

Then, ink samples 5-10 and 5-11 according to Example 6-4 ad diluent samples 5-1 to 5-9 according to Examples 6-1 and 6-2 were combined variously so that the discharge stability was evaluated similarly to Example 5-1. Results were shown in Table 99 similarly to Table 94.

TABLE 99

| | Ink Samples | | | | | | | |
|---|---|---|---|---|---|---|---|---|
| Diluent | 5-10 | | | | 5-11 | | | |
| Samples | a | b | c | d | a | b | c | d |
| 5-1 | ○ | ○ | ○ | ○ | ○ | ○ | ○ | ○ |
| 5-2 | ○ | ○ | Δ | Δ | ○ | ○ | ○ | ○ |
| 5-3 | Δ | Δ | X | X | ○ | ○ | Δ | Δ |
| 5-4 | Δ | X | X | X | Δ | Δ | X | X |
| 5-5 | X | X | X | X | Δ | X | X | X |
| 5-6 | ○ | ○ | ○ | ○ | ○ | ○ | ○ | ○ |
| 5-7 | Δ | Δ | X | X | ○ | ○ | ○ | ○ |
| 5-8 | Δ | Δ | X | X | Δ | Δ | X | X |
| 5-9 | X | X | X | X | Δ | X | X | X |

Ink samples according to Examples 6-1 and 6-2 and diluent samples 5-10 and 5-11 according to Example 6-4 were combined variously so that the discharge stability was evaluated similarly to Example 5-1. Results were shown in Tables 100 and 101 similarly to Table 94.

TABLE 100

| | Ink Samples | | | | | | | | | | | |
|---|---|---|---|---|---|---|---|---|---|---|---|---|
| Diluent | 5-1 | | | | 5-2 | | | | 5-3 | | | |
| Samples | a | b | c | d | a | b | c | d | a | b | c | d |
| 5-10 | Δ | Δ | X | X | ○ | ○ | Δ | Δ | ○ | ○ | ○ | ○ |
| 5-11 | Δ | X | X | X | Δ | Δ | X | X | ○ | ○ | Δ | Δ |

| Diluent | 5-4 | | | | 5-5 | | | |
|---|---|---|---|---|---|---|---|---|
| Samples | a | b | c | d | a | b | c | d |
| 5-10 | ○ | ○ | ○ | ○ | ○ | ○ | ○ | ○ |
| 5-11 | ○ | ○ | ○ | ○ | ○ | ○ | ○ | ○ |

TABLE 101

| | Ink Samples | | | | | | | |
|---|---|---|---|---|---|---|---|---|
| Diluent | 5-6 | | | | 5-7 | | | |
| Samples | a | b | c | d | a | b | c | d |
| 5-10 | Δ | Δ | X | X | ○ | ○ | ○ | ○ |
| 5-11 | Δ | X | X | X | Δ | Δ | X | X |

| | Ink Samples | | | | | | | |
|---|---|---|---|---|---|---|---|---|
| Diluent | 5-8 | | | | 5-9 | | | |
| Samples | a | b | c | d | a | b | c | d |
| 5-10 | ○ | ○ | ○ | ○ | ○ | ○ | ○ | ○ |
| 5-11 | ○ | ○ | ○ | ○ | ○ | ○ | ○ | ○ |

As can be understood from the results shown in Tables 99 to 101, the combination of the ink sample, which was the discharge medium, and diluent sample, which was the quantitative medium, having the relationship that the viscosity $\alpha_3$ (cp) of the ink sample and that $\beta_3$ (cp) of the diluent sample satisfied $\alpha_3-\beta_3 \geqq 0$ resulted in deviation being 60 $\mu$m or smaller which was a practically allowable value. If the deviation was larger than 60 $\mu$m, a white portion (lack of dots) undesirably took place in the printed pattern.

As described above, the recording method according to the present invention uses the discharge medium and the quantitative medium satisfying the relationship as $q-p \geqq 0$ on the assumption that the surface tension of the discharge medium is q (dyn/cm) and that of the quantitative medium is p (dyn/cm); and mixes the mediums at a predetermined mixing ratio immediately before discharge and then applies the discharged mixed solution to the surface of a recording medium. Since the surface tensions of the discharge medium and the quantitative medium have the above-mentioned relationship, the mediums can satisfactorily be mixed with each other. Therefore, accurate expression of a gradient image can be performed.

The recording method according to the present invention is structured in such a manner that the relationship as $\beta-\alpha \geqq 0$ is satisfied on the assumption that the viscosity of the quantitative medium is $\alpha$ (cp) and the viscosity of the discharge medium is $\beta$ (cp). Therefore, discharge of the mixed mediums can stably be performed, that is, the discharge stability can be improved.

The recording method according to the present invention is structured in such a manner that the period of time taken from mixing of the discharge medium and the quantitative medium with each other to the application of the mixed solution to the surface of the recording medium is made to be 1 (msec) or shorter so that the quantitative medium and the discharge medium are further satisfactorily mixed with each other with practical printing speed and accuracy of the discharge position. Therefore, further accurate expression of a gradient image can be performed.

The printer according to the present invention arranged to discharge a discharge medium from a first nozzle so as to mix and discharge the quantitative medium and the discharge medium after the quantitative medium has been allowed to seep from the second nozzle allowed to communicate with the second pressure chamber to which the quantitative medium is introduced toward the first nozzle allowed to communicate with the first pressure chamber into which the discharge medium is introduced and opened adjacently to the second nozzle is structured in such a manner that the discharge medium and the quantitative medium satisfy the relationship as $\alpha-\beta \geqq 0$ on the assumption that the viscosity of the discharge medium is $\alpha$ (cp) and the viscosity of the quantitative medium is $\beta$ (cp). Therefore, the viscosity of the quantitative medium and that of the discharge medium and their relationship can be made to be suitable for use in the mixing operation and the discharge operation. As a result, the discharge stability of the medium can be maintained. As a result, accurate expression of a gradient image can be performed.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A printing method comprising the steps of:

allowing a quantitative medium to seep out; and discharging a discharge medium to mix the quantitative medium and the discharge medium with each other so as to discharge and apply the quantitative medium and the discharge medium to the surface of a recording medium, wherein relationship as $q-p \geqq 0$ is satisfied wherein the surface tension of the quantitative medium is p (dyn/cm) and the surface tension of the discharge medium is q (dyn/cm).

2. A printing method according to claim 1, wherein the quantitative medium is ink and the discharge medium is diluent.

3. A printing method according to claim 2, wherein the surface tension of the quantitative medium is 25 (dyn/cm) to 60 (dyn/cm) and the surface tension of the discharge medium is 30 (dyn/cm) to 70 (dyn/cm).

4. A printing method according to claim 1, wherein the quantitative medium is diluent and the discharge medium is ink.

5. A printing method according to claim 4, wherein the surface tension of the quantitative medium is 25 (dyn/cm) to 60 (dyn/cm) and the surface tension of the discharge medium is 30 (dyn/cm) to 60 (dyn/cm).

6. A printing method comprising the steps of:

allowing a quantitative medium to seep out; and discharging a discharge medium to mix the quantitative medium and the discharge medium with each other so as to discharge and apply the quantitative medium and the discharge medium to the surface of a recording medium, wherein relationship as $\beta-\alpha \geqq 0$ is satisfied wherein the viscosity of the quantitative medium is $\alpha$ (cp) and the viscosity of the discharge medium is $\beta$ (cp).

7. A printing method according to claim 6, wherein the quantitative medium is ink and the discharge medium is diluent.

8. A printing method according to claim 6, wherein the viscosity of the quantitative medium is 1 (cp) to 15 (cp) and the viscosity of the discharge medium is 1 (cp) to 15 (cp).

9. A printing method comprising the steps of:

allowing a quantitative medium to seep out; and discharging a discharge medium to mix the quantitative medium and the discharge medium with each other so as to discharge and apply the quantitative medium and the discharge medium to the surface of a recording medium, wherein relationship as $q-p \geqq 0$ is satisfied wherein the surface tension of the quantitative medium is p (dyn/cm) and the surface tension of the discharge medium is q (dyn/cm) and relationship as $\beta-\alpha \geqq 0$ is satisfied wherein the viscosity of the quantitative medium is $\alpha$ (cp) and the viscosity of the discharge medium is $\beta$ (cp).

10. A printing method according to claim 9, wherein the viscosity of the quantitative medium is 1 (cp) to 15 (cp) and the viscosity of the discharge medium is 1 (cp) to 15 (cp).

11. A printing method according to claim 9, wherein the quantitative medium is ink and the discharge medium is diluent.

12. A printing method according to claim 11, wherein the surface tension of the quantitative medium is 25 (dyn/cm) to 60 (dyn/cm) and the surface tension of the discharge medium is 30 (dyn/cm) to 70 (dyn/cm).

13. A printing method according to claim 9, wherein the quantitative medium is diluent and the discharge medium is ink.

14. A printing method according to claim 13, wherein the surface tension of the quantitative medium is 25 (dyn/cm) to 60 (dyn/cm) and the surface tension of the discharge medium is 30 (dyn/cm) to 60 (dyn/cm).

15. A printer comprising:

a printing head having a first pressure chamber into which a discharge medium is introduced, a second pressure chamber into which a quantitative medium is introduced, a first nozzle allowed to communicate with the first pressure chamber and a second nozzle allowed to communicate with the second pressure chamber which are opened adjacently and structured to discharge the discharge medium from the first nozzle after the quantitative medium has been allowed to seep from the second nozzle toward the first nozzle so that the quantitative medium and the discharge medium are mixed and discharged, wherein relationship as $q-p \geqq 0$ is satisfied wherein the surface tension of the quantitative medium is p (dyn/cm) and the surface tension of the discharge medium is q (dyn/cm).

16. A printer according to claim 15, wherein the quantitative medium is ink and the discharge medium is diluent.

17. A printer according to claim 16, wherein the surface tension of the quantitative medium is 25 (dyn/cm) to 60 (dyn/cm) and the surface tension of the discharge medium is 30 (dyn/cm) to 70 (dyn/cm).

18. A printer according to claim 15, wherein the quantitative medium is diluent and the discharge medium is ink.

19. A printer according to claim 18, wherein the surface tension of the quantitative medium is 25 (dyn/cm) to 60 (dyn/cm) and the surface tension of the discharge medium is 30 (dyn/cm) to 60 (dyn/cm).

20. A printer comprising:

a printing head having a first pressure chamber into which a discharge medium is introduced, a second pressure chamber into which a quantitative medium is introduced, a first nozzle allowed to communicate with the first pressure chamber and a second nozzle allowed to communicate with the second pressure chamber which are opened adjacently and structured to discharge the discharge medium from the first nozzle after the quantitative medium has been allowed to seep from the second nozzle toward the first nozzle so that the quantitative medium and the discharge medium are mixed and discharged, wherein relationship as $\beta-\alpha \geqq 0$ is satisfied wherein the viscosity of the quantitative medium is $\alpha$ (cp) and the viscosity of the discharge medium is $\beta$ (cp).

21. A printer according to claim 20, wherein the quantitative medium is ink and the discharge medium is diluent.

22. A printer according to claim 20, wherein the viscosity of the quantitative medium is 1 (cp) to 15 (cp) and the viscosity of the discharge medium is 1 (cp) to 15 (cp).

23. A printer comprising:

a printing head having a first pressure chamber into which a discharge medium is introduced, a second pressure chamber into which a quantitative medium is introduced, a first nozzle allowed to communicate with the first pressure chamber and a second nozzle allowed to communicate with the second pressure chamber which are opened adjacently and structured to discharge the discharge medium from the first nozzle after the quantitative medium has been allowed to seep from the second nozzle toward the first nozzle so that the quantitative medium and the discharge medium are mixed and discharged, wherein relationship as $q-p \geqq 0$ is satisfied wherein the surface tension of the quantitative medium is p (dyn/cm) and the surface tension of the discharge medium is q (dyn/cm) and relationship as $\beta-\alpha \geqq 0$ is satisfied wherein the viscosity of the quantitative medium is $\alpha$ (cp) and the viscosity of the discharge medium is $\beta$ (cp).

24. A printer according to claim 23, wherein the viscosity of the quantitative medium is 1 (cp) to 15 (cp) and the viscosity of the discharge medium is 1 (cp) to 15 (cp).

25. A printer according to claim 23 wherein the quantitative medium is ink and the discharge medium is diluent.

26. A printer according to claim 25, wherein the surface tension of the quantitative medium is 25 (dyn/cm) to 60 (dyn/cm) and the surface tension of the discharge medium is 30 (dyn/cm) to 70 (dyn/cm).

27. A printer according to claim 23, wherein the quantitative medium is diluent and the discharge medium is ink.

28. A printer according to claim 27, wherein the surface tension of the quantitative medium is 25 (dyn/cm) to 60 (dyn/cm) and the surface tension of the discharge medium is 30 (dyn/cm) to 60 (dyn/cm).

* * * * *